US012156561B2

(12) United States Patent
Laperriere et al.

(10) Patent No.: US 12,156,561 B2
(45) **Date of Patent: *Dec. 3, 2024**

(54) HELMET FOR IMPACT PROTECTION

(71) Applicant: BAUER HOCKEY, LLC, Exeter, NH (US)

(72) Inventors: Jean-Francois Laperriere, Prevost (QA); Thierry Krick, Coteau-du-Lac (CA); Jacques Durocher, Saint-Jerome (CA); Ryan Ouckama, Montreal (CA); Marie-Claude Genereux, Sainte-Therese (CA); Denis Cote, Saint-Colomban (CA); Philippe Jean, Terrebonne (CA); Ken Covo, Pointe-Claire (CA); Garnet Alexander, Beaconsfield (CA); Jean-Marie Bidal, Saint-Jerome (CA)

(73) Assignee: BAUER HOCKEY LLC, Exeter, NH (US)

( * ) Notice: Subject to any disclaimer, the term of this patent is extended or adjusted under 35 U.S.C. 154(b) by 59 days.

This patent is subject to a terminal disclaimer.

(21) Appl. No.: 17/871,370

(22) Filed: Jul. 22, 2022

(65) Prior Publication Data

US 2023/0024564 A1 Jan. 26, 2023

Related U.S. Application Data

(63) Continuation of application No. 16/594,488, filed on Oct. 7, 2019, now Pat. No. 11,425,951, which is a (Continued)

(51) Int. Cl.

| | |
|---|---|
| ***A42B 3/06*** | (2006.01) |
| ***A42B 3/12*** | (2006.01) |
| ***A42B 3/32*** | (2006.01) |

(52) U.S. Cl.

CPC ..... *A42B 3/064* (2013.01); *A42B 3/121* (2013.01); *A42B 3/124* (2013.01); *A42B 3/324* (2013.01)

(58) Field of Classification Search

CPC ..... A42B 3/064; A42B 3/121; A42B 3/324; A42B 3/12; A42B 3/125; A42B 3/145; A42B 3/14; A42B 3/10

See application file for complete search history.

(56) References Cited

U.S. PATENT DOCUMENTS

| | | | |
|---|---|---|---|
| 3,350,718 | A | 11/1967 | Webb |
| 3,413,656 | A | 12/1968 | Vogliano et al. |

(Continued)

FOREIGN PATENT DOCUMENTS

| | | |
|---|---|---|
| CA | 1154552 | 10/1983 |
| CA | 1183302 | 3/1985 |

(Continued)

OTHER PUBLICATIONS

*Bauer Hockey Corp.* v. *Sport Maska Inc. d.b.a. Reebok-CCM Hockey* (Court No. T-123-15) Further Amended Statement of Claim. Mar. 19, 2015. 298 pages.

(Continued)

*Primary Examiner* — Jameson D Collier

(57) ABSTRACT

A helmet for protecting a head of a wearer, such as a hockey, lacrosse, football or other sports player. The helmet includes an outer shell and an inner padding disposed between the outer shell and the wearer's head when the helmet is worn. The inner padding includes a plurality of shock absorbers and an interconnector interconnecting the shock absorbers, each shock absorber being deformable in response to a rotational impact on the helmet such that an outer part of the shock absorber moves relative to an inner part of the shock (Continued)

absorber in a direction tangential to an angular movement of the outer shell due to the rotational impact.

20 Claims, 49 Drawing Sheets

Related U.S. Application Data continuation of application No. 15/106,192, filed as application No. PCT/CA2014/000911 on Dec. 19, 2014, now Pat. No. 10,477,909.

(60) Provisional application No. 61/918,092, filed on Dec. 19, 2013.

(56) References Cited

U.S. PATENT DOCUMENTS

| | | | |
|---|---|---|---|
| 3,447,162 | A | 6/1969 | Aileo |
| 3,471,866 | A | 10/1969 | Raney |
| 3,609,764 | A | 10/1971 | Morgan |
| 3,866,243 | A | 2/1975 | Morgan |
| 3,897,597 | A | 8/1975 | Kasper |
| 4,012,794 | A | 3/1977 | Nomiyama |
| 4,023,213 | A | 5/1977 | Rovani |
| 4,024,586 | A | 5/1977 | Lamb |
| 4,055,860 | A | 11/1977 | King |
| 4,185,331 | A | 1/1980 | Nomiyama |
| 4,287,613 | A | 9/1981 | Schulz |
| 4,307,471 | A | 12/1981 | Lovell |
| 4,477,929 | A | 10/1984 | Mattson |
| 4,685,315 | A | 8/1987 | Comolli |
| 4,932,076 | A | 6/1990 | Giorgio et al. |
| 4,942,628 | A | 7/1990 | Freung |
| 5,068,922 | A | 12/1991 | Zahn |
| 5,204,998 | A | 4/1993 | Liu |
| 5,249,347 | A | 10/1993 | Marinitz |
| 5,315,718 | A | 5/1994 | Barson et al. |
| 5,412,814 | A | 5/1995 | Pernicka et al. |
| 5,483,699 | A | 1/1996 | Pernicka et al. |
| 5,511,250 | A | 4/1996 | Field et al. |
| 5,571,217 | A | 11/1996 | Del Bon et al. |
| 5,638,551 | A | 6/1997 | Lallemand |
| D400,311 | S | 10/1998 | Chartrand |
| 5,832,569 | A | 11/1998 | Berg |
| 5,845,341 | A | 12/1998 | Barthold et al. |
| 5,867,840 | A | 2/1999 | Hirosawa et al. |
| 5,950,244 | A | 9/1999 | Fournier et al. |
| 5,950,245 | A | 9/1999 | Binduga |
| 5,953,761 | A | 9/1999 | Jurga et al. |
| 5,956,776 | A | 9/1999 | Chartrand |
| 6,032,297 | A | 3/2000 | Barthold et al. |
| 6,081,931 | A | 7/2000 | Burns et al. |
| 6,101,636 | A | 8/2000 | Williams |
| 6,108,824 | A | 8/2000 | Fournier et al. |
| 6,125,477 | A | 10/2000 | Croppa et al. |
| 6,240,571 | B1 | 6/2001 | Infusino |
| 6,256,798 | B1 | 7/2001 | Egolf et al. |
| 6,272,692 | B1 | 8/2001 | Abraham |
| 6,298,497 | B1 | 10/2001 | Chartrand |
| 6,324,700 | B1 | 12/2001 | McDougall |
| 6,338,165 | B1 | 1/2002 | Biondich |
| 6,385,780 | B1 | 5/2002 | Racine |
| 6,389,607 | B1 | 5/2002 | Wood |
| 6,401,261 | B1 | 6/2002 | Amey et al. |
| 6,453,476 | B1 | 9/2002 | Moore, III |
| 6,560,787 | B2 | 5/2003 | Mendoza |
| 6,592,536 | B1 | 7/2003 | Argenta |
| 6,658,671 | B1 | 12/2003 | Von Holst et al. |
| 6,681,409 | B2 | 1/2004 | Dennis et al. |
| 6,751,808 | B2 | 6/2004 | Puchalski |
| 6,772,447 | B2 | 8/2004 | Morrow et al. |
| 6,817,039 | B1 | 11/2004 | Grilliot et al. |
| 6,862,747 | B2 | 3/2005 | Oleson |
| 6,865,752 | B2 | 3/2005 | Udelhofen et al. |
| 6,883,183 | B2 | 4/2005 | Morrow et al. |
| 6,886,183 | B2 | 5/2005 | DeHaan et al. |
| 6,920,644 | B1 | 7/2005 | Higgs |
| 6,934,971 | B2 | 8/2005 | Ide et al. |
| 6,952,839 | B2 | 10/2005 | Long |
| 6,961,963 | B2 | 11/2005 | Rosie |
| 6,964,066 | B2 | 11/2005 | Tucker |
| 6,966,075 | B2 | 11/2005 | Racine |
| 6,968,575 | B2 | 11/2005 | Durocher |
| 6,981,284 | B2 | 1/2006 | Durocher |
| 6,996,856 | B2 | 2/2006 | Puchalski |
| 7,043,772 | B2 | 5/2006 | Bielefeld et al. |
| 7,076,811 | B2 | 7/2006 | Puchalski |
| 7,174,575 | B1 | 2/2007 | Scherer |
| 7,222,374 | B2 | 5/2007 | Musal et al. |
| 7,341,776 | B1 | 3/2008 | Milliren et al. |
| 7,603,725 | B2 | 10/2009 | Harris |
| 7,634,820 | B2 | 12/2009 | Rogers et al. |
| 7,673,351 | B2 | 3/2010 | Copeland |
| 7,677,538 | B2 | 3/2010 | Darnell et al. |
| 7,870,618 | B2 | 1/2011 | Pilon et al. |
| 7,908,678 | B2 | 3/2011 | Brine, III et al. |
| 7,930,771 | B2 | 4/2011 | Depreitere et al. |
| 7,950,073 | B2 | 5/2011 | Ferrara |
| 7,954,178 | B2 | 6/2011 | Durocher et al. |
| 8,037,548 | B2 | 10/2011 | Alexander et al. |
| 8,039,078 | B2 | 10/2011 | Moore et al. |
| 8,095,995 | B2 | 1/2012 | Alexander et al. |
| 8,156,574 | B2 | 4/2012 | Stokes et al. |
| 8,296,867 | B2 | 10/2012 | Rudd et al. |
| 8,296,868 | B2 | 10/2012 | Bélanger et al. |
| 8,316,512 | B2 | 11/2012 | Halldin |
| 8,448,266 | B2 | 10/2013 | Alexander et al. |
| 8,544,118 | B2 | 10/2013 | Brine, III et al. |
| 8,566,968 | B2 | 10/2013 | Marzec et al. |
| 8,566,969 | B2 | 10/2013 | Glogowski et al. |
| 8,578,520 | B2 | 11/2013 | Halldin |
| 8,713,716 | B2 | 5/2014 | Krueger |
| 8,832,870 | B2 | 9/2014 | Bélanger et al. |
| 8,850,622 | B2 | 10/2014 | Finiel et al. |
| 8,887,318 | B2 | 11/2014 | Mazzarolo et al. |
| 9,095,179 | B2 | 8/2015 | Kwan et al. |
| 9,345,282 | B2 | 5/2016 | Durocher et al. |
| 9,743,702 | B2 | 8/2017 | Warmouth |
| 9,961,952 | B2 | 5/2018 | Durocher |
| 10,292,449 | B2 | 5/2019 | Durocher et al. |
| 10,306,941 | B2 | 6/2019 | Durocher et al. |
| 10,334,904 | B2 | 7/2019 | Durocher et al. |
| 10,477,909 | B2 | 11/2019 | Laperriere et al. |
| 11,089,833 | B2 | 8/2021 | Durocher |
| 11,425,951 | B2 | 8/2022 | Laperriere et al. |
| 11,638,458 | B2 | 5/2023 | Durocher |
| 2001/0032351 | A1 | 10/2001 | Nakayama et al. |
| 2002/0035748 | A1 | 3/2002 | Racine |
| 2003/0070201 | A1 | 4/2003 | McClelland |
| 2003/0106138 | A1 | 6/2003 | Guay |
| 2003/0135914 | A1 | 7/2003 | Racine et al. |
| 2003/0221245 | A1 | 12/2003 | Lee et al. |
| 2004/0025231 | A1 | 2/2004 | Ide et al. |
| 2004/0040073 | A1 | 3/2004 | Morrow et al. |
| 2004/0117896 | A1 | 6/2004 | Madey et al. |
| 2004/0117897 | A1 | 6/2004 | Udelhofen et al. |
| 2004/0168246 | A1 | 9/2004 | Phillips |
| 2004/0172739 | A1 | 9/2004 | Racine |
| 2004/0199981 | A1 | 10/2004 | Tucker |
| 2004/0250340 | A1 | 12/2004 | Piper et al. |
| 2004/0255370 | A1 | 12/2004 | Moeller et al. |
| 2005/0015857 | A1 | 1/2005 | Desjardins et al. |
| 2005/0034222 | A1 | 2/2005 | Durocher |
| 2005/0034223 | A1 | 2/2005 | Durocher |
| 2005/0125882 | A1 | 6/2005 | Long |
| 2005/0262619 | A1 | 12/2005 | Musal et al. |
| 2006/0059606 | A1 | 3/2006 | Ferrara |
| 2006/0096011 | A1 | 5/2006 | Dennis et al. |
| 2006/0191403 | A1 | 8/2006 | Hawkind et al. |
| 2006/0206994 | A1 | 9/2006 | Rogers et al. |
| 2007/0044193 | A1 | 3/2007 | Durocher et al. |
| 2007/0079429 | A1 | 4/2007 | Pilon et al. |
| 2007/0083965 | A1 | 4/2007 | Darnell et al. |

(56) References Cited

U.S. PATENT DOCUMENTS

| | | | | |
|---|---|---|---|---|
| 2007/0157370 | A1 | 7/2007 | Joubert Des Ouches | |
| 2007/0169251 | A1 | 7/2007 | Rogers et al. | |
| 2007/0190292 | A1 | 8/2007 | Ferrara | |
| 2007/0199136 | A1 | 8/2007 | Brine et al. | |
| 2007/0245466 | A1 | 10/2007 | Lilenthal et al. | |
| 2007/0266481 | A1 | 11/2007 | Garnet et al. | |
| 2008/0066217 | A1 | 3/2008 | Depreitere et al. | |
| 2008/0155735 | A1 | 7/2008 | Ferrara | |
| 2008/0276354 | A1 | 11/2008 | Stokes et al. | |
| 2008/0289085 | A1 | 11/2008 | Bryant et al. | |
| 2009/0031482 | A1 | 2/2009 | Stokes et al. | |
| 2009/0038055 | A1 | 2/2009 | Ferrara | |
| 2009/0044315 | A1 | 2/2009 | Belanger et al. | |
| 2009/0158506 | A1 | 6/2009 | Thompson et al. | |
| 2009/0188022 | A1 | 6/2009 | Durocher et al. | |
| 2009/0178184 | A1 | 7/2009 | Brine, III et al. | |
| 2009/0222978 | A1 | 9/2009 | Fang | |
| 2010/0005573 | A1 | 1/2010 | Rudd et al. | |
| 2010/0043126 | A1 | 2/2010 | Morel | |
| 2010/0050323 | A1 | 3/2010 | Durocher et al. | |
| 2010/0107317 | A1 | 5/2010 | Wang | |
| 2010/0115686 | A1 | 5/2010 | Halldin | |
| 2010/0132099 | A1 | 6/2010 | Green et al. | |
| 2010/0151631 | A1 | 6/2010 | Pu et al. | |
| 2010/0180363 | A1 | 7/2010 | Glogowski et al. | |
| 2010/0186150 | A1 | 7/2010 | Ferrara et al. | |
| 2011/0004980 | A1 | 1/2011 | Leatt et al. | |
| 2011/0047679 | A1 | 3/2011 | Rogers et al. | |
| 2011/0083251 | A1 | 4/2011 | Mandell | |
| 2011/0117310 | A1 | 5/2011 | Anderson et al. | |
| 2011/0171420 | A1 | 7/2011 | Yang | |
| 2012/0060251 | A1 | 3/2012 | Schimpf | |
| 2012/0096631 | A1 | 4/2012 | King et al. | |
| 2012/0110720 | A1 | 5/2012 | Mazzarolo et al. | |
| 2012/0198604 | A1 | 8/2012 | Weber et al. | |
| 2012/0204329 | A1 | 8/2012 | Faden et al. | |
| 2012/0208032 | A1 | 8/2012 | Faden et al. | |
| 2013/0000018 | A1 | 1/2013 | Rudd et al. | |
| 2013/0025032 | A1 | 1/2013 | Durocher et al. | |
| 2013/0040524 | A1 | 2/2013 | Halldin et al. | |
| 2013/0061371 | A1 | 3/2013 | Phipps et al. | |
| 2013/0122256 | A1 | 5/2013 | Kleiven et al. | |
| 2013/0185837 | A1 | 7/2013 | Phipps et al. | |
| 2013/0247284 | A1 | 9/2013 | Hoshizaki et al. | |
| 2014/0013492 | A1 | 1/2014 | Bottlang et al. | |
| 2014/0109300 | A1 | 4/2014 | Durocher et al. | |
| 2014/0189945 | A1 | 7/2014 | Golnaraghi et al. | |
| 2015/0089722 | A1 | 4/2015 | Berry | |
| 2015/0089724 | A1 | 4/2015 | Berry | |
| 2015/0113718 | A1 | 4/2015 | Bayer | |
| 2015/0216248 | A1 | 8/2015 | Blair | |
| 2015/0237945 | A1* | 8/2015 | Vito | A42B 3/125 2/414 |
| 2015/0264993 | A1* | 9/2015 | Vito | A42B 3/125 2/414 |
| 2016/0073723 | A1* | 3/2016 | Halldin | A42B 3/06 2/411 |
| 2016/0235151 | A1 | 8/2016 | Durocher et al. | |
| 2016/0316847 | A1* | 11/2016 | Weber | A42B 3/064 |
| 2019/0116911 | A1 | 4/2019 | Durocher et al. | |
| 2019/0350297 | A1 | 11/2019 | Durocher et al. | |
| 2020/0187582 | A1 | 6/2020 | Laperriere et al. | |
| 2021/0076769 | A1 | 3/2021 | Kirshon | |
| 2021/0153594 | A1 | 5/2021 | Rogers et al. | |
| 2021/0401103 | A1 | 12/2021 | Durocher | |
| 2023/0292872 | A1 | 9/2023 | Durocher | |

FOREIGN PATENT DOCUMENTS

| | | |
|---|---|---|
| CA | 1217601 | 2/1987 |
| CA | 1290324 | 10/1991 |
| CA | 2048028 | 12/1994 |
| CA | 2230616 | 3/1997 |
| CA | 2191683 | 3/2005 |
| CA | 2290324 | 5/2005 |
| CA | 2321399 | 7/2005 |
| CA | 2191693 | 11/2005 |
| CA | 2598015 | 8/2006 |
| CA | 2273621 | 2/2008 |
| CA | 2357690 | 1/2009 |
| CA | 2638703 | 2/2009 |
| CA | 2916360 | 2/2009 |
| CA | 2437626 | 4/2009 |
| CA | 2533493 | 5/2009 |
| CA | 2561540 | 8/2010 |
| CA | 2573640 | 9/2010 |
| CA | 2759915 | 2/2012 |
| CA | 2573639 | 5/2012 |
| CA | 2872140 | 10/2012 |
| CA | 2880069 | 10/2012 |
| CA | 3133927 | 10/2012 |
| CA | 2917968 | 1/2013 |
| CA | 2659638 | 7/2013 |
| CA | 2784316 | 10/2013 |
| CA | 2804937 | 11/2013 |
| CA | 2878613 | 1/2014 |
| CA | 2821540 | 1/2015 |
| CA | 2847669 | 2/2015 |
| CA | 2838103 | 3/2015 |
| CA | 2798542 | 7/2015 |
| CA | 2783079 | 3/2016 |
| CA | 2966656 | 5/2016 |
| CA | 2963353 | 2/2018 |
| CA | 3018280 | 11/2021 |
| CA | 2934368 | 3/2023 |
| DE | 10037461 | 2/2002 |
| EP | 1142495 | 10/2001 |
| EP | 1494990 | 1/2005 |
| EP | 1635664 | 3/2006 |
| EP | 1429635 | 7/2007 |
| EP | 2550885 | 1/2013 |
| EP | 2550886 | 1/2013 |
| EP | 2742817 | 6/2014 |
| GB | 191419109 | 2/1915 |
| JP | H03122726 | 5/1991 |
| JP | 2005146468 | 6/2005 |
| SE | 518223 | 9/2002 |
| SE | 1050458 | 1/2012 |
| WO | 19960014768 | 5/1996 |
| WO | 2001045526 | 6/2001 |
| WO | 2004000054 | 12/2003 |
| WO | 2006005143 | 1/2006 |
| WO | 2006005183 | 1/2006 |
| WO | 2006099928 | 9/2006 |
| WO | 2007025500 | 3/2007 |
| WO | 2008085108 | 7/2008 |
| WO | 2008103107 | 8/2008 |
| WO | 2010082919 | 7/2010 |
| WO | 2010122586 | 10/2010 |
| WO | 2010151631 | 12/2010 |
| WO | 2011139224 | 11/2011 |
| WO | 2011141562 | 11/2011 |
| WO | 2015166598 | 11/2015 |

OTHER PUBLICATIONS

*Bauer Hockey Corp.* v. *Sport Maska Inc. d.b.a. Reebok-CCM Hockey* (Court No. T-123-15) Motion Record: Defendant's Motion Record For an Extension of Time. Jul. 3, 2015. 43 pages.

*Bauer Hockey Corp.* v. *Sport Maska Inc. d.b.a. Reebok-CCM Hockey* (Court No. T-123-15) Plaintiffs Amended Motion to Strike, for Particulars, for Production of Documents and for a Scheduling Order. Jun. 15, 2016. 119 pages.

*Bauer Hockey Corp.* v. *Sport Maska Inc. d.b.a. Reebok-CCM Hockey* (Court No. T-123-15) Plaintiffs Motion to Strike, for Particulars, for Production of Documents and for a Scheduling Order. Dec. 31, 2015. 496 pages.

*Bauer Hockey Corp.* v. *Sport Maska Inc. d.b.a. Reebok-CCM Hockey* (Court No. T-123-15) Reply and Defence to Counterclaim. Oct. 6, 2016. 13 pages.

(56) References Cited

OTHER PUBLICATIONS

*Bauer Hockey Corp.* v. *Sport Maska Inc. d.b.a. Reebok-CCM Hockey* (Court No. T-123-15) Statement of Claim. Jan. 28, 2015. 13 pages.
*Bauer Hockey Corp.* v. *Sport Maska Inc. d.b.a. Reebok-CCM Hockey* (Court No. T-123-15) Statement of Defence and Counterclaim. Jul. 3, 2015. 29 pages.
*Bauer Hockey Corp.* v. *Sport Maska Inc. d.b.a. Reebok-CCM Hockey* (Court No. T-123-15) Thrice Amended Statement of Claim. Feb. 19, 2016. 411 pages.
*Bauer Hockey Corp.* v. *Sport Maska Inc. d.b.a. Reebok-CCM Hockey* (Court No. T-123-15, T-546-12, T-311-12) Motion Record of the Moving Party Sport Maska Inc. d.b.a. Reebok-CCM Hockey vol. 2. Oct. 4, 2017. 480 pages.
*Bauer Hockey Corp.* v. *Sport Maska Inc. d.b.a. Reebok-CCM Hockey* (Court No. T-123-15, T-546-12, T-311-12) Motion Record of the Moving Party Sport Maska Inc. d.b.a. Reebok-CCM Hockey vol. 3. Oct. 4, 2017. 321 pages.
*Bauer Hockey Corp.* v. *Sport Maska Inc. d.b.a. Reebok-CCM Hockey* (Court No. T-123-15, T-546-12, T-311-12) Notice of Motion (Motion to Dismiss). Oct. 4, 2017. 12 pages.
*Bauer Hockey Corp.* v. *Sport Maska Inc. d.b.a. Reebok-CCM Hockey*. Plaintiffs Notice of Motion (Plaintiffs Motion to Strike, for Particulars, for Production of Documents and for a Scheduling Order). Court No. T-123-15. Dec. 31, 2015. 496 pages.
Bicycle Retailer Article titled "Lazer to Add Eyewear to Helmet Line", published on Jun. 26, 2011, 3 pagesé.
Burton RED Hi-hi MIPS Helmet provided to Bauer on Jul. 12, 2011, 22 pages.
"CNW Group Ltd., ""Bauer Hockey Unveils Revolutionary New Products During BauerWorld 2012"", Orlando, FL, Oct. 27, 2011, document retrieved on Sep. 22, 2015 at http://www.newswire.ca/newsreleases/bauerhockeyunveilsrevolutionarynewproductsduringbauerworld2012508943451.html, 4 pages".
Dimock Stratton LLP "MIPS AB and Bauer Hockey Corp. and Bauer Hockey, Inc., Further Amended Statement of Claim", Document filed at the Federal Court of Canada on Jan. 15, 2015 and amended on Apr. 24, 2015, Court File No. T-56-15, 35 pages.
Dimock Stratton LLP "MIPS AB and Bauer Hockey Ltd. and Bauer Hockey, LLC, Thrice Amended Statement of Claim", Document filed at the Federal Court of Canada on Jun. 19, 2017, Court File No. T-56-15, 46 pages.
DLA Piper (Canada) LLP "MIPS AB and Bauer Hockey Ltd. and Bauer Hockey, LLC, Amended Reply And Defence to Counterclaim", Document filed at the Federal Court of Canada on Jul. 21, 2017, Court File No. T-56-15, 14 pages.
Easton Hockey 2008 Product Catalogue p. 38-40 Stealth S-17 with MonoLock and In Form Fit System.
Easton Hockey 2009 Product Catalogue p. 39-40 Stealth S-17 with MonoLock and In Form Fit System.
Easton Hockey 2011 Product Catalogue p. 24 Stealth S-17, S-13.
Easton Hockey 2012 Product Catalogue p. 19 E700 with EPP foam liner and Fit System p. 20, Stealth S13, E300 29.
Easton Hockey 2013 Product Catalogue, p. 14-15 R800 with Hexagonal Liner System, p. 16E700, p. 17 E300.
Easton Hockey 2014 Product Catalogue, p. 16-18 E-Series Helmets.
Föregående, Nästa, SvD Sport Article titled "Valdet mot huvudet skakar om hockeyn", published on Nov. 27, 2011, English translation enclosed, 11 pages.
Gulli, Cathy et al., "Hits to the head: Scientists explain Sidney Crosby's concussion" Macleans, Feb. 17, 2011, document retrieved on Sep. 23, 2015 at http://www.macleans.ca/society/health/theaftershocks/, 9 pages.
Hippson Article titled "Skallskador är inte bara hjärnskakning", published on Apr. 6, 2007, No English translation enclosed, 19 pages.
Interview with Bauer Hockey: RE-AKT Helmet; Hockey World Blog article dated May 11, 2012; http: / /www. hockeyworldblog. com /2012/05/11 /interview-with-bauer-hockey-re-akt-helmet/; retrieved Dec. 16, 2014, 4 pages.
Lazer Booth at EuroBike in Friedrichshafen, Germany (Aug. 31-Sep. 2, 2011)—Public display of Lazer P'Nut Helmet with MIPS technology, with MIPS product tags, MIPS poster, MIPS PowerPoint presentation, 19 pages.
Lazer Booth at Interbike in Las Vegas (Sep. 12-16, 2011)—Public display of Lazer P'Nut Helmet with MIPS technology, with MIPS product tags, MIPS poster, MIPS PowerPoint presentation, 19 pages.
"Lazer Booth at Interbike in Las Vegas (Sep. 22-24, 2010)—Publicdisplay of Lazer P'Nut Helmet with MIPS technology, with MIPS producttags, MIPS poster, MIPS PowerPoint presentation, 47 pages".
Lazer P'Nut helmet with MIPS system disclosed to Bauer on Nov. 16, 2010.
Magnus Aare & Peter Halldin (2003), "A New Laboratory Rig for Evaluating Helmets Subject to Oblique Impacts", Traffic Injury Prevention, 4:3, pp. 240-248.
MIPS Booth that ISPO 2011 in Munich (Feb. 6-9, 2011)—Public display of Burton RED Hi-Fi MIPS Helmet, Limar Helmet with MIPS technology, POC Receptor Backcountry with MIPS technology, MIPS product tags, MIPS poster, MIPS PowerPoint presentation, 50 pages.
MIPS Booth that Snow Sports Industries America (SIA) in Denver (Jan. 27-30, 2011)—Public display of Burton RED Hi-Fi MIPS Helmet, Limar Helmet with MIPS technology, POC Receptor Backcountry with MIPS technology, MIPS product tags, MIPS poster, MIPS PowerPoint presentation, 12 pages.
MIPS Press Release titled "MIPS and Lazer Join Forces to Protect Children's Brains", Stockholm, Sweden, Aug. 25, 2011, 1 page.
MIPS Press Release titled "MIPS protection system to offer enhanced protective technology in Burton's R.E.D. snow helmets", Stockholm, Sweden, Jan. 17, 2011, 2 pages.
Mission Itech 2007 Product Catalogue p. 24-27 Mission Intake Helmet with Mission Head Lock and Trip Padding.
Mission Itech 2008 Product Catalogue p. 22-23 Mission Intake Helmet with Mission Head Lock and Trip Padding.
Nike Bauer 2006 Product Catalogue p. 42-45 Nike Bauer 8500 Helmet with Tool-Free Adjustment and Occipital Lock.
Nike Bauer 2007 Product Catalogue p. 30 Nike Bauer 8500 Helmet with Tool-Free Adjustment and Occipital Lock.
NyTeknik Article titled "Ridhjalmen skyddar hjarnan vid cykelvurpa", published on Oct. 6, 2009, 2 pages.
Pacocha, Matt, "The Cult of Aluminum is Alive and Well. 2012 Lazer helmets and eyewear—First look", Jul. 1, 2011, document retrieved on Sep. 23, 2015 at http://www.bikeradar.com/news/article/2012lazerhelmetsandeyewearfirstlook30811/, 9 pages.
POC Booth at Eurobike in Friedrichshafen, Germany (August 31-Sep. 2, 2011)—Public display of POC Trabec Helmet with MIPS technology, with MIPS product tags, 18 pages.
POC Booth at Interbike in Las Vegas (Sep. 12-16, 2011)—Public display of POC Trabec Helmet with MIPS technology, with MIPS product tags, 18 pages.
Presentation about the Lazer P-nut with MIPS to Lazer distributors and agents, May-Jun. 2011, including Peter Steenwegen of Lazer, 12 pages.
Promotion of MIPS technology during meetings at Intennot 2010 in Cologne, Germany (Oct. 6-10, 2010)—Public display of MIPS technology, with MIPS product tags, MIPS poster, MIPS PowerPoint presentation, 15 pages.
Public presentation of Lazer P'Nut helmet with MIPS system at the LazerSports NV event "Lazer Oazis Party", Hard Rock Cafe, Las Vegas, Sep. 21, 2010—Public display of Lazer P' Nut Helmet with MIPS technology, MIPS Tech-folder and poster, PowerPoint presentation, 47 pages.
Reebok CCM Hockey Product 2014 Catalogue—p. 38-39 CCM Resistance Helmet RES 300, RES 100.
Request for grant of a European patent filed at the European Patent Office filed Jul. 27, 2012 in connection with European Patent Application 12178380.7, 5 pages.
*Bauer Hockey Corp.* v. *Sport Maska Inc. d.b.a. Reebok-CCM Hockey* (Court No. T-123-15, T-546-12, T-311-12) Motion Record of the Moving Party Sport Maska Inc. d.b.a. Reebok-CCM Hockey vol. 4. Oct. 4, 2017. 46 pages.

(56) References Cited

OTHER PUBLICATIONS

*Bauer Hockey Corp.* v. *Sport Maska Inc. d.b.a. Reebok-CCM Hockey* (Court No. T-123-15, T-546-12, T-311-12) Plaintiffs Responding Motion Record (in response to the Defendant's Motion to Dismiss) vol. 4. 31 pages [last accessed Jan. 10, 2018].
Burton RED HiFi design drawings from Oct. 24, 2010, 3 pages.
Delivery note dated Nov. 24, 2011, 3 pages.
Digital Mechanics silicon tooling invoice Sep. 17, 2010, 3 pages.
Email conversation re MIPS Reebok helmet sent to Pat Brisson—Feb. 16 to 29, 2012, 3 pages.
Email dated Apr. 16, 2012 from Niklas Steenberg to Daniel Lanner; subject "Re: SV: Reebok-CCM", 1 page.
Email dated Apr. 16, 2012 from Niklas Steenberg to Daniel Lanner; subject "Reebok hjalm", 1 page.
Email dated Apr. 17, 2012 from Niklas Steenberg to Peter Halldin; subject "NHLoch ReebokCCM", 6 pages.
Email dated Apr. 30, 2012 from Brian Jennings to Niklas Steenberg and Peter Halldin; subject "Re: MIPS meeting in NYC", 2 pages.
Email exchanges in connection with RE-AKT order placed on May 14, 2012, 5 pages.
English translation of email dated Apr. 16, 2012 from Niklas Steenberg to Daniel Lanner; subject "Re: SV: Reebok-CCM", 1 page.
English translation of email dated Apr. 17, 2012 from Niklas Steenberg to Peter Halldin; subject "NHLoch ReebokCCM", 5 pages.
English translation of Nytt skydd kan halvera hjarnskador, SVT article (www.svt.se) dated Nov. 6, 2011; http://www.svt.se/sport/nytt-skydd-kan-halvera-hjarnskador-1; retrieved Dec. 18, 2014, 1 page.
English translation Vildet mot huvudet skakarom hockey, SVD article (www.svd.se); http: / /www. svd. se/ sport/valdet-mot-huvudet-skakar-om- hockevn 6666590.svd; published Nov. 27, 2011; retrieved Dec. 24, 2014, 5 pages.
Fork of D7a email conversation copying Daniel Lanner, 3 pages.
Guest list for "Lazer Oasiz Party", 8 pages.
HKSM order Aug. 17, 2011, 1 page.
HKSM order Sep. 9, 2011, 1 page.
Images in connection with Burton RED HiFi helmets, displayed at SIA Denver exhibition Jan. 27-30, 2011; 3D Model images from Dec. 2010, sample photographs incorporating HiFi sliding facilitator in hockey helmet from Jan. 20, 2011 and photographs of SIA display booth taken Jan. 27, 2011, 19 pages.
Images of MIPS Reebok helmet, 11 pages.
Images re display of Lazer P'Nut at "Lazer Oasiz Party", Hard Rock Cafe, Las Vegas, Sep. 21, 2010, 3 pages.
Internal MIPS specification document "Specification: MIPS in Hockey helmets", dated Mar. 15, 2012, 4 pages.
Lazer Interbike flyer, 1 page.
Lazer invoice of Dec. 16, 2010 for space rented at Las Vegas event, 1 page.
Lazer P'Nut toddler bike helmet.
MIPS Press Release dated Aug. 25, 2011, 1 page.
MIPS/Burton press release dated Jan. 17, 2011, 2 pages.
Mission Intake Helmet with the Mission Head Lock (MHL) self-adjusting occipital retention system.
MNR/Article overview for order Mq11005435—Mar. 17, 2011, 1 page.
New Helmet Technology Reduces Brain Injury, KTH website article (ww.kth.se); https://www.kth.se/en/aktuellt/nyheter/new-helmet-technology-reduces-brain-injury-1.299392; published Mar. 7, 2012; retrieved Dec. 30, 2014, 3 pages.
Nytt skydd kan halvera hjarnskador, SVT article (www.svt.se) dated Nov. 6, 2011; http://www.svt.se/sport/nytt-skydd-kan-halvera-hjarnskador-1; retrieved Dec. 18, 2014, 3 pages.
Photographs of purchased RE-AKT helmet (related to Email exchanges in connection with RE-AKT order placed on May 14, 2012); photographs taken May 31, 2012, 14 pages.
Photographs relating to display of Lazer P'Nut helmet at Eurobike exhibition 2011; exhibition held in Friedrichshafen, Germany, Aug. 31, 2011-Sep. 3, 2011; photographs taken Sep. 1 and 2, 17 pages.
Photographs relating to display of POC Trabec helmet at Eurobike exhibition 2011; exhibition held in Friedrichshafen, Germany, Aug. 31, 2011-Sep. 3, 2011; photographs taken Aug. 18, 2011, Sep. 2, 2011, Oct. 12, 2011 and Oct. 24, 2014, 18 pages.
POC Cortex DH MIPS full face downhill bike helmet with MIPS.
Purchase order for test and sample units dated May 13, 2011, 2 pages.
Riddell 360 Football Helmet with Concussion Reduction Technology (CRT) and occipital lock.
Screenshots from Dec. 2010 Limar video. Video viewable at: http://www.mipshelmet.com/video/inmold/Limar, 2 pages.
Screenshots from Ice Warehouse YouTube video, video available at https://www.youtube.corn/watch?v-eHKOeKTI8k, video published Apr. 27, 2012, video retrieved/screenshots taken Dec. 3, 2014, 8 pages.
Screenshots from video viewable at: http://www.mipshelmet.com/video/Lazer/pnut presentation, 5 pages.
Slides from P'Nut presentation made to Lazer distributors, 6 pages.
Slides from sales presentation made to Lazer distributors, 29 pages.
Transcript of Ice Warehouse YouTube video, video available at https://www.youtube.com/watch?v---eHKOeKTI8k, video published Apr. 27, 2012, video retrieved/transcript taken Dec. 3, 2014, 3 pages.
Transcript of video shown at presentation. Video viewable at: http://www.mipshelmet.com/video/Lazer/pnut presentation, 1 page.
Translation of email dated Apr. 16, 2012 from Niklas Steenberg to Daniel Lanner; subject "Reebok hjalm", 1 page.
Translation of Email exchanges in connection with RE-AKT order placed on May 14, 2012, 8 pages.
Vildet mot huvudet skakarom hockey, SVD article (www.svd.se); http: / /www. svd. se/ sport/valdet-mot-huvudet- skakar-om- hockevn 6666590.svd; published Nov. 27, 2011; retrieved Dec. 24, 2014, 6 pages.
Warrior Krown 360 Helmet.
Witness statement from Daniel Lanner dated Dec. 22, 2014, re NHL presentation in Apr. 2012 filed in the matter of an opposition to European Patent Application 2,550,886 in the name of Bauer Hockey Corp, 1 page.
Schwarz, Alan, "Helmet Safety Unchanged as Injury Concerns Rise", The New York Times, "As Injuries Rise, Scant Oversight of Helmet Safety", Published on Oct. 20, 2010, document retrieved on Sep. 23, 2015 at http://www.nytimes.com/2010/10/21/sports/football/21 helmets.html?pagewanted=all&_r=0, 9 pages.
Smart & Biggar "MIPS AB and Bauer Hockey Ltd. and Bauer Hockey, LLC, Further Amended Statement of Defence and Counterclaim", Document filed at the Federal Court of Canada on Jun. 21, 2017, Court File No. T-56-15, 45 pages.
Statement under 37 CRF 3.73(c) and two Assignments filed in connection with U.S. Appl. No. 13/560,546 (U.S. Publication 2013/0025032), completed Sep. 5, 2012 and Sep. 10, 2012, 6 pages.
SvT Sport Online Article titled "Nytt skydd kan halvera hjarnskador", published on Nov. 6, 2011, English translation enclosed, 4 pages.
USPTO, Certified U.S. Appl. No. 61/512,266, filed Jul. 1, 2012, 27 pages.
USPTO, Certified U.S. Appl. No. 61/587,040, filed Jan. 16, 2012, 71 pages.
"Xenith Technology, Adaptive Head Protectionhttp://www.xenith.com/why-x/technology, 3 pages".
"Xenith, Heads-up: Tech to Combat Concussionshttp://www.xenith.com/the-game/2012/08/heads-up-tech-to-combat-concussions, 4 pages".
Examiner's Report issued on May 3, 2023 in connection with Canadian Patent Application No. 2901035, 3 pages.
Lazer to Add Eyewear to Helmet Line, Bicycle Retailer (www.bicycleretailer.com) article published on Jun. 26, 2011; http://www.bicycleretailer.com/product-tech/2011/06/26/lazer-add-eyewear-helmet-line; retrieved Dec. 4, 2014, 3 pages.
Witness statement from Daniel Lanner dated Dec. 22, 2014, re helmet for Ludvig Steenberg, presented to Lars Steenberg on Jul. 3, 2012 filed in the matter of an opposition to European Patent Application 2,550,886 in the name of Bauer Hockey Corp, 1 page.

(56) References Cited

OTHER PUBLICATIONS

Almi Foretagspartner Article titled "MIPS genomfor riktad nyemission till HealthCap, KTH-Chalmers Capital och Almi Invest for kommersialisering av MIPS-teknologin", published Oct. 20, 2009, No English translation enclosed, 2 pages.
Examiner's Report issued on Apr. 21, 2020 in connection with Canadian Patent Application No. 3,018,280, 4 pages.
Examiner's Report issued on Feb. 22, 2021 in connection with Canadian Patent Application No. 2,934, 368, 5 pages.
Examiner's Report issued on Jul. 21, 2022 in connection with Canadian Patent Application No. 2901035, 7 pages.
Examiner's Report issued on Oct. 1, 2020 in connection with Canadian Patent Application No. 3,018,280, 4 pages.
Examiner's Report issued on Oct. 25, 2021 in connection with Canadian Patent Application No. 2901035, 5 pages.
Examiner's Report issued on Oct. 26, 2021 in connection with Canadian Patent Application No. 2934368, 3 pages.
Examiner's Report issued on Dec. 16, 2022 in connection with Canadian Patent Application No. 3,133,927, 8 pages.
Final Office Action issued on Jan. 28, 2021 in connection with U.S. Appl. No. 15/960,915. 61 pages.
Non-Final Office Action issued on Oct. 26, 2022 in connection with U.S. Appl. No. 17/371,277, 6 pages.
Non-Final Office Action issued on Jan. 20, 2022 in connection with U.S. Appl. No. 16/594,488, 54 pages.
Non-Final Office Action issued on Jul. 5, 2022 in connection with U.S. Appl. No. 16/396,837, 54 pages.
Notice of Allowance issued on Apr. 12, 2021 in connection to U.S. Appl. No. 15/960,915, 7 pages.
Notice of Allowance issued on Apr. 26, 2022 in connection to U.S. Appl. No. 16/594,488, 18 pages.
Notice of Allowance issued on Dec. 27, 2022 in connection with U.S. Appl. No. 17/371,277, 5 pages.
Restriction Requirement issued on Mar. 10, 2022 in connection with U.S. Appl. No. 16/396,837, 7 pages.
Restriction Requirement issued on Oct. 2, 2020 in connection with U.S. Appl. No. 15/960,915, 6 pages.
Communication pursuant to Article 94(3) EPC in connection with European Patent Application No. 141551044, 4 pages.
European Search Report issued on Apr. 22, 2016 in connection with European Patent Application No. 14155104.4, 4 pages.
European Search Report issued on Aug. 19, 2014 in connection with European Patent Application No. 14155104.4, 6 pages.
European Search Report issued on Oct. 31, 2012 in connection with European Patent Application No. 1217838.7, 5 pages.
Examiner's Report issued on Dec. 21, 2016 in connection with Canadian Patent Application No. 2,880,069, 4 pages.
Examiner's Report issued on Feb. 4, 2015 in connection with Canadian Patent Application No. 2872140, 4 pages.
Examiner's Report issued on Jul. 16, 2014 in connection with Canadian Patent Application No. 2821540, 2 pages.
Examiner's Report issued on May 23, 2014 in connection with Canadian Patent Application No. 2821540, 2 pages.
Examiner's Report issued on May 23, 2014 in connection with Canadian Patent Application No. 2838103, 4 pages.
Examiner's Report issued on May 28, 2014 in connection with Canadian Patent Application No. 2847669, 4 pages.
Examiner's Report issued on Sep. 16, 2014 in connection with Canadian Patent Application No. 2838103, 3 pages.
Examiner's Report issued on Sep. 9, 2016 in connection with Canadian Patent Application No. 2,880,069, 5 pages.
Final Office Action issued on Aug. 24, 2016 in connection with U.S. Appl. No. 13/560,546, 10 pages.
Final Office Action issued on Jul. 13, 2017 in connection with U.S. Appl. No. 14/139,049, 5 pages.
International Search Report issued on Mar. 16, 2015 in connection with International Application No. PCT/CA2014/000911, 8 pages.
Non-Final Office Action issued on Aug. 17, 2015 in connection with U.S. Appl. No. 13/560,546, 37 pages.
Non-Final Office Action issued on May 4, 2017 in connection with U.S. Appl. No. 14/828,051, 8 pages.
Non-Final Office Action issued on Oct. 6, 2016 in connection with U.S. Appl. No. 14/139,049, 14 pages.
Non-Final Office Action issued on Sep. 21, 2018 in connection with U.S. Appl. No. 15/106,192, 64 pages.
Final Office Action issued on Apr. 25, 2019 in connection with U.S. Appl. No. 15/106,192, 53 pages.
Notice of Allowance issued on Jul. 5, 2019 n connection with U.S. Appl. No. 15/106,192, 9 pages.
Notice of Allowance issued on Apr. 9, 2018 in connection with U.S. Appl. No. 14/139,049, 7 pages.
Notice of Allowance issued on Dec. 28, 2017 in connection with U.S. Appl. No. 14/828,051, 5 pages.
Notice of Allowance issued on Jan. 18, 2018 in connection with U.S. Appl. No. 14/828,051, 4 pages.
Notice of Allowance issued on Jan. 30, 2019 in connection with U.S. Appl. No. 14/139,049, 10 pages.
Notice of Allowance issued on Mar. 13, 2019 in connection with U.S. Appl. No. 13/560,546, 10 pages.
Notice of Allowance issued on May 10, 2017 in connection with U.S. Appl. No. 13/560,546, 7 pages.
Notice of Allowance issued on May 18, 2018 in connection with U.S. Appl. No. 13/560,546, 7 pages.
Notice of Allowance issued on Oct. 30, 2017 in connection with U.S. Appl. No. 13/560,546, 7 pages.
Notice of Allowance issued on Oct. 4, 2018 in connection with U.S. Appl. No. 14/139,049, 7 pages.
Notice of Allowance issued on Sep. 25, 2018 in connection with U.S. Appl. No. 13/560,546, 7 pages.
Office Action issued on Apr. 22, 2016 in connection with European Patent Application No. 14155104.4, 2 pages.
Office Action issued on Feb. 24, 2015 in connection with European Patent Application No. 14155104.4, 2 pages.
Office Action issued on Jun. 27, 2013 in connection with European Patent Application No. 1217838.7, 2 pages.
Summons to attend oral proceedings issued by the European Patent Office opposition division in connection to the Application No. 12178380.7—Patent No. 1731/2550886 on Jul. 6, 2017, 33 pages.
Supplemental Notice of Allowability issued on Jun. 14, 2017 in connection with U.S. Appl. No. 13/560,546, 2 pages.
Written Opinion issued on Mar. 16, 2015 in connection with International Application No. PCT/CA2014/000911, 9 pages.
"Bikeskills.com: MIPS Helmet Technology", YouTube video, uploaded Sep. 25, 2009, https://www.youtube.com/watch?v=9wtb_R4NxS8.
"Hjalmen som hamar hjarnans eget skydd" in Fokus: Flemingsberg, Nov. 2007, p. 13.
"Lazer MIPS", YouTube video, uploaded Jul. 8, 2011, https://www.youtube.com/watch?v=5jGxLmBP9CQ.
"Advanced Impact Defense, 6D helmetshttp://www.6dhelmets.com/#!ods/c10b6, 1 page".
Bauer 2009 Product Catalogue p. 49 Bauer 5100 Helmet with Dual-Density Liner and Tool-Free Adjustment.
Bauer 2010 Product Catalogue p. 42 Bauer 7500 Helmet with Triple-density protection, EPP1/2 liner, PORON inserts and Tool-Free Adjustment and Bauer 9900 Helmet with FXPP foam, PORON inserts, Occipital Lock 2.0 and Tool-Free Adjustment, p. 43 Bauer 5100 Helmet with Triple-density liner and Tool-Free adjustment.
Bauer 2011 Product Catalogue p. 44-45, Bauer 9900, p. 46 Bauer 7500 Helmet, p. 47 Bauer 5100 Helmet.
Bauer 2012 Product Catalogue p. 44-48 Introducing Bauer RE-AKT with Suspend-Tech liner system, Vertex foam protection, Poron, occipital lock 3.0 and tool-free adjustment p. 48—Bauer 9900 and 7500 Helmets, p. 49 Bauer 5100 Helmet.
Bauer 2013 Player Catalogue p. 45—Bauer IMS 11.0 Helmet with Seven Technology, p. 47-RE-AKT, 48-RE-AKT, IMS 11.0, IMS 9.0, p. 49—Bauer 7500 and IMS 7.0, p. 50-5100.
Bauer 2014 Player Catalogue p. 19-RE-AKT, p. 20—Comparison RE-AKT 100, REAKT, IMS 11.0, IMS 9.0, IMS, 7500 7.0, p. 21-RE-AKT 100 with Suspend Tech 2 and VTX Technology with Seven+. See p. 22-28 for helmets.

(56) References Cited

OTHER PUBLICATIONS

*Bauer Hockey Corp.* v. *Sport Maska Inc. d.b.a. Reebok-CCM Hockey* (Court No. T-123-15) Amended Statement of Claim. Court No. T-123-15. Feb. 25, 2015. 201 pages.
*Bauer Hockey Corp.* v. *Sport Maska Inc. d.b.a. Reebok-CCM Hockey* (Court No. T-123-15) Amended Statement of Defence and Counterclaim. May 16, 2016. 33 pages.
*Bauer Hockey Corp.* v. *Sport Maska Inc. d.b.a. Reebok-CCM Hockey* (Court No. T-123-15) Defendant's Responding Motion Record. Jul. 19, 2016. 352 pages.
Non-Final Office Action issued on Nov. 9, 2023 in connection with U.S. Appl. No. 18/126,535, 6 pages.

* cited by examiner

HELMET FOR IMPACT PROTECTION

CROSS-REFERENCE TO RELATED APPLICATION

This application claims priority from U.S. Provisional Patent Application 61/918,092 filed on Dec. 19, 2013 and hereby incorporated by reference herein.

FIELD

The invention relates generally to helmets and, more particularly, to helmets providing protection against impacts such as linear impacts and/or rotational impacts.

BACKGROUND

Helmets are worn in sports and other activities (e.g., motorcycling, industrial work, military activities, etc.) to protect their wearers against head injuries. To that end, helmets typically comprise a rigid outer shell and inner padding to absorb energy when impacted.

Various types of impacts are possible. For example, a helmet may be subjected to a linear impact in which an impact force is generally oriented to pass through a center of gravity of the wearer's head and imparts a linear acceleration to the wearer's head. A helmet may also be subjected to a rotational impact in which an impact force imparts an angular acceleration to the wearer's head. This can cause serious injuries such as concussions, subdural hemorrhage, or nerve damage.

Although helmets typically provide decent protection against linear impacts, their protection against rotational impacts is often deficient. This is clearly problematic given the severity of head injuries caused by rotational impacts.

Also, while various forms of protection against linear impacts have been developed, existing techniques may not always be adequate or optimal in some cases, such as for certain types of impacts (e.g., high- and low-energy impacts)

For these and other reasons, there is a need for improvements directed to providing helmets with enhanced impact protection.

SUMMARY OF THE INVENTION

According to various aspects of the invention, there is provided a helmet for protecting a head of a wearer, in which the helmet has any feature or combination of features disclosed herein.

For example, according to one aspect of the invention, there is provided a helmet for protecting a head of a wearer. The helmet comprises an outer shell and inner padding disposed between the outer shell and the wearer's head when the helmet is worn. The inner padding comprises a plurality of shock absorbers and an interconnector interconnecting the shock absorbers. Each shock absorber is deformable in response to a rotational impact on the helmet such that an outer part of the shock absorber moves relative to an inner part of the shock absorber in a direction tangential to an angular movement of the outer shell due to the rotational impact.

According to another aspect of the invention, there is provided a helmet for protecting a head of a wearer. The helmet comprises an outer shell and inner padding disposed between the outer shell and the wearer's head when the helmet is worn. The inner padding comprises: a plurality of shock absorbers, each shock absorber being deformable in response to an impact such that an outer part of the shock absorber moves relative to an inner part of the shock absorber; an interconnector interconnecting the shock absorbers; and a shearing layer between the outer part of the shock absorber and the inner part of the shock absorber to allow the outer part of the shock absorber and the inner part of the shock absorber to shear relative to one another.

According to another aspect of the invention, there is provided a helmet for protecting a head of a wearer. The helmet comprises an outer shell and inner padding disposed between the outer shell and the wearer's head when the helmet is worn. The inner padding comprises an arrangement of shock absorbers that is connected to another part of the helmet by a plurality of connectors which are deformable in response to a rotational impact on the helmet such that the arrangement of shock absorbers moves relative to the outer shell in a direction tangential to an angular movement of the outer shell due to the rotational impact.

According to another aspect of the invention, there is provided a helmet for protecting a head of a wearer. The helmet comprises a first protective layer and a second protective layer meshing with the first protective layer. A meshing part of the first protective layer extends into a meshing hollow space of the second protective layer and is movable relative to the meshing hollow space of the second protective layer such that, in response to a rotational impact on the helmet, the meshing part of the first protective layer moves relative to the meshing hollow space of the second protective layer in a direction tangential to an angular movement of an external surface of the helmet due to the rotational impact.

According to another aspect of the invention, there is provided a helmet for protecting a head of a wearer. The helmet comprises an outer shell. The helmet comprises a shearable material configured to elastically shear in response to a rotational impact on the helmet such that an outer surface of the shearable material is movable relative to an inner surface of the shearable material in a direction tangential to an angular movement of the outer shell due to the rotational impact.

According to another aspect of the invention, there is provided a helmet for protecting a head of a wearer. The helmet comprises an outer shell and inner padding disposed between the outer shell and the wearer's head when the helmet is worn. The inner padding comprises a plurality of padding layers that are stacked and interconnected such that compression of the padding layers is decoupled from shearing of adjacent ones of the padding layers relative to one another.

According to another aspect of the invention, there is provided a helmet for protecting a head of a wearer. The helmet comprises an outer shell and inner padding disposed between the outer shell and the wearer's head when the helmet is worn. The inner padding comprises a plurality of pad members separate from one another. Each pad member comprises a plurality of padding layers that are stacked and a connector interconnecting adjacent ones of the padding layers such that compression of the padding layers is decoupled from shearing of the adjacent ones of the padding layers relative to one another.

According to another aspect of the invention, there is provided a helmet for protecting a head of a wearer. The helmet comprises an outer shell and inner padding disposed between the outer shell and the wearer's head when the helmet is worn. The helmet comprises an impact deflector at an external side of the outer shell to deflect a rotational impact.

According to another aspect of the invention, there is provided a helmet for protecting a head of a wearer. The helmet comprises an outer shell and inner padding disposed between the outer shell and the wearer's head when the helmet is worn. The helmet comprises a sacrificial layer at an external side of the outer shell and configured to erode at a point of rotational impact.

According to another aspect of the invention, there is provided a helmet for protecting a head of a wearer. The helmet comprises an outer shell and inner padding disposed between the outer shell and the wearer's head when the helmet is worn. The helmet comprises a faceguard for protecting at least part of a face of the wearer. The faceguard is angularly movable relative to an internal surface of the helmet in response to a rotational impact on the faceguard.

According to another aspect of the invention, there is provided a helmet for protecting a head of a wearer. The helmet comprises: an external surface; an internal surface for contacting the wearer's head; and a rotational impact protection system for allowing an angular movement of the external surface relative to the internal surface in response to a rotational impact on the helmet. The rotational impact protection mechanism comprises a plurality of distinct rotational impact protection mechanisms to provide at least two levels of protection against the rotational impact.

These and other aspects of the invention will now become apparent to those of ordinary skill in the art upon review of the following description of embodiments of the invention in conjunction with the accompanying drawings.

BRIEF DESCRIPTION OF THE DRAWINGS

A detailed description of embodiments of the invention is provided below, by way of example only, with reference to the accompanying drawings, in which.

It is to be expressly understood that the description and drawings are only for the purpose of illustrating certain embodiments of the invention and are an aid for understanding. They are not intended to be a definition of the limits of the invention.

DETAILED DESCRIPTION OF EMBODIMENTS

FIGS. 1 to 8 show an example of a helmet 10 for protecting a head 11 of a wearer in accordance with an embodiment of the invention. In this embodiment, the helmet 10 is a sports helmet for protecting the head 11 of the wearer who is a sports player. More particularly, in this embodiment, the helmet 10 is a hockey helmet for protecting the head 11 of the wearer who is a hockey player. In other embodiments, the helmet 10 may be any other type of helmet for other sports (e.g., lacrosse, football, baseball, bicycling, skiing, snowboarding, horseback riding, etc.) and activities other than sports (e.g., motorcycling, industrial applications, military applications, etc.) in which protection against head injury is desired.

The helmet 10 defines a cavity 13 for receiving the wearer's head 11 to protect the wearer's head 11 when the helmet 10 is impacted (e.g., when the helmet 10 hits a board or an ice or other skating surface of a hockey rink or is struck by a puck or a hockey stick). In this embodiment, the helmet 10 is designed to provide protection against various types of impacts. More particularly, in this embodiment, the helmet 10 is designed to provide protection against a linear impact in which an impact force is generally oriented to pass through a center of gravity of the wearer's head 11 and imparts a linear acceleration to the wearer's head 11. In addition, in this embodiment, the helmet 10 is designed to provide protection against a rotational impact in which an impact force imparts an angular acceleration to the wearer's head 11.

In response to an impact, the helmet 10 absorbs energy from the impact to protect the wearer's head 11. Notably, in this embodiment, in order to provide protection against rotational impacts, the helmet 10 comprises a rotational impact protection system 28 responsive to a rotational impact to absorb rotational energy from the rotational impact. This reduces rotational energy transmitted to the wearer's head 11 and therefore reduces an angular acceleration of the wearer's 11.

Figure 9:
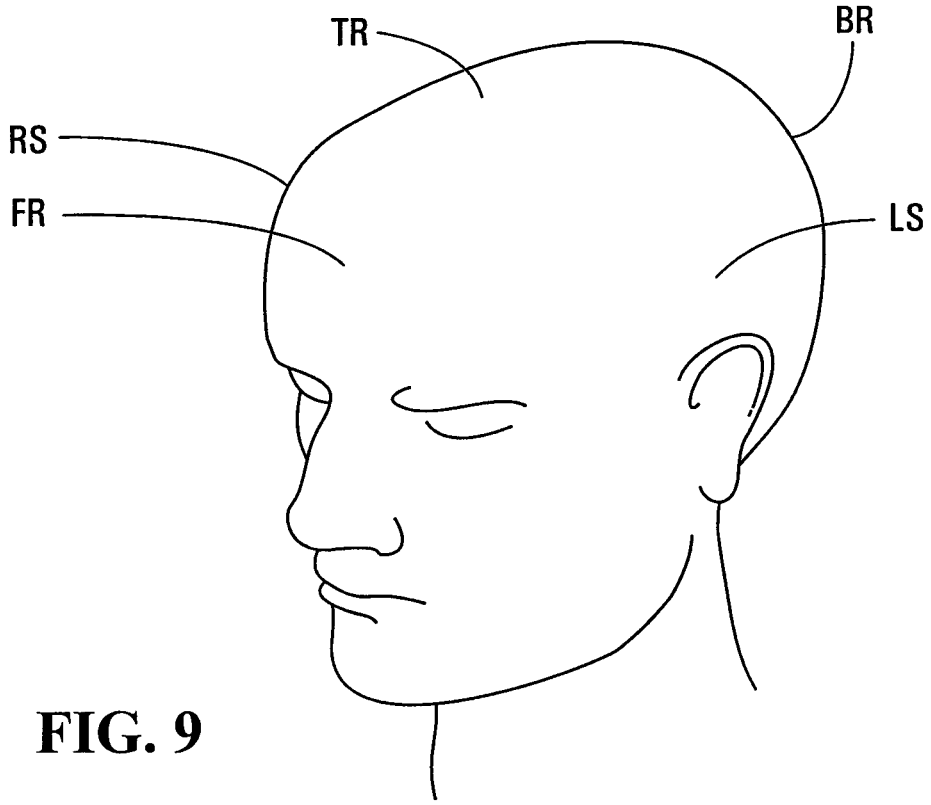
FIGS. 9 and 10 show the head of the wearer.
Figure 10:
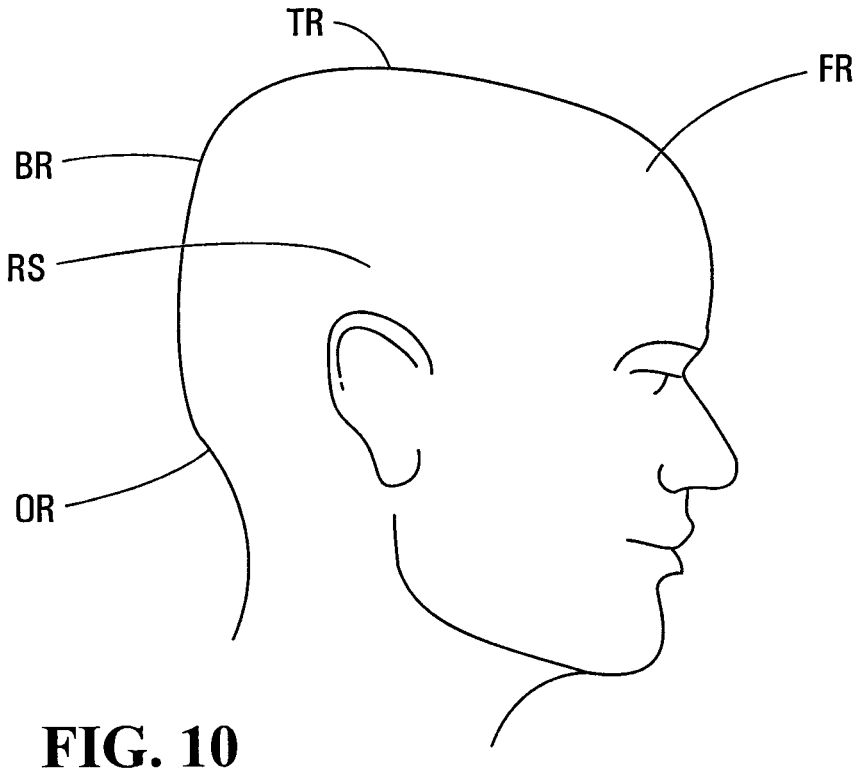

The helmet 10 protects various regions of the wearer's head 11. As shown in FIGS. 9 and 10, the wearer's head 11 comprises a front region FR, a top region TR, left and right side regions LS, RS, a back region BR, and an occipital region OR. The front region FR includes a forehead and a front top part of the head 11 and generally corresponds to a frontal bone region of the head 11. The left and right side regions LS, RS are approximately located above the wearer's ears. The back region BR is opposite the front region FR and includes a rear upper part of the head 11. The occipital region OR substantially corresponds to a region around and under the head's occipital protuberance.

The helmet 10 comprises an external surface 18 and an internal surface 20 that contacts the wearer's head 11 when the helmet 10 is worn. The helmet 10 has a front-back axis FBA, a left-right axis LRA, and a vertical axis VA which are respectively generally parallel to a dorsoventral axis, a dextrosinistral axis, and a cephalocaudal axis of the wearer when the helmet 10 is worn and which respectively define a front-back direction, a left-right direction, and a vertical direction of the helmet 10. Since they are generally oriented longitudinally and transversally of the helmet 10, the front-back axis FBA and the left-right axis LRA can also be referred to as a longitudinal axis and a transversal axis, respectively, while the front-back direction and the left-right direction can also be referred to a longitudinal direction and a transversal direction.

Figure 11:
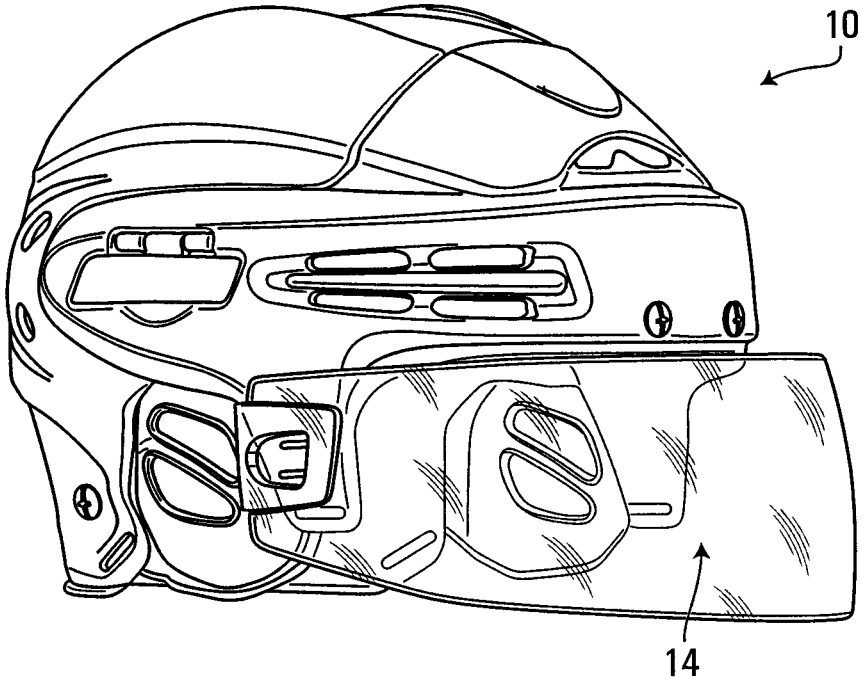
FIGS. 11 and 12 show examples of a faceguard that may be provided on the helmet.
Figure 12:
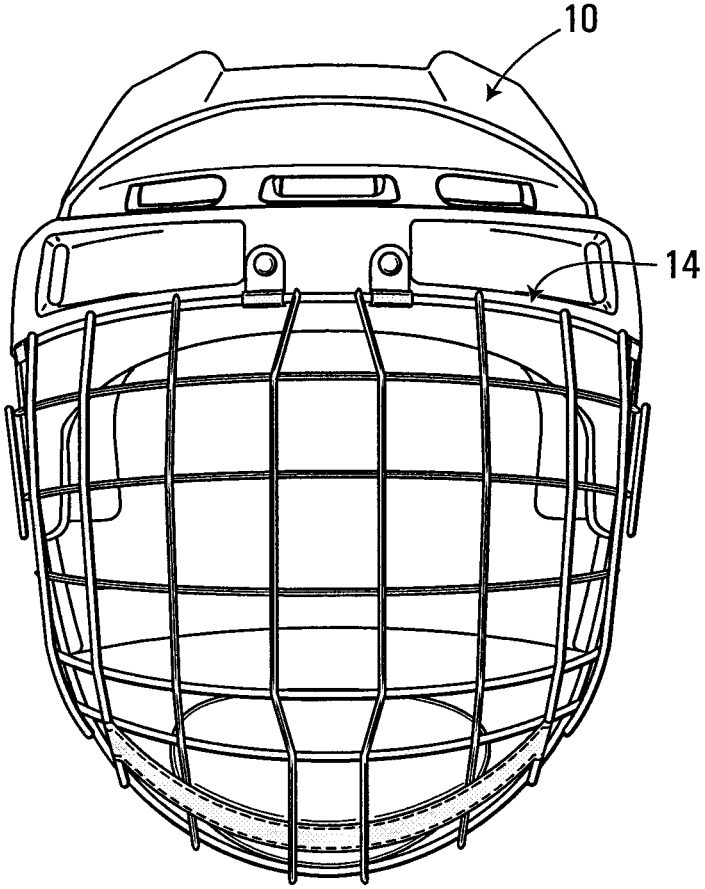

In this embodiment, the helmet 10 comprises an outer shell 12 and inner padding 15. The helmet 10 also comprises a chinstrap 16 for securing the helmet 10 to the wearer's head 11. As shown in FIGS. 11 and 12, the helmet 10 may also comprise a faceguard 14.

The outer shell 12 provides strength and rigidity to the hockey helmet 10. To that end, the outer shell 12 is made of rigid material. For example, in various embodiments, the outer shell 12 may be made of thermoplastic material such as polyethylene, polyamide (nylon), or polycarbonate, of thermosetting resin, or of any other suitable material. The outer shell 12 has an inner surface 17 facing the inner padding 15 and an outer surface 19 opposite the inner surface 17. The outer surface 19 of the outer shell 12 constitutes at least part of the external surface 18 of the helmet 10.

In this embodiment, the outer shell 12 comprises a front outer shell member 22 and a rear outer shell member 24 that are connected to one another. The front outer shell member 22 comprises a top portion 21 for facing at least part of the top region TR of the wearer's head 11, a front portion 23 for facing at least part of the front region FR of the wearer's head 11, and left and right lateral side portions 25, 27 extending rearwardly from the front portion 23 for facing at least part of the left and right side regions LS, RS of the wearer's head 11. The rear outer shell member 24 comprises a top portion 29 for facing at least part of the top region TR of the wearer's head 11, a back portion 31 for facing at least part of the back region BR of the wearer's head 11, an occipital portion 37 for facing at least part of the occipital region OR of the wearer's head 11, and left and right lateral side portions 33, 35 extending forwardly from the back portion 31 for facing at least part of the left and right side regions LS, RS of the wearer's head 11.

Figure 13:
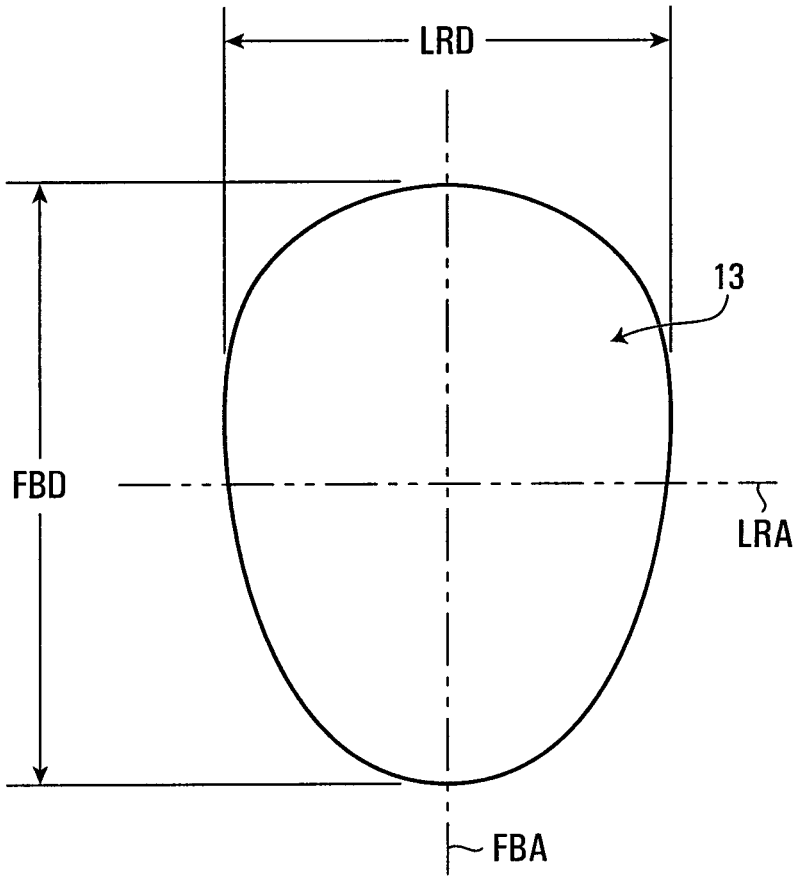
FIG. 13 shows internal dimensions of a head-receiving cavity of the helmet.

In this embodiment, the helmet 10 is adjustable to adjust how it fits on the wearer's head 11. To that end, the helmet 10 comprises an adjustment mechanism 40 for adjusting a fit of the helmet 10 on the wearer's head 11. The adjustment mechanism 40 allows the fit of the helmet 10 to be adjusted by adjusting one or more internal dimensions of the cavity 13 of the helmet 10, such as a front-back internal dimension FBD of the cavity 13 in the front-back direction of the helmet 10 and/or a left-right internal dimension LRD of the cavity 13 in the left-right direction of the helmet 10, as shown in FIG. 13.

Figure 1:
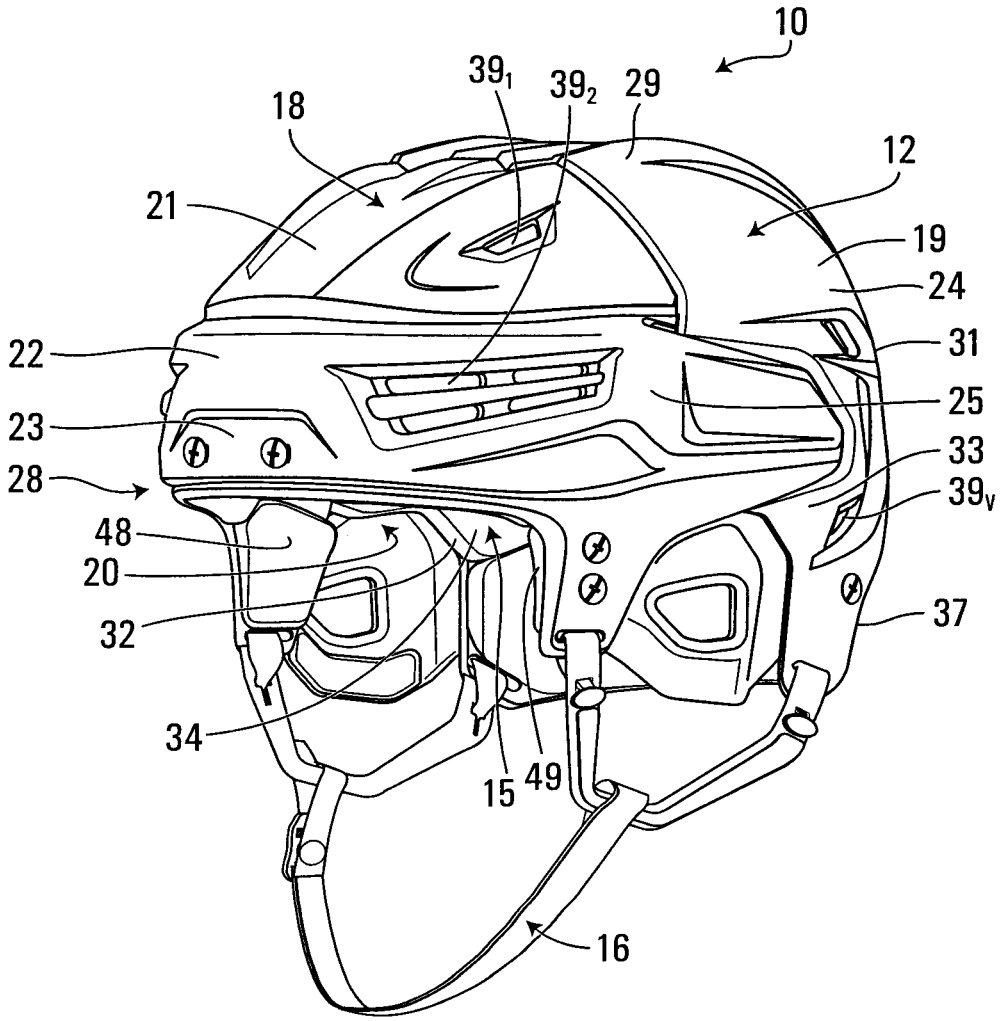
FIG. 1 shows an example of a helmet for protecting a head of a wearer in accordance with an embodiment of the invention.
Figure 2:
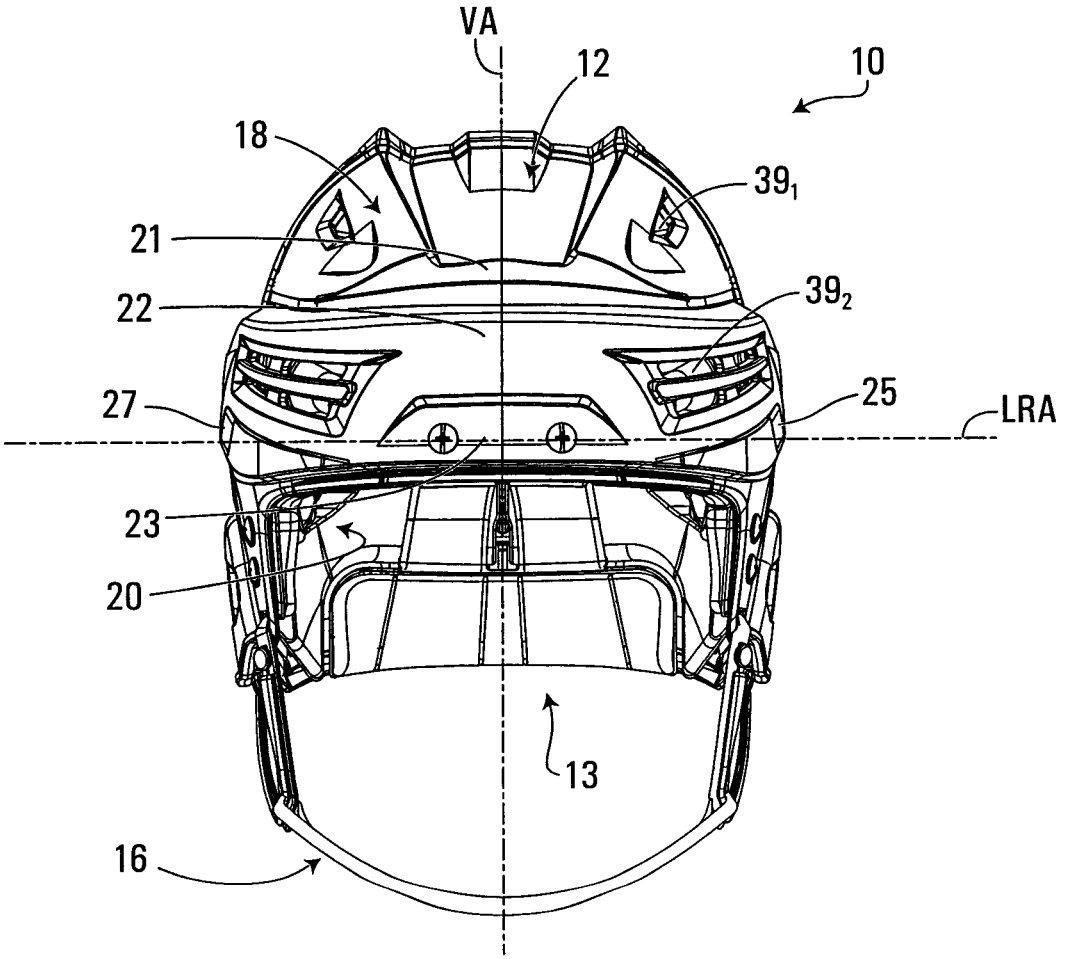
FIGS. 2 and 3 show a front and rear perspective view of the helmet.
Figure 3:
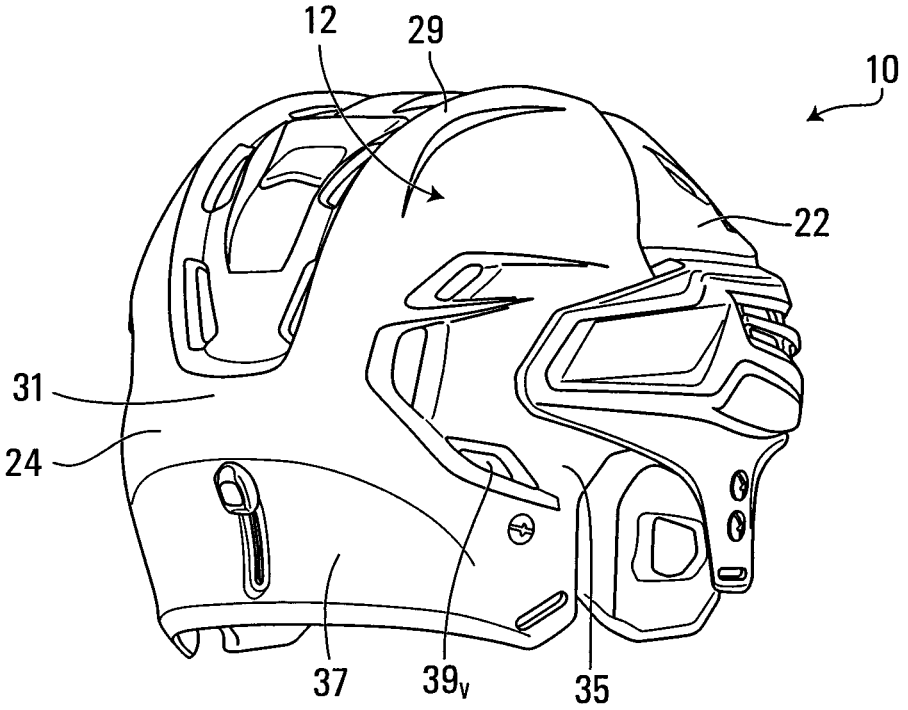
Figure 4:
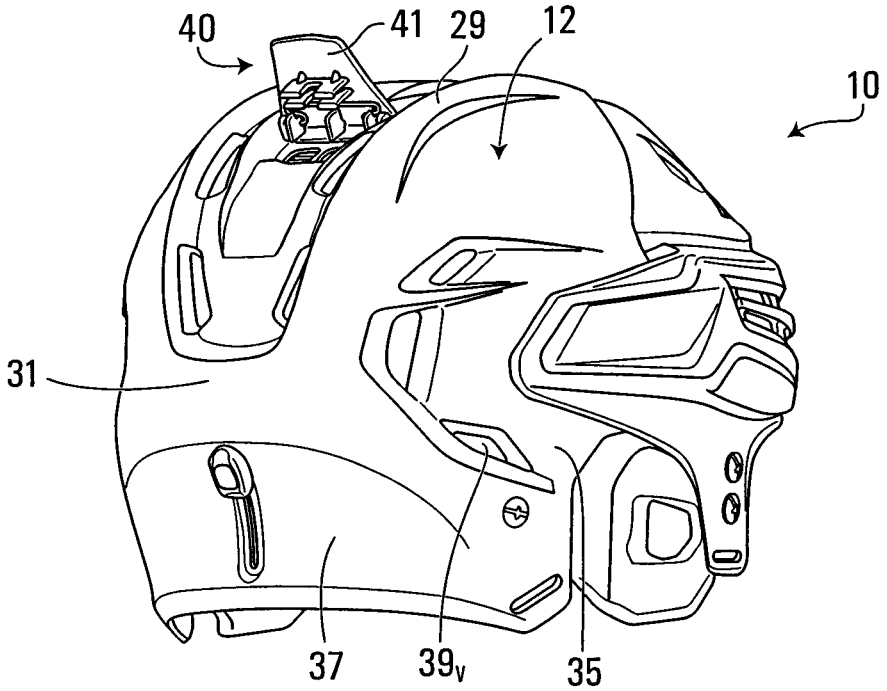
FIGS. 4 to 8 show operation of an example of an adjustment mechanism of the helmet.
Figure 5:
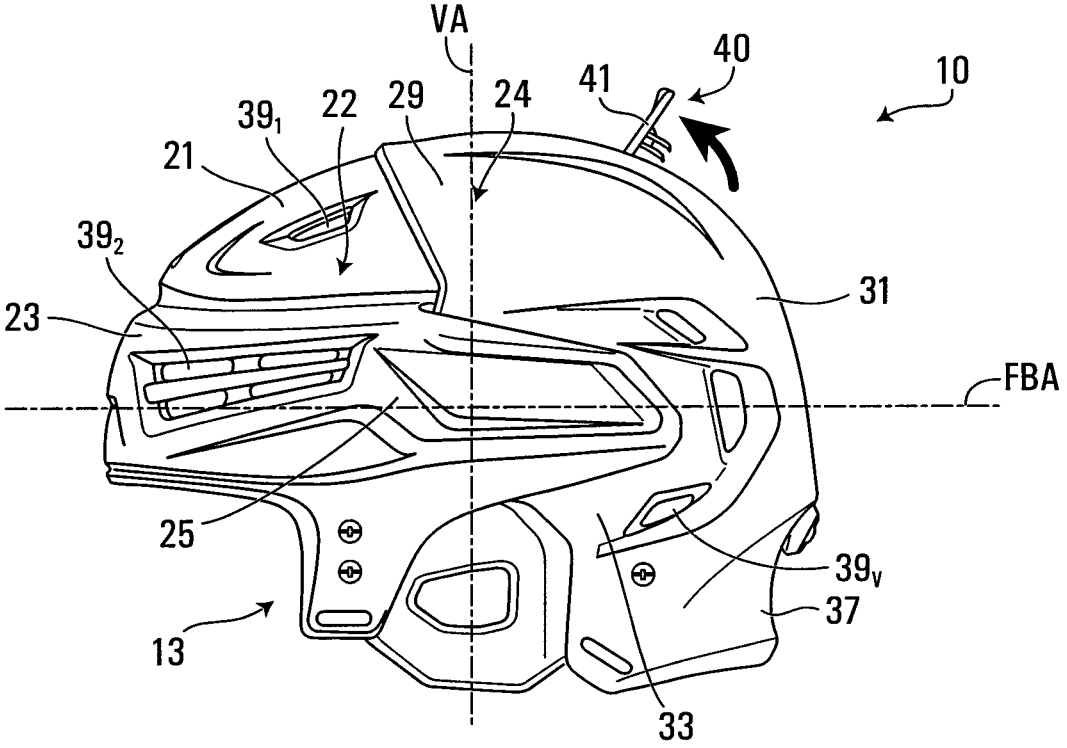
Figure 6:
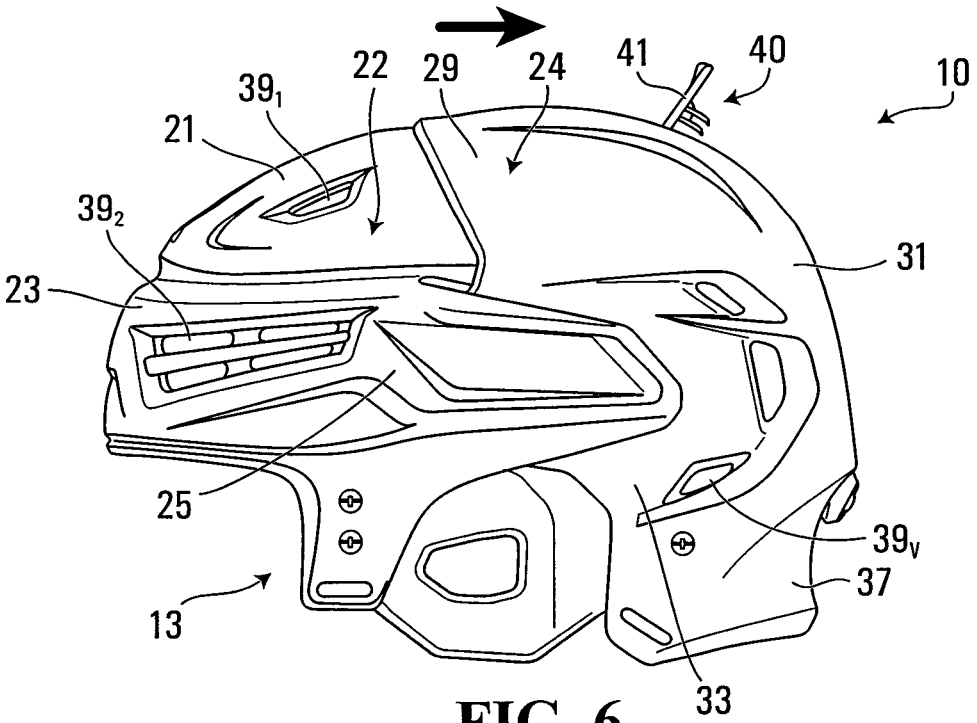
Figure 7:
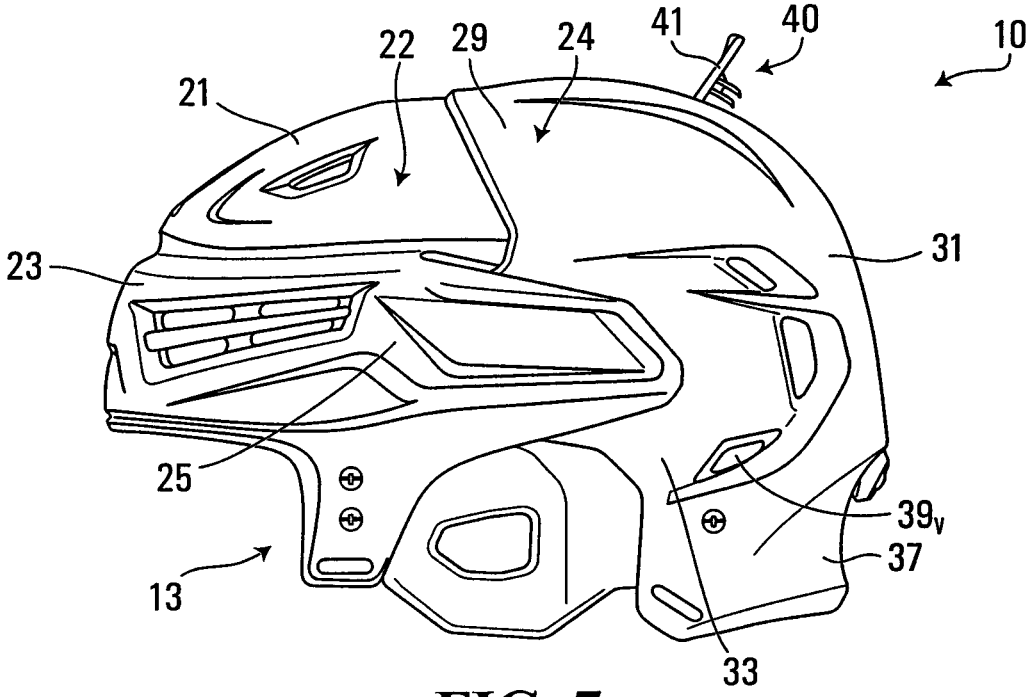
Figure 8:
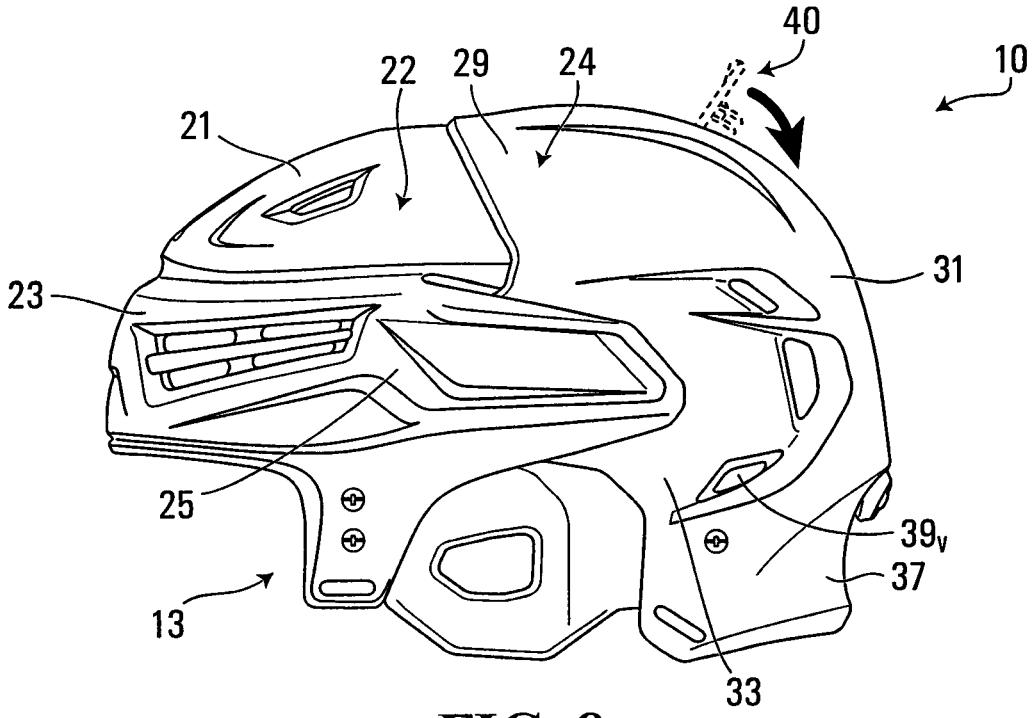

More particularly, in this embodiment, the outer shell 12 and the inner padding 15 are adjustable to adjust the fit of the helmet 10 on the wearer's head 11. To that end, in this case, the front outer shell member 22 and the rear outer shell member 24 are movable relative to one another to adjust the fit of the helmet 10 on the wearer's head 11. The adjustment mechanism 40 is connected between the front outer shell member 22 and the rear outer shell member 24 to enable adjustment of the fit of the helmet 10 by moving the outer shell members 22, 24 relative to one another. In this example, relative movement of the outer shell members 22, 24 for adjustment purposes is in the front-back direction of the helmet 10 such that the front-back internal dimension FBD of the cavity 13 of the helmet 10 is adjusted. This is shown in FIGS. 5 to 8 in which the rear outer shell member 24 is moved relative to the front outer shell member 22 from a first position, which is shown in FIG. 5 and which corresponds to a relatively small size of the helmet 10, to a second position, which is shown in FIG. 6 and which corresponds to an intermediate size of the helmet 10, and to a third position, which is shown in FIGS. 7 and 8 and which corresponds to a relatively large size of the helmet 10.

Figure 14:
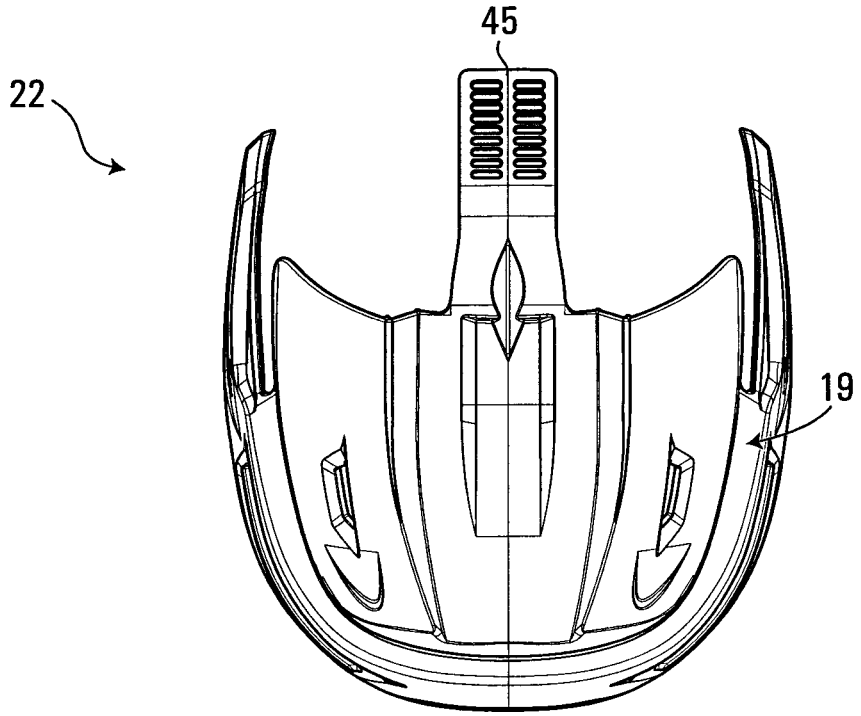
FIGS. 14 and 15 show an example of shell members of an outer shell of the helmet.
Figure 15:
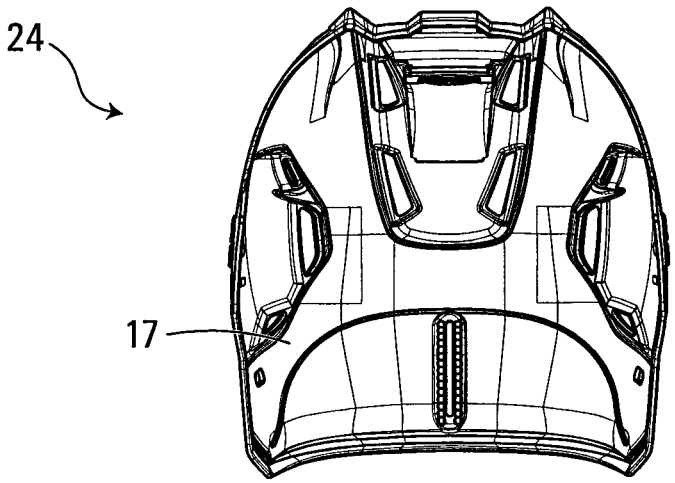
Figure 16:
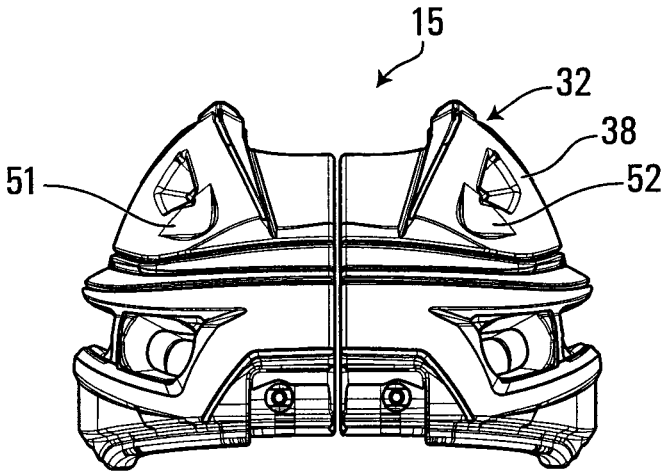
FIGS. 16 to 20 show an example of parts of inner padding of the helmet.
Figure 17:
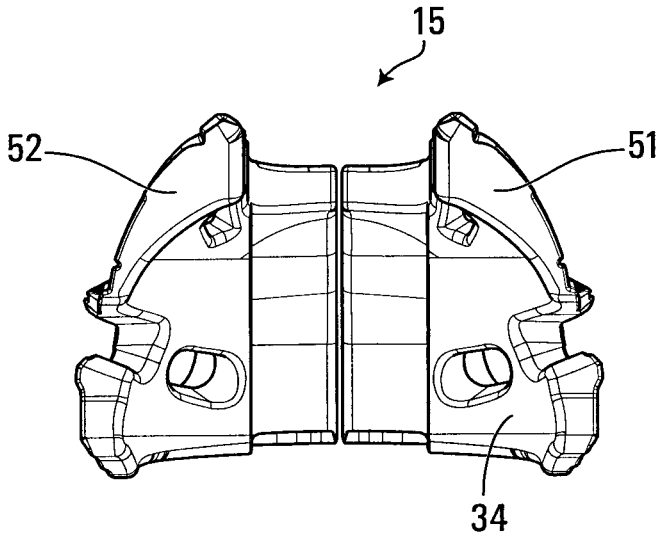
Figure 18:
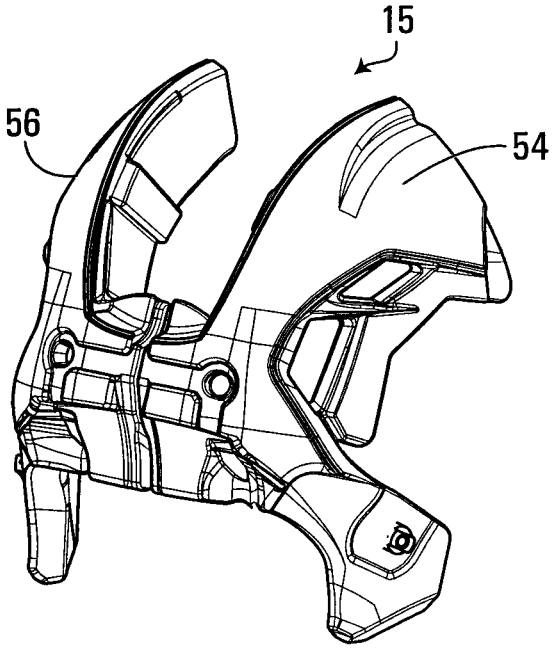
Figure 19:
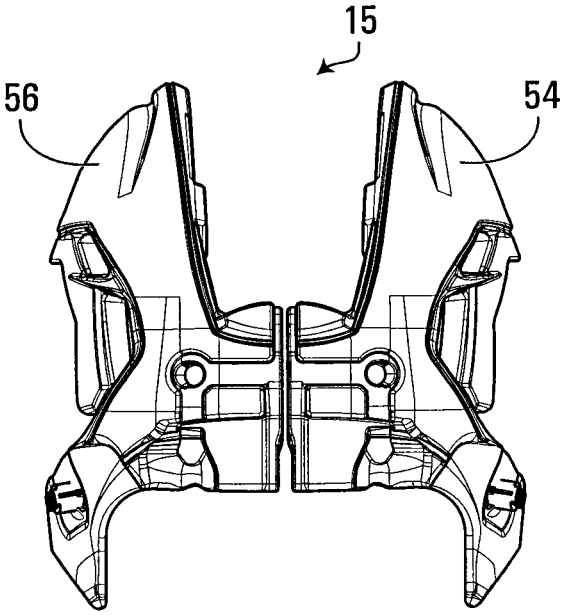
Figure 20:
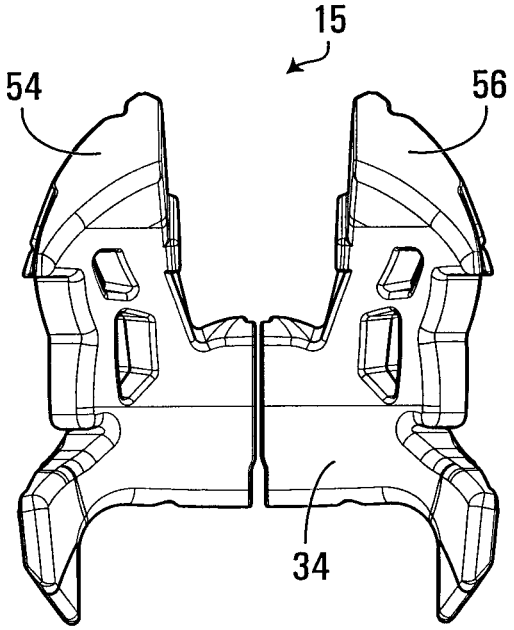

In this example of implementation, the adjustment mechanism 40 comprises an actuator 41 that can be moved (in this case pivoted) by the wearer between a locked position, in which the actuator 41 engages a locking part 45 (as best shown in FIGS. 14 and 15) of the front outer shell member 22 and thereby locks the outer shell members 22, 24 relative to one another, and a release position, in which the actuator 41 is disengaged from the locking part 45 of the front outer shell member 22 and thereby permits the outer shell members 22, 24 to move relative to one another so as to adjust the size of the helmet 10. The adjustment mechanism 40 may be implemented in various other ways in other embodiments.

In this embodiment, the outer shell 12 comprises a plurality of ventilation holes $\mathbf{39}_1$-$\mathbf{39}_V$ allowing air to circulate around the wearer's head 11 for added comfort. In this case, each of the front and rear outer shell members 22, 24 defines respective ones of the ventilation holes $\mathbf{39}_1$-$\mathbf{39}_V$ of the outer shell 12.

The outer shell 12 may be implemented in various other ways in other embodiments. For example, in other embodiments, the outer shell 12 may be a single-piece shell. In such embodiments, the adjustment mechanism 40 may comprise an internal adjustment device located within the helmet 10 and having a head-facing surface movable relative to the wearer's head 11 in order to adjust the fit of the helmet 10. For instance, in some cases, the internal adjustment device may comprise an internal pad member movable relative to the wearer's head 11 or an inflatable member which can be inflated so that its surface can be moved closer to or further from the wearer's head 11 to adjust the fit.

The inner padding 15 is disposed between the outer shell 12 and the wearer's head 11 in use to absorb impact energy when the helmet 10 is impacted. More particularly, the inner padding 15 comprises a shock-absorbing structure 32 that includes an outer surface 38 facing towards the outer shell 12 and an inner surface 34 facing towards the wearer's head 11. For example, in some embodiments, the shock-absorbing structure 32 of the inner padding 15 may comprise a shock-absorbing material. For instance, in some cases, the shock-absorbing material may include a polymeric cellular material, such as a polymeric foam (e.g., expanded polypropylene (EPP) foam, expanded polyethylene (EPE) foam, vinyl nitrile (VN) foam, polyurethane foam (e.g., PORON XRD foam commercialized by Rogers Corporation), or any other suitable polymeric foam material), or expanded polymeric microspheres (e.g., Expancel™ microspheres commercialized by Akzo Nobel). In some cases, the shock-absorbing material may include an elastomeric material (e.g., a rubber such as styrene-butadiene rubber or any other suitable rubber; a polyurethane elastomer such as thermoplastic polyurethane (TPU); any other thermoplastic elastomer; etc.). In some cases, the shock-absorbing material may include a fluid (e.g., a liquid or a gas), which may be contained within a container (e.g., a flexible bag, pouch or other envelope) or implemented as a gel (e.g., a polyurethane gel). Any other material with suitable impact energy absorption may be used in other embodiments. Additionally or alternatively, in some embodiments, the shock-absorbing structure 32 of the inner padding 15 may comprise an arrangement (e.g., an array) of shock absorbers that are configured to deform when the helmet 10 is impacted. For instance, in some cases, the arrangement of shock absorbers may include an array of compressible cells that can compress when the helmet 10 is impacted. Examples of this are described in U.S. Pat. No. 7,677,538 and U.S. Patent Application Publication 2010/0258988, which are incorporated by reference herein.

The inner padding 15 may be mounted to the outer shell 12 in various ways. For example, in some embodiments, the inner padding 15 may be mounted to the outer shell 12 by one or more fasteners such as mechanical fasteners (e.g., tacks, staples, rivets, screws, stitches, etc.), an adhesive, or any other suitable fastener. In such embodiments, the inner padding 15 is affixed to the outer shell 12 and, during movement of the front and rear outer shell members 22, 24 to adjust the size of the helmet 10, various parts of the inner padding 15 move along with the outer shell members 22, 24.

In this embodiment, as shown in FIGS. 16 to 20, the inner padding 15 comprises a front left inner pad member 52 for facing at least part of the front region FR and left side region LS of the wearer's head 11, a front right inner pad member 51 for facing at least part of the front region FR and right side region RS of the wearer's head 11, a rear left inner pad member 56 for facing at least part of the back region BR and left side region LS of the wearer's head 11, a rear right inner pad member 54 for facing at least part of the back region BR and right side region RS of the wearer's head 11, and a top inner pad member 58 for facing at least part of the top region TR and back region BR of the wearer's head 11. The front outer shell member 22 overlays the front right and left inner pad members 51, 52 while the rear outer shell member 24 overlays the rear right and left inner pad members 54, 56 and the top inner pad member 58. The inner pad members 51, 52, 54, 56, 58 of the inner padding 15 are movable relative to one another and with the outer shell members 22, 24 to allow adjustment of the fit of the helmet 10 using the adjustment mechanism 40.

Also, in this embodiment, the inner padding 15 comprises left and right comfort pad members 48, 49 for facing the left and right side regions of the wearer's head 11 above the ears. The comfort pad members 48, 49 may comprise any suitable soft material providing comfort to the wearer. For example, in some embodiments, the comfort pad members 48, 49 may comprise polymeric foam such as polyvinyl chloride (PVC) foam or polyurethane foam (e.g., PORON XRD foam commercialized by Rogers Corporation).

The inner padding 15 may be implemented in various other ways in other embodiments. For example, in other embodiments, the inner padding 15 may comprise any number of pad members (e.g., two pad members such as one pad member that faces at least part of the front region FR, top region TR, and left and right side regions LS, RS of the wearer's head 11 and another pad member that faces at least part of the back region BR, top region TR, and left and right side regions LS, RS of the wearer's head 11; a single pad that faces at least part of the front region FR, top region TR, left and right side regions LS, RS, and back region BR of the wearer's head 11; etc.).

The faceguard 14, when part of the helmet 10, protects at least part of a face of the wearer. For example, in some embodiments, as shown in FIG. 12, the faceguard 14 may comprise a grid (sometimes referred to as a "cage"). As another example, in some embodiments, as shown in FIG. 11, the faceguard 14 may comprise a visor (sometimes referred to as a "shield"). The visor may cover the wearer's eyes, nose and mouth or may cover a smaller area of the wearer's face (e.g., the wearer's eyes but not his/her nose and mouth).

The rotational impact protection system 28 of the helmet 10 may be implemented in various ways. Examples of embodiments of the rotational impact protection system 28 are considered below.

1. Internal Elements for Rotational Impact Protection

In some embodiments, the rotational impact protection system 28 of the helmet 10 may comprise one or more internal elements (e.g., of the outer shell 12 and/or the inner padding 15) movable relative to one another or otherwise configured to absorb energy from a rotational impact.

Figure 21:
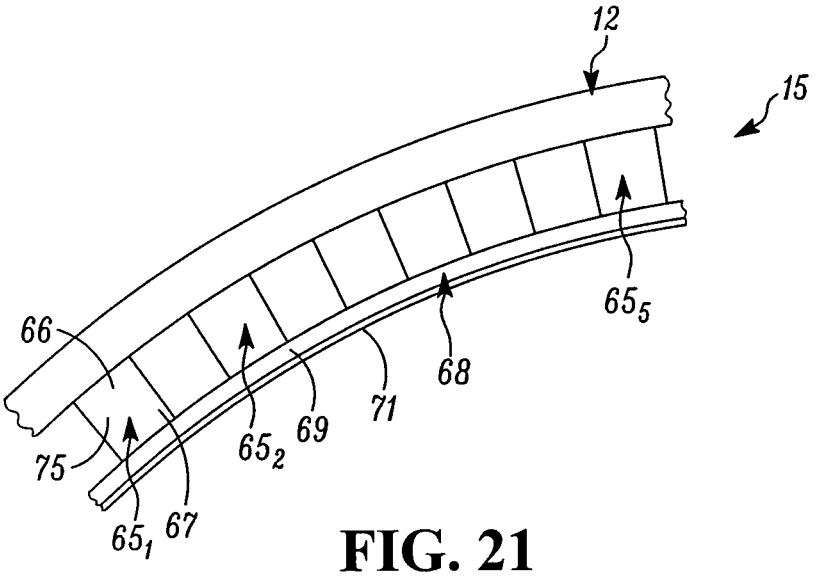
FIGS. 21 to 23 show an example of an arrangement of shock absorbers that are deformable.
Figure 22:
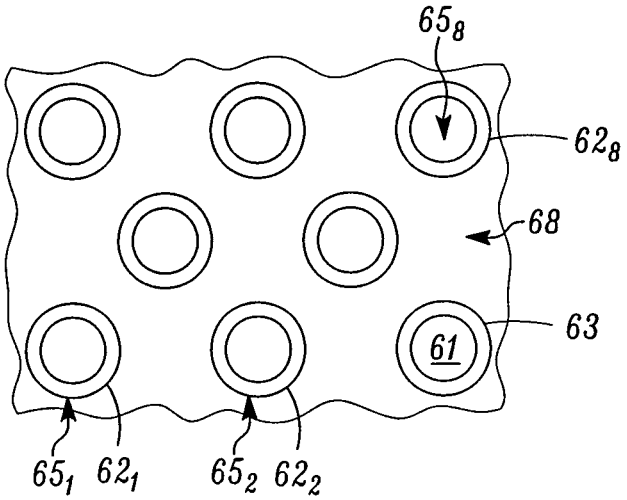
Figure 23:
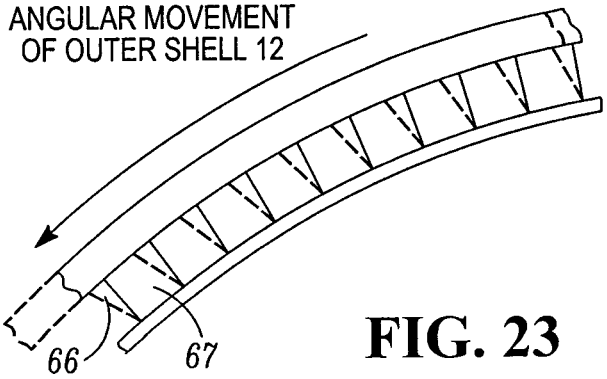

1.1 Arrangement of Shock Absorbers which are Deformable in Response to a Rotational Impact In some embodiments, as shown in FIGS. 21 to 23, the shock-absorbing structure 32 of the inner padding 15 may comprise an arrangement (e.g., an array) of shock absorbers $\mathbf{65}_1$-$\mathbf{65}_N$ which are deformable (e.g., shearable or deflectable) in response to a rotational impact on the helmet 10, such that an outer part 66 of a given one of the shock absorbers $\mathbf{65}_1$-$\mathbf{65}_N$ moves relative to an inner part 67 of the given one of the shock absorbers $65_1$-$65_N$ in a direction tangential to an angular movement of the outer shell 12 due to the rotational impact. This elastic deformation of the shock absorbers $65_1$-$65_N$ absorbs energy from the rotational impact and may thus reduce its effect on the wearer's head 11.

In this embodiment, the shock-absorbing structure 32 of the inner padding 15 comprises an interconnector 68 interconnecting the shock absorbers $65_1$-$65_N$ such that the shock absorbers $65_1$-$65_N$ are linked together as a group. For instance, in this embodiment, the interconnector 68 comprises a base 69 from which project the shock absorbers $65_1$-$65_N$. The interconnector 68 may comprise a liner 71 for contacting the wearer's head 11. By way of example, the liner 71 may comprise foam for comfort of the wearer's head 11 such as polyvinyl chloride (PVC) foam or polyurethane foam (e.g., PORON XRD foam commercialized by Rogers Corporation).

Figure 24:
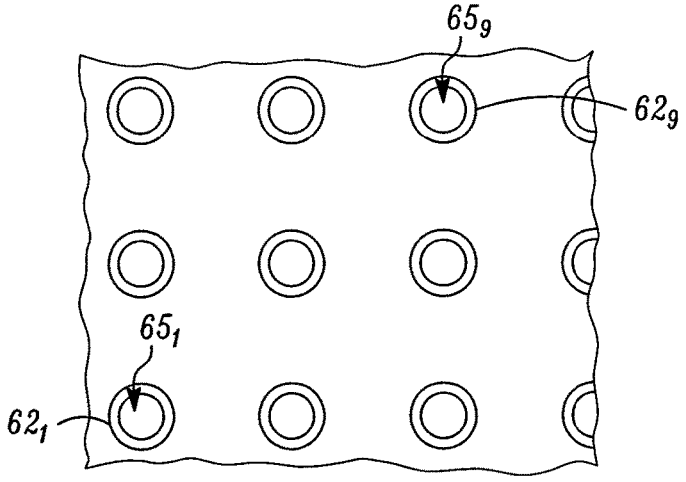
FIGS. 24 to 27 show other examples of an arrangement of shock absorbers that are deformable.

More particularly, in this embodiment, each shock absorber $65_x$ is a compressible cell that can compress in response to a linear impact force. For instance, the shock absorber $65_x$ may include a tubular member $62_x$. In this case, the tubular member 62, may have an elongated shape with a top opening 63, a bottom opening 64, and a passageway 61 extending through it. The tubular members 62-$62_N$ may be arranged in any suitable configuration, such as in a staggered configuration as shown in FIG. 22, as in a square matrix as shown in FIG. 24, or in any other desired configuration. The tubular members 62-$62_N$ may have any other suitable shape in other embodiments (e.g., the cross-sectional dimensions of the tubular member $62_x$ along its length from the top opening 63 to the bottom opening 64 may vary). In some examples of implementation, the tubular members could be implemented using the structure discussed in U.S. Pat. No. 7,677,538 and U.S. Patent Application Publication 2010/0258988.

Figure 28:
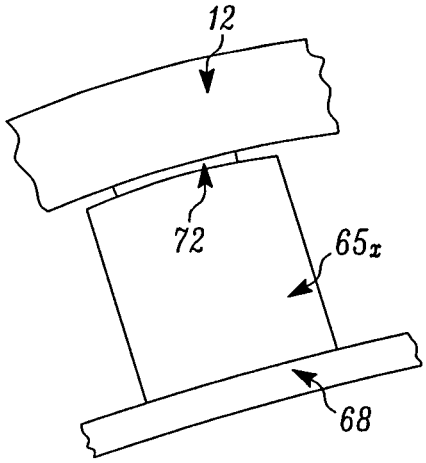
FIG. 28 shows an example of a shock absorber fastened to the outer shell.

Each shock absorber $65_x$ is configured such that the angular movement of the outer shell 12 due to a rotational impact causes the outer part 66 of the each shock absorber $65_x$ to move relative to the inner part 67 of the shock absorber $65_x$ in a direction tangential to the outer shell's angular movement. In this case, the outer part 66 of the shock absorber $65_x$ interfaces with the outer shell 12 such that the outer part 66 is dragged or otherwise drawn by the outer shell 12 when the outer shell 12 angularly moves. For instance, the embodiment shown in FIG. 23 illustrates in dotted lines the outer part 66 of each shock absorber $65_x$ displaced relative to the inner part 67 of each shock absorber $65_x$ in a direction tangential to the outer shell's angular movement. For example, with additional reference to FIG. 28, in some embodiments, the outer part 66 of the shock absorber $65_x$ may be fastened to the outer shell 12 by a fastener 72. In various cases, the fastener 72 may be an adhesive fastener, a mechanical fastener (e.g., screw or other threaded fastener, rivet, etc.) or any other suitable fastener.

Each shock absorber $65_x$ is at least partly (i.e., partly or entirely) made of a deformable material 75 to allow it to elastically deform such that the outer part 66 of the shock absorber $65_x$ moves relative to the inner part 67 of the shock absorber $65_x$ in a direction tangential to the outer shell's angular movement. In that sense, the deformable material 75 may sometimes be referred to as a "flexible", "elastic", "compliant" or "resilient" material. For instance, in some embodiments, the deformable material 75 of the shock absorber $65_x$ is such that the shock absorber $65_x$ is shearable. In some embodiments, the deformable material 75 of the shock absorber $65_x$ is such that the shock absorber $65_x$ is bendable. In some embodiments, the deformable material 75 of the shock absorber $65_x$ is such that the shock absorber $65_x$ is stretchable.

For example, in some embodiments, the deformable material 75 may have an elastic modulus (i.e., modulus of elasticity) of no more than a certain value to provide suitable elastic deformation. For instance, in some embodiments, the elastic modulus of the deformable material 75 may be no more than 75 MPa, in some cases no more than 65 MPa, in some cases no more than 55 MPa, in some cases less than 45 MPa, and in some cases even less. The elastic modulus of the deformable material 75 may have any other suitable value in other embodiments.

As another example, in some embodiments, the deformable material 75 may have a resilience within a certain range to provide suitable elastic deformation. For instance, in some embodiments, the resilience of the deformable material 75 may be at least 10%, in some cases at least 20%, in some cases at least 30%, and in some cases at least 40% according to DIN 53512 of the German institute for standardization and/or may be no more than 40%, in some cases no more than 30%, in some cases no more than 20%, and in some cases no more than 10% according to DIN 53512. The resilience of the deformable material 75 may have any other suitable value in other embodiments.

As another example, in some embodiments, the deformable material 75 may have a compression deflection within a certain range to provide suitable elastic deformation. For instance, in some embodiments, the compression deflection (i.e., 25% compression deflection) of the deformable material 75 may be at least 5 psi, in some cases at least 10 psi, in some cases at least 20 psi, and in some cases at least 30 psi according to ASTM D-1056 and/or may be no more than 30 psi, in some cases no more than 20 psi, in some cases no more than 10 psi, and in some cases no more than 5 psi according to ASTM D-1056. The compression deflection of the deformable material 75 may have any other suitable value in other embodiments.

For instance, in some embodiments, the deformable material 75 may comprise polymeric cellular material. For instance, the polymeric cellular material may comprise polymeric foam such as expanded polypropylene (EPP) foam, expanded polyethylene (EPE) foam, vinyl nitrile (VN) foam, polyurethane foam (e.g., PORON XRD foam commercialized by Rogers Corporation), or any other suitable polymeric foam material and/or may comprise expanded polymeric microspheres (e.g., Expancel™ microspheres commercialized by Akzo Nobel). In other embodiments, the deformable material 75 may comprise an elastomeric material (e.g., a rubber such as styrene-butadiene rubber or any other suitable rubber; a polyurethane elastomer such as thermoplastic polyurethane (TPU); any other thermoplastic elastomer; etc.). In yet other embodiments, the deformable material 75 may comprise a flexible plastic (e.g., low-density polyethylene).

Figure 31:
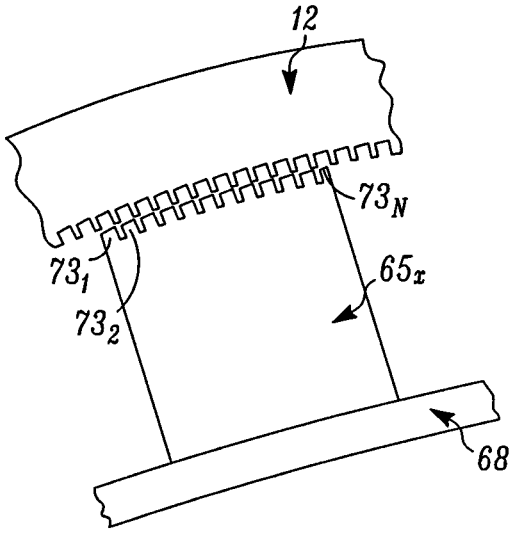

In order to provide rotational impact protection, in some embodiments, each shock absorber $65_x$ may have a shear stiffness $K_S$ of no more than a certain value, where the shear stiffness $K_S$ is defined as a ratio $F_S/\delta_S$ of a shear force $F_S$ applied at an outer end 78 of the shock absorber $65_x$ over a displacement $\delta_S$ of the outer end 78 of the shock absorber $65_x$ while an inner end 79 of the shock absorber $65_x$ is fixed, as shown in FIG. 31.

The shock absorbers $65_1$-$65_N$ and/or the interconnector 68 may be manufactured using any suitable manufacturing technique. For example, in some embodiments, the shock absorbers $65_1$-$65_N$ may be made by molding (e.g., injection molding), such as by integrally molding them together as one-piece or molding them as separate parts and then assembled together (e.g., by an adhesive, ultrasonic welding, stitching, etc.), or may be made by any other suitable manufacturing process.

The arrangement of shock absorbers $\mathbf{65}_1$-$\mathbf{65}_N$ and the interconnector 68 may be configured in various other ways in other embodiments.

Figure 25:
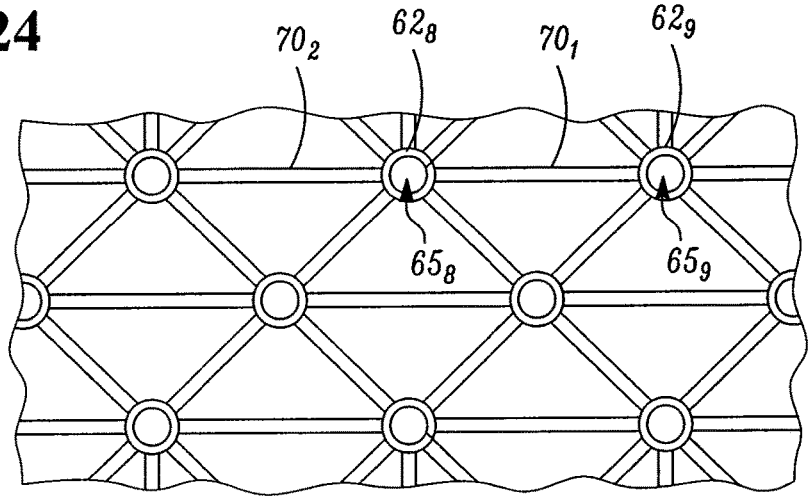
Figure 26:
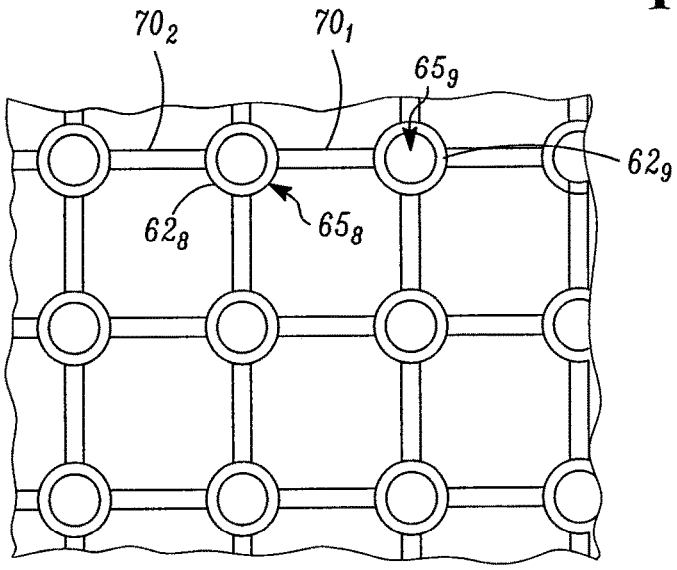
Figure 27:
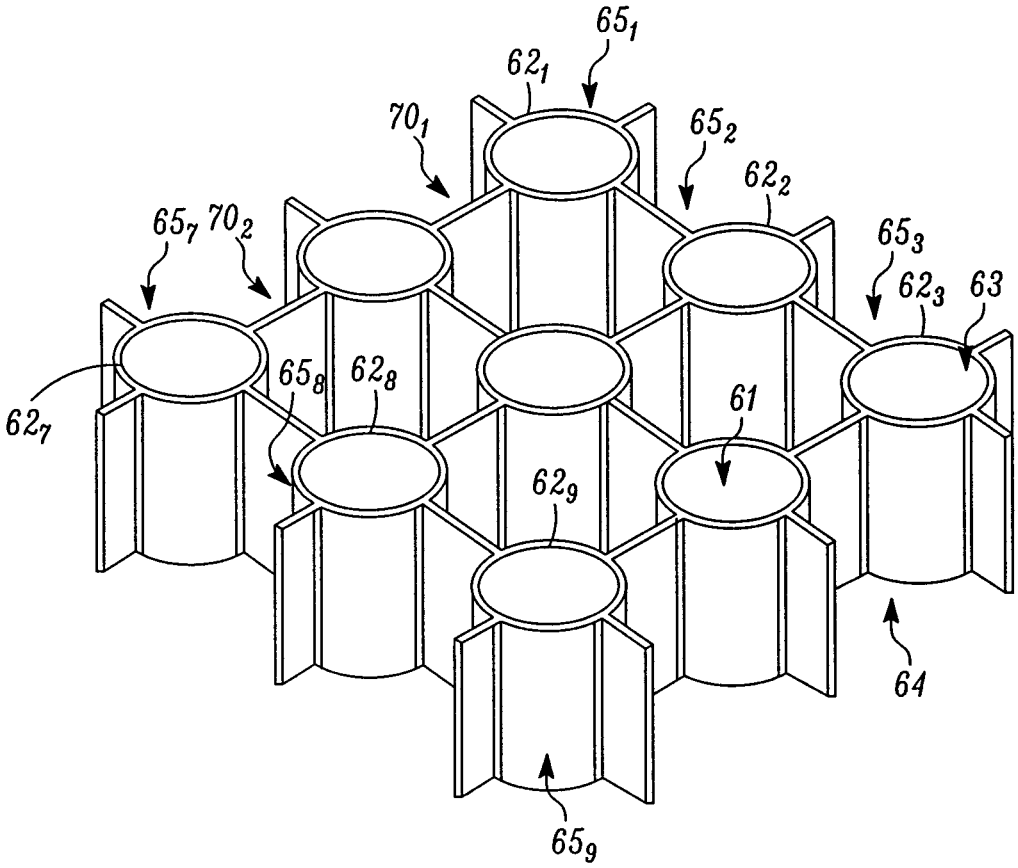

For example, in other embodiments, as shown in FIGS. 25 to 27, the interconnector 68 may comprise interconnecting members $\mathbf{70}_1$-$\mathbf{70}_M$ between the shock absorbers $\mathbf{65}_1$-$\mathbf{65}_N$, with or without the base 69. For instance, the interconnecting members $\mathbf{70}_1$-$\mathbf{70}_M$ may be webs constituting webbing. Furthermore, the webs $\mathbf{70}_1$-$\mathbf{70}_M$ may be configured for maintaining the axis of elongation of each of the shock absorbers $\mathbf{65}_1$-$\mathbf{65}_N$. For example, FIG. 25 and FIGS. 26 and 27 illustrate the shock absorbers $\mathbf{65}_1$-$\mathbf{65}_N$ interconnected with the webs $\mathbf{70}_1$-$\mathbf{70}_M$ in a triangular and square configuration, respectively. In some cases, the interconnecting members $\mathbf{70}_1$-$\mathbf{70}_M$ may be web members similar to what is discussed in U.S. Pat. No. 7,677,538 and U.S. Patent Application Publication 2010/0258988.

Figure 29:
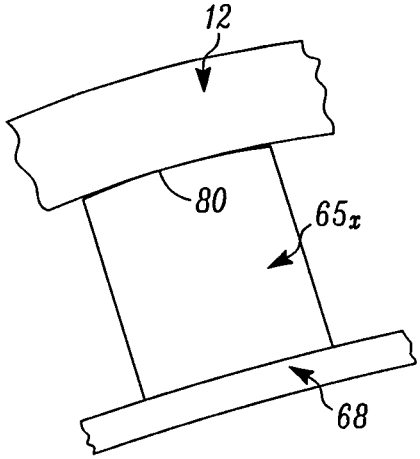
FIGS. 29 to 31 and 34 show examples of a shock absorber having a frictional interface with the outer shell.
Figure 30:
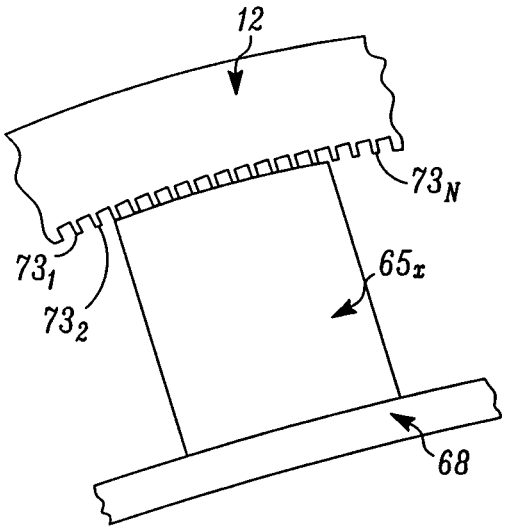

By way of another example, in other embodiments, as shown in FIGS. 29 to 31, the outer part 66 of the shock absorber $\mathbf{65}_x$ may have a frictional interface 80 with the outer shell 12 to frictionally engage the outer shell 12 with sufficient friction that the outer part 66 is dragged or otherwise drawn by the outer shell 12 when the outer shell 12 angularly moves. For instance, in some embodiments, a coefficient of friction between the outer shell 12 and the outer part 66 of the shock absorber $\mathbf{65}_x$ may be at least 0.2, in some cases at least 0.3, in some cases at least 0.4, in some cases at least 0.5, in some cases at least 0.6., in some cases at least 0.7, and in some cases even more, according to ASTM G115. The coefficient of friction between the outer shell 12 and the outer part 66 of the shock absorber $\mathbf{65}_x$ may have any other suitable value in other embodiments.

For instance, in some embodiments, as shown in FIGS. 30 and 31, the frictional interface 80 may comprise an arrangement of friction-increasing members $\mathbf{73}_1$-$\mathbf{73}_F$ on the inner surface 17 of outer shell 12 and/or the outer part 66 of the shock absorber $\mathbf{65}_x$. More specifically, the friction-increasing members $\mathbf{73}_1$-$\mathbf{73}_F$ may comprise: recesses (e.g., grooves) and/or projections (e.g., ridges); a corrugated surface; textured surface with "rough" surface texture; or a combination thereof. The friction-increasing members $\mathbf{73}_1$-$\mathbf{73}_F$ may be on the inner surface 17 of outer shell 12, on the outer part 66 of the shock absorber $\mathbf{65}_x$, or on both.

Figure 34:
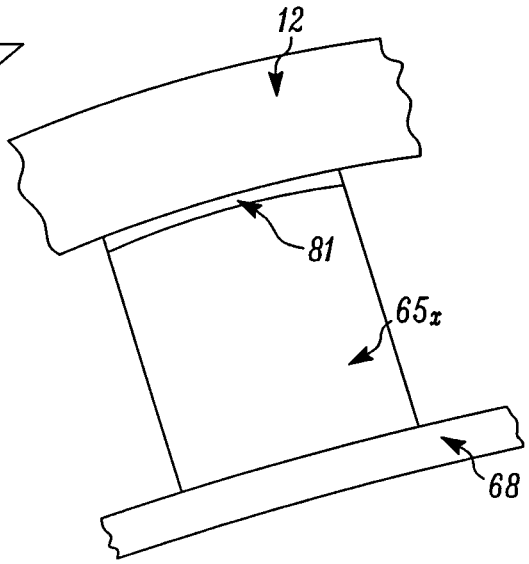

In other embodiments, as illustrated in FIG. 34, the frictional interface 80 may comprise a tackifying material 81 to exert sufficient friction to draw or drag the outer part 66 of the shock absorber $\mathbf{65}_x$ when the outer shell 12 angularly moves. For instance, the tackifying material 81 may comprise a thermoplastic elastomer (e.g., Santoprene™), polyurethane (thermoplastic or thermoset), polyvinyl chloride (e.g., Plastisol), silicone, or any other suitable material providing tackiness.

In embodiments where individual ones of the shock absorbers $\mathbf{65}_1$-$\mathbf{65}_N$ are not directly connected or fastened to the outer shell 12, the arrangement of shock absorbers $\mathbf{65}_1$-$\mathbf{65}_N$ may be secured within the helmet 10 in any suitable way. For example, in some embodiments, the interconnector 68 may be fastened to the outer shell 12 at one or more fastening points along a lower edge portion of the outer shell 12 by one or more fasteners (e.g., screws, rivets, an adhesive, etc.).

By way of another example, in some embodiments, different parts of the shock absorber $\mathbf{65}_x$ may be configured to exhibit different levels of stiffness such that a first part of the shock absorber $\mathbf{65}_x$ is stiffer than a second part of the shock absorber $\mathbf{65}_x$, thereby resulting in the first part of the shock absorber $\mathbf{65}_x$ deforming less than the second part of the shock absorber $\mathbf{65}_x$ in response to an impact.

Figure 32:
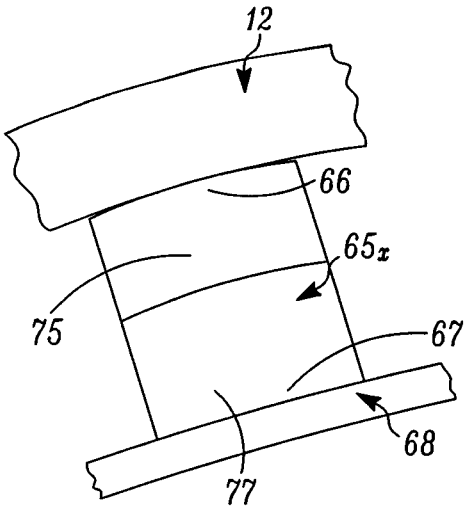
FIG. 32 show an example of a shock absorber comprising a plurality of different deformable materials.
Figure 33:
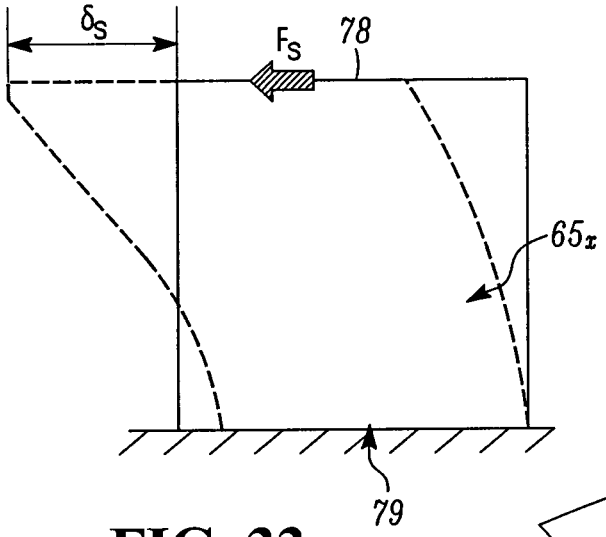
FIG. 33 shows an example of a deformation of a shock absorber.

For example, in some embodiments, with additional reference to FIG. 32, different parts of the shock absorber $\mathbf{65}_x$ may be made of different deformable materials such that a first part of the shock absorber $\mathbf{65}_x$ is made of the deformable material 75 and a second part of the shock absorber $\mathbf{65}_x$ is made of a deformable material 77 different from (e.g., stiffer than) the deformable material 75. For instance, in this case, the outer part 66 of the shock absorber $\mathbf{65}_x$ may be made of the deformable material 75 and the inner part 67 of the shock absorber $\mathbf{65}_x$ may be made of the deformable material 77 which is stiffer (e.g., denser) than the deformable material 75 such that the outer part 66 deforms more than the inner part 67. In other cases, this may be reversed, with the deformable material 75 being stiffer (e.g., denser) than the deformable material 77.

Figure 65:
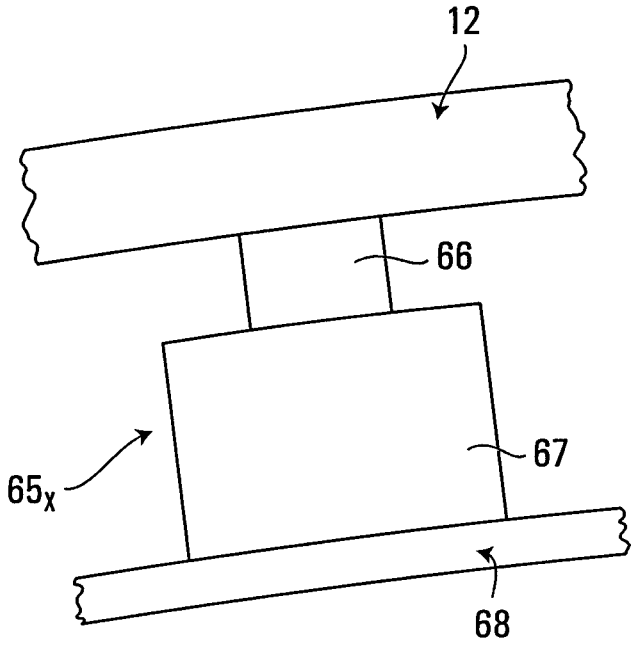
FIGS. 65 to 72 show other examples of shock absorbers of the helmet.
Figure 66:
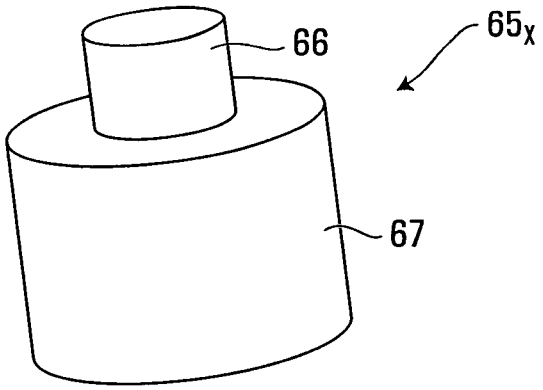

As another example, in some embodiments, with additional reference to FIGS. 65 and 66, different parts of the shock absorber $\mathbf{65}_x$ may have different shapes (e.g., different sizes and/or different geometries) such that a shape of a first part of the shock absorber $\mathbf{65}_x$ is different from a shape of a second part of the shock absorber $\mathbf{65}_x$ and makes the first part of the shock absorber $\mathbf{65}_x$ more rigid than the second part of the shock absorber $\mathbf{65}_x$. For instance, in this case, a shape of the inner part 67 of the shock absorber $\mathbf{65}_x$ may be different than a shape of the outer part 66 of the shock absorber $\mathbf{65}_x$ and make the inner part 67 of the shock absorber $\mathbf{65}_x$ more rigid than the outer part 66 of the shock absorber $\mathbf{65}_x$ such that the outer part 66 deforms more than the inner part 67. In this example, a cross-sectional dimension (e.g., a diameter) of the inner part 67 of the shock absorber $\mathbf{65}_x$ may be than that of the outer part 66 of the shock absorber $\mathbf{65}_x$, thereby making it more rigid. More particularly, in this example, the inner part 67 and the outer part 66 of the shock absorber $\mathbf{65}_x$ may be cylindrical with the inner part 67 having a greater outer diameter than the outer part 66. In other examples, this may be reversed, with the inner part 67 of the shock absorber $\mathbf{65}_x$ being smaller and less rigid than the outer part 66 of the shock absorber $\mathbf{65}_x$. The inner part 67 and the outer part 66 of the shock absorber $\mathbf{65}_x$ may have any other suitable different shapes in other examples (e.g., polygonal and non-polygonal shapes).

Figure 67:
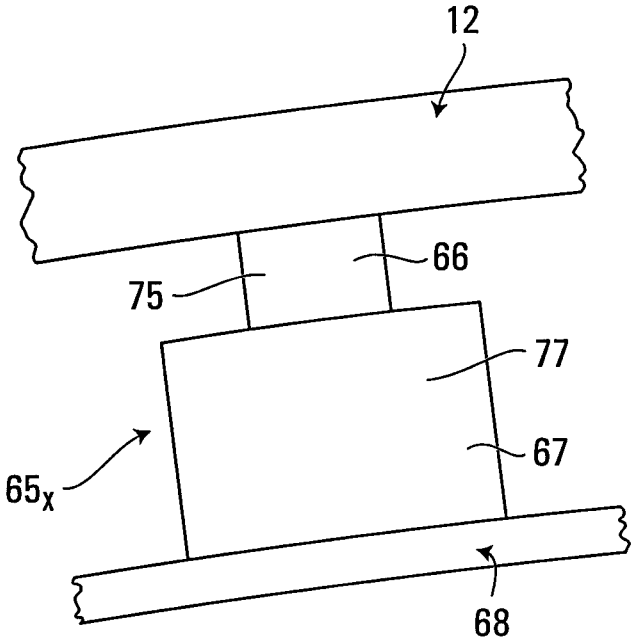

As another example, in some embodiments, with additional reference to FIG. 67, different parts of the shock absorber $\mathbf{65}_x$ may be made of different deformable materials and have different shapes (e.g., different sizes and/or different geometries) such that a first part of the shock absorber $\mathbf{65}_x$ is stiffer than a second part of the shock absorber $\mathbf{65}_x$. For instance, in this case, the inner part 67 of the shock absorber $\mathbf{65}_X$ may be larger (e.g., have a greater diameter) than the outer part 66 of the shock absorber $\mathbf{65}_x$ and may be made of the deformable material 77 which is stiffer (e.g., denser) than the deformable material 75 of the outer part 66 such that the outer part 66 deforms more than the inner part 67. In other cases, this may be reversed, with the inner part 67 of the shock absorber $\mathbf{65}_x$ being smaller (e.g., have a smaller diameter) than the outer part 66 of the shock absorber $\mathbf{65}_x$ and made of the deformable material 77 which is less stiff than the deformable material 75 of the outer part 66.

In embodiments such as those considered above in which different parts (e.g., the inner part 67 and the outer part 66)

of the shock absorber $65_x$ may be configured to exhibit different levels of stiffness such that a first part (e.g., the inner part 67) of the shock absorber $65_x$ is stiffer than a second part (e.g. the outer part 66) of the shock absorber $65_x$, the different levels of stiffness exhibited by the different parts of the shock absorber $65_x$ may differ in any suitable way. For example, in some embodiments, in response to an impact, a ratio of a deflection of the second part (e.g. the outer part 66) of the shock absorber $65_x$ in a direction of the impact over a deflection of the first part (e.g., the inner part 67) of the shock absorber $65_x$ in the direction of the impact may be at least 1.1, in some cases at least 1.2, in some cases at least 1.5, in some cases at least 2, and in some cases even more.

In examples in which the different parts (e.g., the inner part 67 and the outer part 66) of the shock absorber $65_x$ are respectively made of the deformable material 75 and the deformable material 77 which is stiffer than the deformable material 75, the deformable materials 75, 77 may differ in stiffness in any suitable way. For instance, in some embodiments, a ratio of the elastic modulus of the deformable material 77 over the elastic modulus of the deformable material 75 may be at least 1.1, in some cases at least 1.15, in some cases at least 1.2, in some cases at least 1.5, in some cases at least 2, in some cases at least 3, and in some cases even more. This ratio may have any other suitable value in other embodiments. Alternatively or additionally, in some embodiments, a ratio of a compression deflection (i.e., 25% compression deflection) of the deformable material 77 over a compression deflection of the deformable material 75 may be at least 1.1, in some cases at least 1.15, in some cases at least 1.2, in some cases at least 1.5, in some cases at least 2, in some cases at least 3, and in some cases even more, according to ASTM D-1056. This ratio may have any other suitable value in other embodiments.

In embodiments such as those considered above in which different parts (e.g., the inner part 67 and the outer part 66) of the shock absorber $65_x$ may be configured to exhibit different levels of stiffness such that a first part (e.g., the inner part 67) of the shock absorber $65_x$ is stiffer than a second part (e.g. the outer part 66) of the shock absorber $65_x$, the different parts of the shock absorber $65_x$ may be interconnected in any suitable way. For example, in some embodiments, the different parts of the shock absorber $65_x$ may be adhesively bonded together. In other embodiments, the different parts of the shock absorber $65_x$ may be overmolded. In yet other embodiments, the different parts of the shock absorber $65_x$ may be fastened together by a mechanical fastener (e.g., a rivet, staple, etc.). In yet other embodiments, the different parts of the shock absorber $65_x$ may be welded (e.g., by ultrasonic welding). In yet other embodiments, the different parts of the shock absorber $65_x$ may be secured to an intermediate material disposed between them (e.g., by adhesive bonding, one or more mechanical fastener, welding, etc.).

Figure 68:
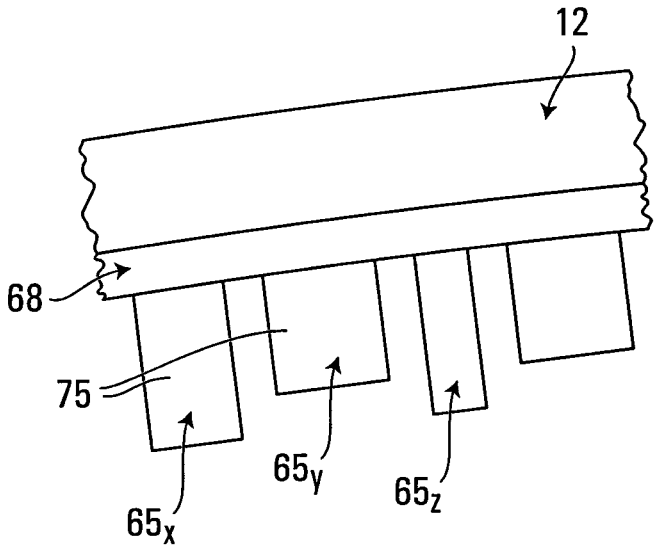
Figure 69:
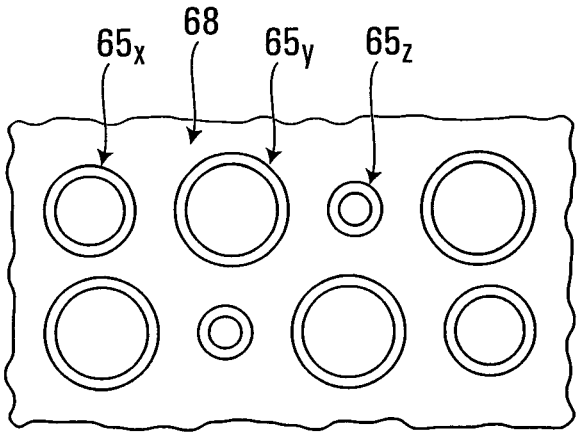

By way of another example, in some embodiments, as shown in FIGS. 68 and 69, different ones of the shock absorbers $65_1$-$65_N$ may have different shapes (e.g., different sizes and/or different geometries) and/or be made of different materials (e.g., having different densities and/or different moduli of elasticity) such that a shock absorber $65_x$ may be stiffer and/or otherwise react differently to an impact than another shock absorber $65_y$.

For example, in some embodiments, a shape of the shock absorber $65_x$ may be different than the shape of the shock absorber $65_y$. In this case, a height of the shock absorber $65_x$ is greater than the height of the shock absorber $65_y$. For instance, in some embodiments, the heights of the shock absorbers $65_x$, $65_y$ may be such that an inner end of the shock absorber $65_x$ is disposed more inwardly (i.e., closer to the wearer's head 11, possibly touching it) than an inner end of the shock absorber $65_y$. Also, in some embodiments, a cross-sectional dimension (e.g., a width) of the shock absorber $65_x$ may be greater than a cross-sectional dimension of the shock absorber $65_y$.

As another example, additionally or alternatively, in some embodiments, the deformable material 75 of the shock absorber $65_x$ may be different from (e.g., stiffer than) the deformable material 75 of the shock absorber $65_y$. The deformable material 75 of the shock absorber $65_x$ and the deformable material 75 of the shock absorber $65_y$ may differ in stiffness in any suitable way. For instance, in some embodiments, a ratio of a compression deflection (i.e., 25% compression deflection) of the deformable material 75 of the shock absorber $65_x$ over a compression deflection of the deformable material 75 of the shock absorber $65_y$ may be at least 1.1, in some cases at least 1.15, in some cases at least 1.2, in some cases at least 1.5, and in some cases at least 2, according to ASTM D-1056. This ratio may have any other suitable value in other embodiments.

In embodiments such as those considered above in which different ones of the shock absorbers $65_1$-$65_N$ may have different shapes (e.g., different sizes and/or different geometries) and/or be made of different materials to exhibit different levels of stiffness, the different levels of stiffness exhibited by the different ones of the shock absorbers $65_1$-$65_N$ may differ in any suitable way. For example, in some embodiments, in response to an impact, a ratio of a deflection of the shock absorber $65_x$ in a direction of the impact over a deflection of the shock absorber $65_y$ in the direction of the impact may be at least 1.1, in some cases at least 1.2, in some cases at least 1.5, in some cases at least 2, and in some cases even more. This ratio may have any other suitable value in other embodiments.

Figure 70:
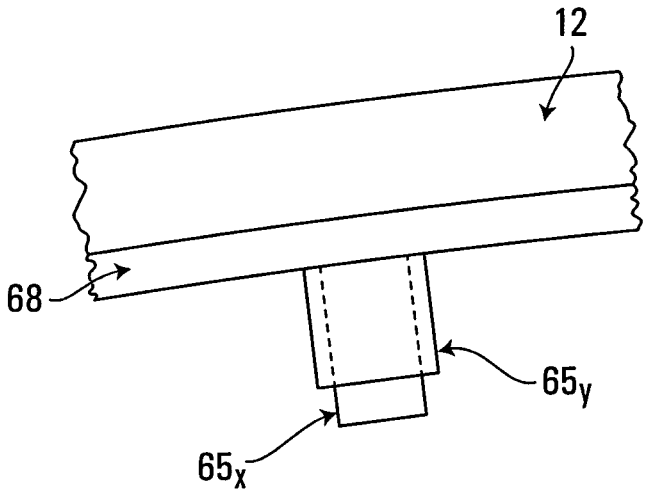
Figure 71:
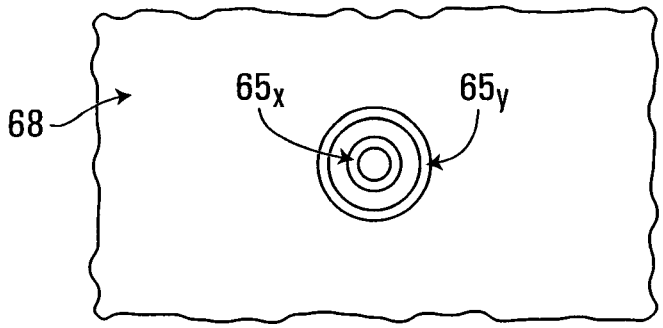

In some embodiments, as shown in FIGS. 68 and 69, the different ones of the shock absorbers $65_1$-$65_N$ having different shapes (e.g., different sizes and/or different geometries) and/or made of different materials may be spaced apart from one another and disposed adjacent to one another in the longitudinal direction and/or in the transversal direction of the helmet 10. In other embodiments, as shown in FIGS. 70 and 71, the different ones of the shock absorbers $65_1$-$65_N$ having different shapes (e.g., different sizes and/or different geometries) and/or made of different materials may be disposed within one another (e.g., concentrically).

Figure 72:
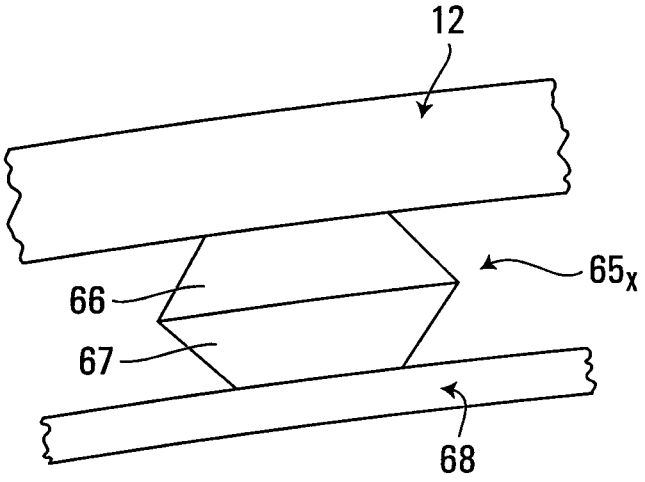
Figure 73:
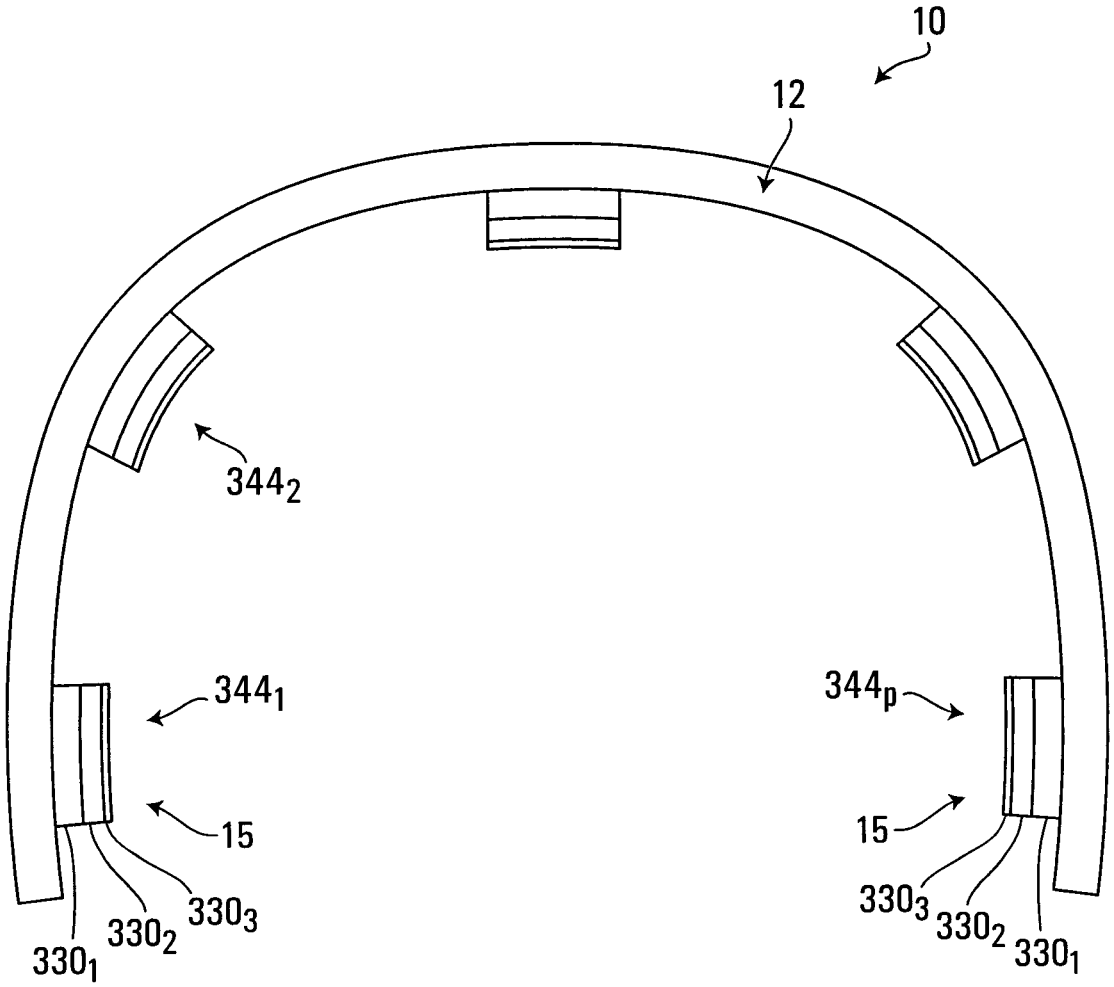
FIGS. 73 to 77 show examples of padding layers that are stacked and interconnected such that compression of adjacent ones of the padding layers is decoupled from shearing of these adjacent ones of the padding layers relative to one another.
Figure 74:
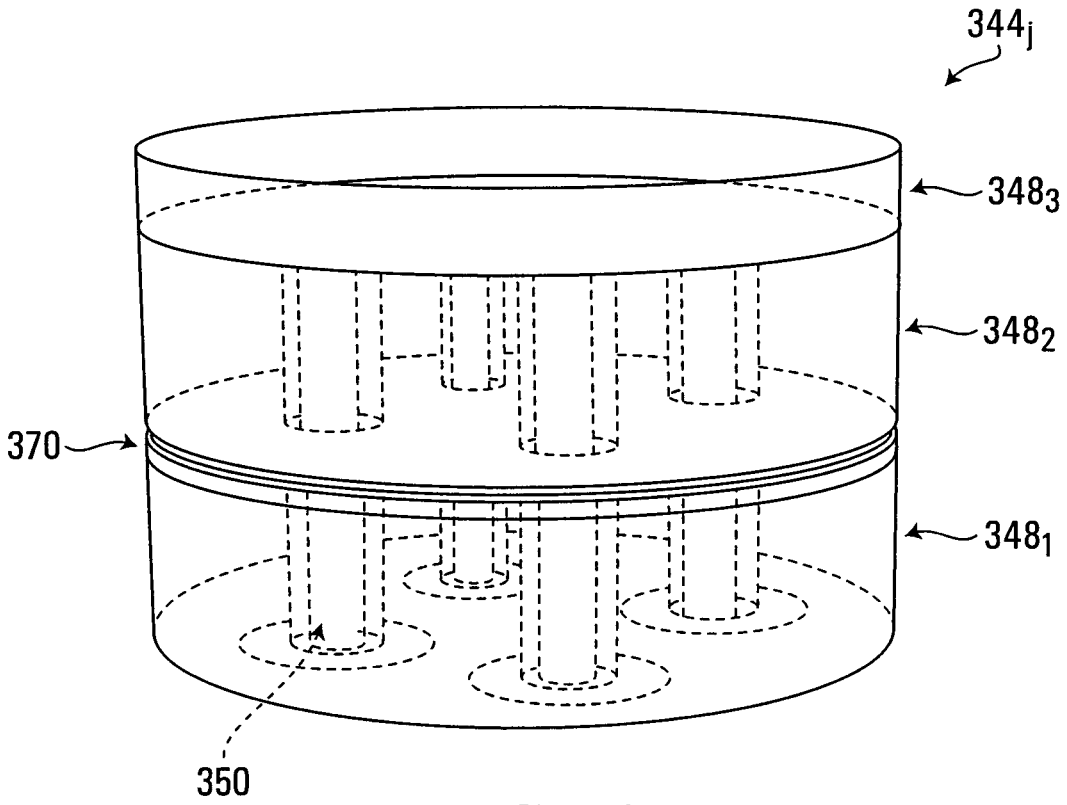
Figure 75:
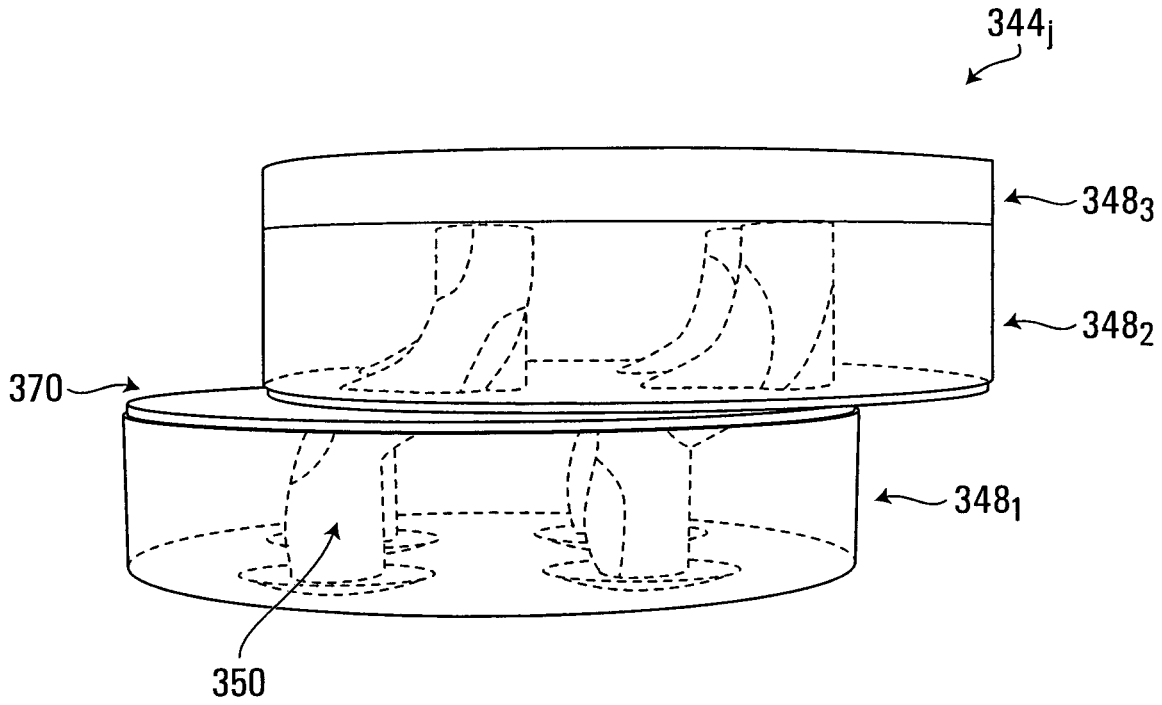
Figure 76:
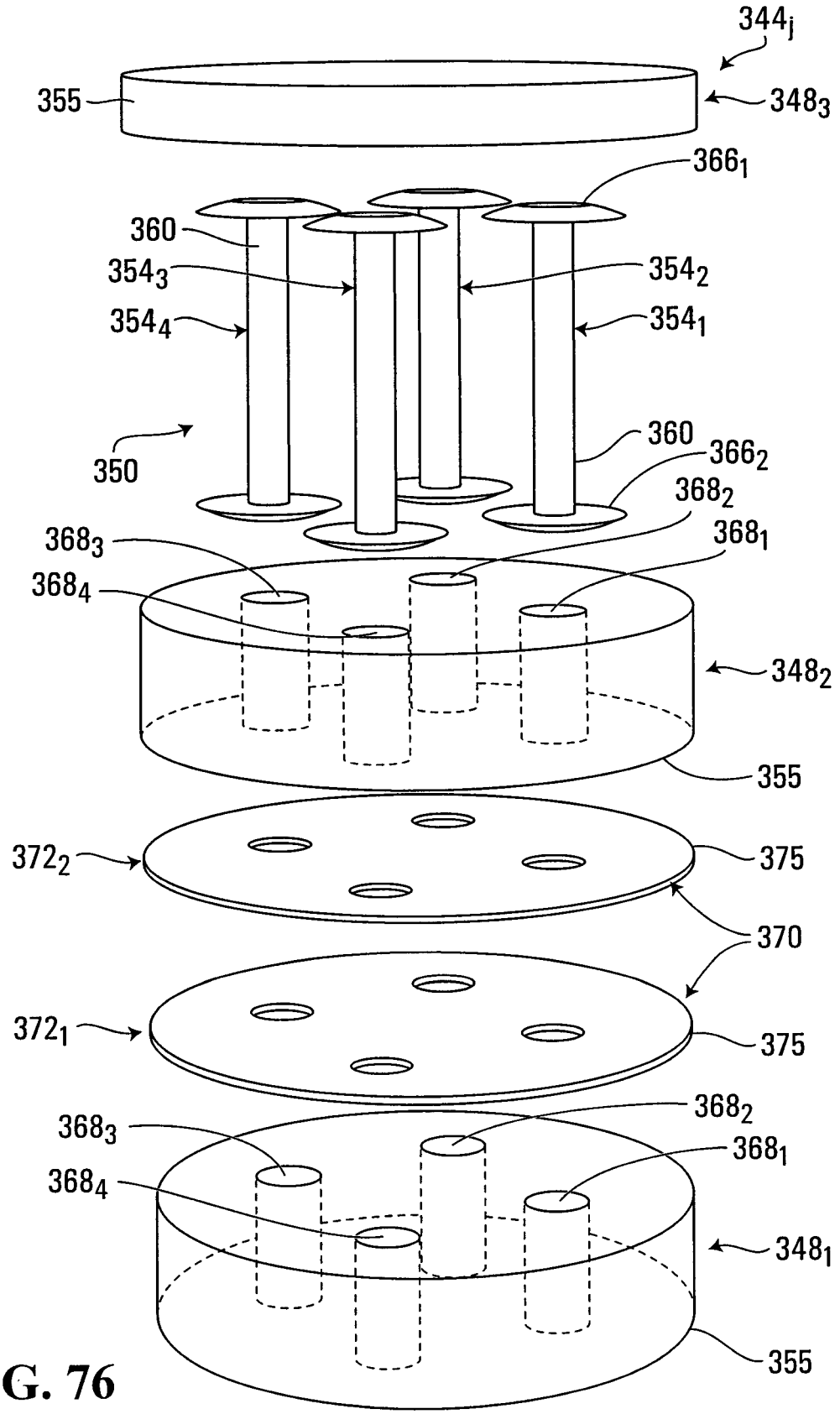

As yet other examples, although the shock absorbers $65_1$-$65_N$ are illustrated as circular in FIGS. 22 and 24 to 27, the shock absorbers $65_1$-$65_N$ could be pentagonal, hexagonal, heptagonal, octagonal, square, rectangular, or otherwise polygonal or have any other suitable shape in other embodiments. Also, in some embodiments, a cross-sectional shape of a shock absorber $65_x$ may vary in a height direction of the shock absorber $65_x$. For instance, as shown in FIG. 72, in some embodiments, an outer part 66 of the shock absorber $65_x$ may taper outwardly (i.e., towards the outer shell 12) while an inner part 67 of the shock absorber $65_x$ may taper inwardly (i.e., towards the wearer's head). Furthermore, while in FIGS. 22 and 24 to 27 the shock absorbers $65_1$-$65_N$ are of the same size and there is even spacing between them, in other embodiments, different sizing and/or different spacing of the shock absorbers $65_1$-$65_N$ are possible.

Figure 78:
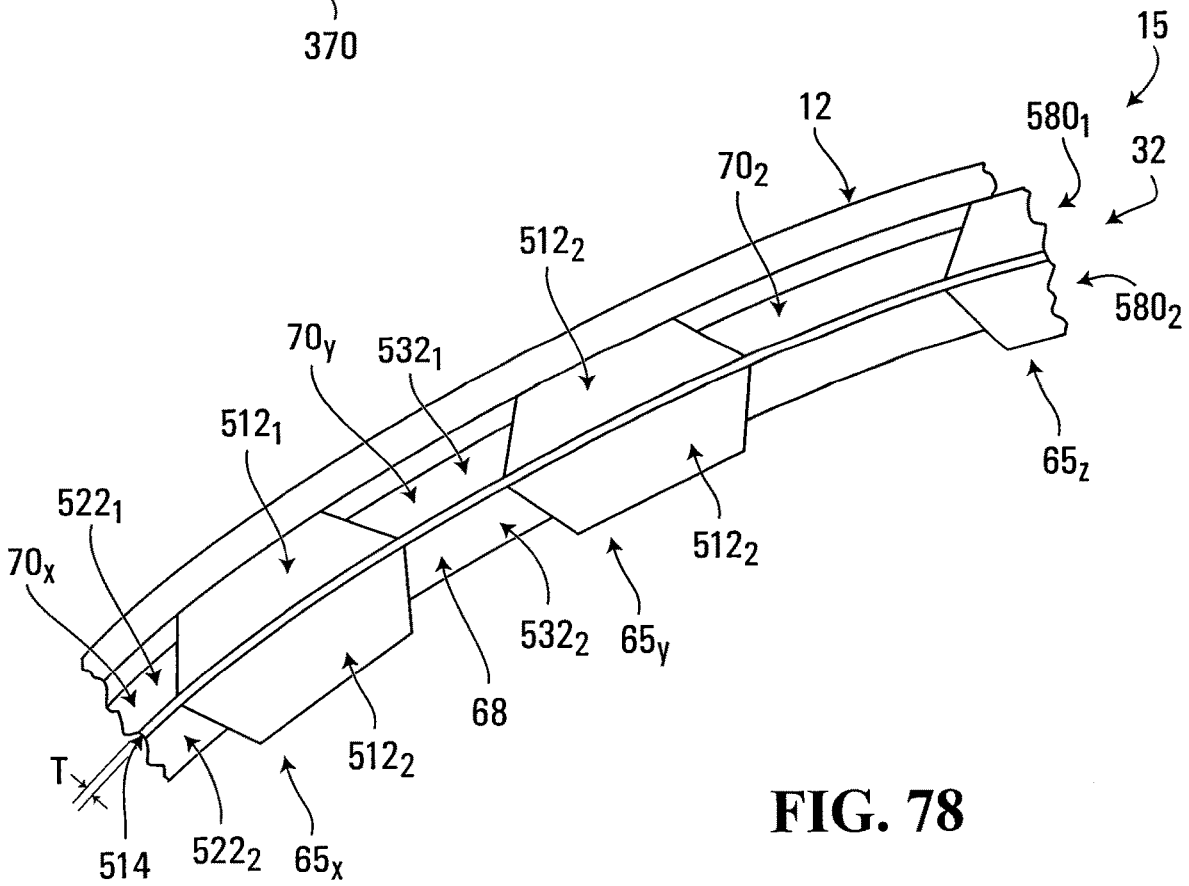
FIGS. 78 to 84 show examples of an arrangement of shock absorbers in which a shearing layer facilitates shearing of different parts of the shock absorbers relative to one another.
Figure 79:
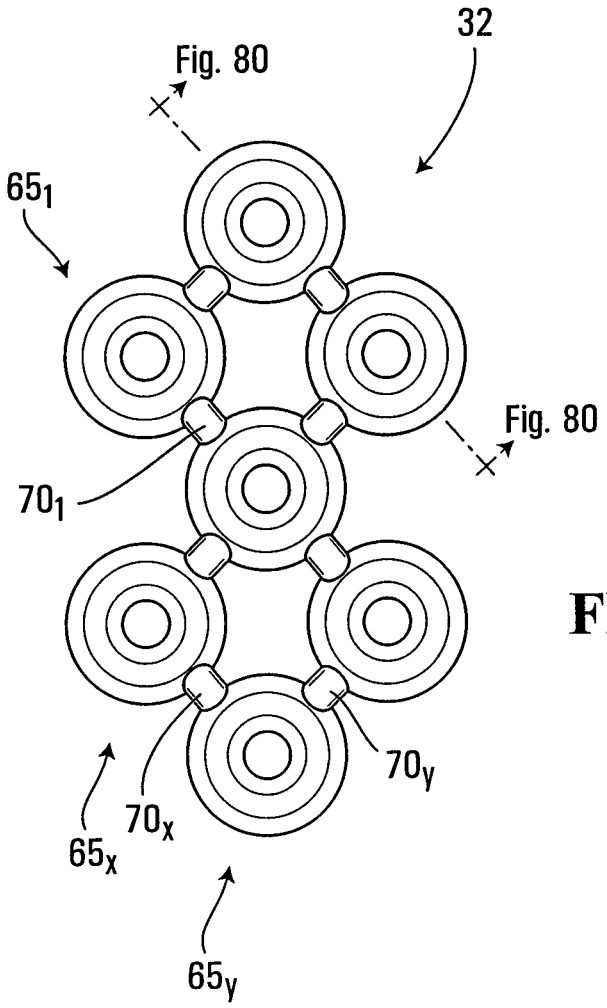
Figure 80:
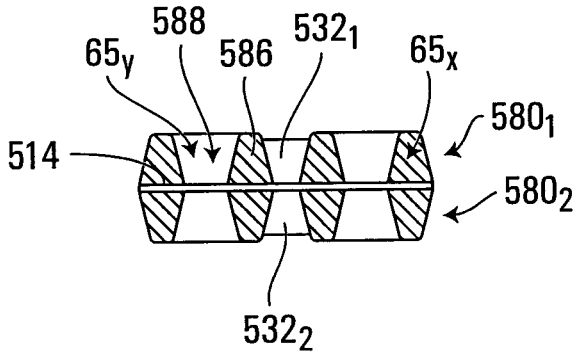

As yet another example, in some embodiments, with additional reference to FIGS. 78 to 80, the shock-absorbing structure 32 of the inner padding 15 may comprise a shearing layer 514 disposed between an outer part $\mathbf{512}_1$ of a shock absorber $\mathbf{65}_x$ and an inner part $\mathbf{512}_2$ of the shock absorber $\mathbf{65}_x$ to allow the outer and inner parts $\mathbf{512}_1$, $\mathbf{512}_2$ of the shock absorber $\mathbf{65}_x$ to shear relative to one another when the helmet 10 is impacted. For example, in response to a rotational impact on the helmet 10, the shearing layer 514 allows the outer part $\mathbf{512}_1$ of the shock absorber $\mathbf{65}_x$ to be movable relative to the inner part $\mathbf{512}_2$ of the shock absorber $\mathbf{65}_x$ in a direction tangential to an angular movement of the outer shell 12 due to the rotational impact.

In this embodiment, the shock absorbers $\mathbf{65}_1$-$\mathbf{65}_N$ are interconnected by the interconnector 68 and the shearing layer 514 is also disposed between an outer part $\mathbf{522}_1$ of the interconnector 68 and an inner part $\mathbf{522}_2$ of the interconnector 68 to allow the outer and inner parts $\mathbf{522}_1$, $\mathbf{522}_2$ of the interconnector 68 to shear relative to one another when the helmet 10 is impacted. More particularly, in this embodiment, the interconnector 68 comprises the interconnecting members $\mathbf{70}_1$-$\mathbf{70}_M$ (e.g., web members) between the shock absorbers $\mathbf{65}_1$-$\mathbf{65}_N$ such that the shearing layer 514 is disposed between an outer part $\mathbf{532}_1$ of each interconnecting member $\mathbf{70}_x$ and an inner part $\mathbf{532}_2$ of the interconnecting member $\mathbf{70}_x$ to allow the outer and inner parts $\mathbf{532}_1$, $\mathbf{532}_2$ of the interconnecting member $\mathbf{70}_x$ to shear relative to one another when the helmet 10 is impacted. Thus, in this case, the outer and inner parts $\mathbf{532}_1$, $\mathbf{532}_2$ of the interconnecting members $\mathbf{70}_1$-$\mathbf{70}_M$ respectively constitute the outer and inner parts $\mathbf{522}_1$, $\mathbf{522}_2$ of the interconnector 68.

The shearing layer 514 may be implemented in any suitable way in various embodiments.

Figure 81:
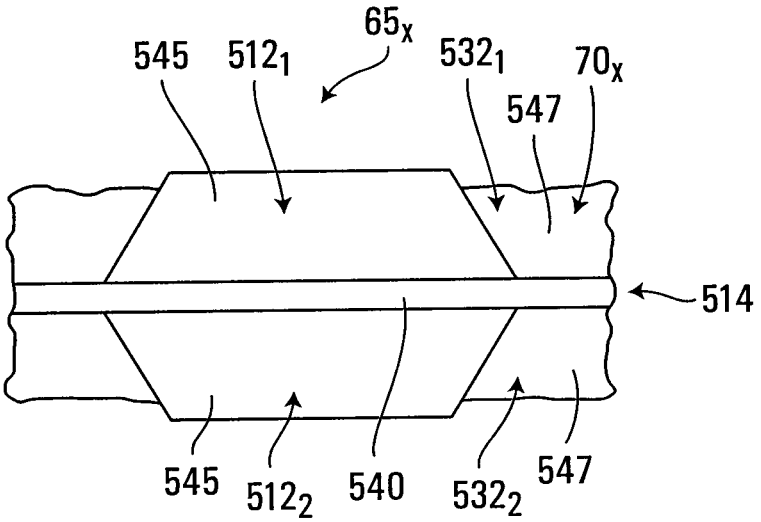

In some embodiments, as shown in FIG. 81, the shearing layer 514 may comprise a deformable material 540 disposed between the outer and inner parts $\mathbf{512}_1$, $\mathbf{512}_2$ of a shock absorber $\mathbf{65}_x$ and/or between the outer and inner parts $\mathbf{532}_1$, $\mathbf{532}_2$ of an interconnecting member $\mathbf{70}_x$. The deformable material 540 interconnects the outer and inner parts $\mathbf{512}_1$, $\mathbf{512}_2$ of the shock absorber $\mathbf{65}_x$ and allows them to shear relative to one another, and/or interconnects the outer and inner parts $\mathbf{532}_1$, $\mathbf{532}_2$ of the interconnecting member $\mathbf{70}_x$ and allows them to shear relative to one another. In that sense, the deformable material 540 may also sometimes be referred to as a "flexible", "elastic", "compliant" or "resilient" material.

The deformable material 540 of the shearing layer 514 may be less rigid than a material 545 of the outer and inner parts $\mathbf{512}_1$, $\mathbf{512}_2$ of the shock absorber $\mathbf{65}_x$ and/or less rigid than a material 547 of the outer and inner parts $\mathbf{532}_1$, $\mathbf{532}_2$ of the interconnecting member $\mathbf{70}_x$.

For example, in some embodiments, an elastic modulus of the deformable material 540 of the shearing layer 514 may be lower than an elastic modulus of the material 545 of the outer and inner parts $\mathbf{512}_1$, $\mathbf{512}_2$ of the shock absorber $\mathbf{65}_x$ and/or lower than an elastic modulus of the material 547 of the outer and inner parts $\mathbf{532}_1$, $\mathbf{532}_2$ of the interconnecting member $\mathbf{70}_x$. In some examples, a ratio of the elastic modulus of the deformable material 540 of the shearing layer 514 over the elastic modulus of the material 545 of the outer and inner parts $\mathbf{512}_1$, $\mathbf{512}_2$ of the shock absorber $\mathbf{65}_x$ and/or a ratio of the elastic modulus of the deformable material 540 of the shearing layer 514 over the elastic modulus of the material 547 of the outer and inner parts $\mathbf{532}_1$, $\mathbf{532}_2$ of the interconnecting member $\mathbf{70}_x$ may be no more than 0.9, in some cases no more than 0.7, in some cases no more than 0.5, in some cases no more than 0.3, and in some cases even less (e.g., no more than 0.1). For instance, in some embodiments, the elastic modulus of the deformable material 540 of the shearing layer may be no more than 75 MPa, in some cases no more than 65 MPa, in some cases no more than 55 MPa, in some cases less than 45 MPa, and in some cases even less. The elastic modulus of the deformable material 540 of the shearing layer 540 may have any other suitable value in other embodiments.

As another example, in some embodiments, a resilience of the deformable material 540 of the shearing layer 514 may be lower than a resilience of the material 545 of the outer and inner parts $\mathbf{512}_1$, $\mathbf{512}_2$ of the shock absorber $\mathbf{65}_x$ and/or lower than a resilience of the material 547 of the outer and inner parts $\mathbf{532}_1$, $\mathbf{532}_2$ of the interconnecting member $\mathbf{70}_x$. In some examples, a ratio of the resilience of the deformable material 540 of the shearing layer 514 over the resilience of the material 545 of the outer and inner parts $\mathbf{512}_1$, $\mathbf{512}_2$ of the shock absorber $\mathbf{65}_x$ and/or a ratio of the resilience of the deformable material 540 of the shearing layer 514 over the resilience of the material 547 of the outer and inner parts $\mathbf{532}_1$, $\mathbf{532}_2$ of the interconnecting member $\mathbf{70}_x$ may be no more than 0.9, in some cases no more than 0.7, in some cases no more than 0.5, in some cases no more than 0.3, and in some cases even less (e.g., no more than 0.1). In other embodiments, this may be reversed, with the resilience of the deformable material 540 of the shearing layer 514 being greater than the resilience of the material 545 of the outer and inner parts $\mathbf{512}_1$, $\mathbf{512}_2$ of the shock absorber $\mathbf{65}_x$ and/or greater than the resilience of the material 547 of the outer and inner parts $\mathbf{532}_1$, $\mathbf{532}_2$ of the interconnecting member $\mathbf{70}_x$. For instance, in some embodiments, the resilience of the deformable material 540 may be at least 10%, in some cases at least 20%, in some cases at least 30%, and in some cases at least 40% according to DIN 53512 of the German institute for standardization and/or may be no more than 40%, in some cases no more than 30%, in some cases no more than 20%, and in some cases no more than 10% according to DIN 53512. The resilience of the deformable material 540 may have any other suitable value in other embodiments.

As another example, in some embodiments, a compression deflection (i.e., 25% compression deflection) of the deformable material 540 of the shearing layer 514 may be lower than a compression deflection of the material 545 of the outer and inner parts $\mathbf{512}_1$, $\mathbf{512}_2$ of the shock absorber $\mathbf{65}_x$ and/or lower than a compression deflection of the material 547 of the outer and inner parts $\mathbf{532}_1$, $\mathbf{532}_2$ of the interconnecting member $\mathbf{70}_x$. In some examples, a ratio of the compression deflection of the deformable material 540 of the shearing layer 514 over the compression deflection of the material 545 of the outer and inner parts $\mathbf{512}_1$, $\mathbf{512}_2$ of the shock absorber $\mathbf{65}_x$ and/or a ratio of the compression deflection of the deformable material 540 of the shearing layer 514 over the compression deflection of the material 547 of the outer and inner parts $\mathbf{532}_1$, $\mathbf{532}_2$ of the interconnecting member $\mathbf{70}_x$ may be no more than 0.9, in some cases no more than 0.7, in some cases no more than 0.5, in some cases no more than 0.3, and in some cases even less (e.g., no more than 0.1). In other embodiments, this may be reversed, with the compression deflection of the deformable material 540 of the shearing layer 514 being lower than the compression deflection of the material 545 of the outer and inner parts $\mathbf{512}_1$, $\mathbf{512}_2$ of the shock absorber $\mathbf{65}_x$ and/or lower than the compression deflection of the material 547 of the outer and inner parts $\mathbf{532}_1$, $\mathbf{532}_2$ of the interconnecting member $\mathbf{70}_x$. For instance, in some embodiments, the compression deflection (i.e., 25% compression deflection) of the deformable material 540 may be at least 5 psi, in some cases at least 10 psi, in some cases at least 20 psi, and in some cases at least 30 psi according to ASTM D-1056 and/or may be no more than 30 psi, in some cases no more than 20 psi, in some cases no more than 10 psi, and in some cases no more than 5 psi according to ASTM D-1056. The compression deflection of the deformable material 540 may have any other suitable value in other embodiments.

The deformable material 540 of the shearing layer 514 may be implemented in any suitable way. For instance, in some embodiments, the deformable material 540 may comprise an elastomeric material (e.g., a rubber such as styrene-butadiene rubber or any other suitable rubber; a polyurethane elastomer such as thermoplastic polyurethane (TPU); any other thermoplastic elastomer; etc.). In other embodiments, the deformable material 540 may comprise polymeric cellular material. For example, the polymeric cellular material may comprise polymeric foam such as expanded polypropylene (EPP) foam, expanded polyethylene (EPE) foam, vinyl nitrile (VN) foam, polyurethane foam (e.g., PORON XRD foam commercialized by Rogers Corporation), or any other suitable polymeric foam material and/or may comprise expanded polymeric microspheres (e.g., Expancel™ microspheres commercialized by Akzo Nobel). In yet other embodiments, the deformable material 540 may comprise a fluid (e.g., a liquid or a gas), which may be contained within a container (e.g., a flexible bag, pouch or other envelope) or implemented as a gel (e.g., a polyurethane gel). In yet other embodiments, the deformable material 540 may comprise a flexible plastic (e.g., low-density polyethylene).

The deformable material 540 of the shearing layer 514 can be affixed to the outer and inner parts $\mathbf{512}_1$, $\mathbf{512}_2$ of the shock absorber $\mathbf{65}_x$ and/or to the outer and inner parts $\mathbf{532}_1$, $\mathbf{532}_2$ of the interconnecting member $\mathbf{70}_x$ in any suitable way. For example, in some embodiments, the deformable material 540 may be affixed to the outer and inner parts $\mathbf{512}_1$, $\mathbf{512}_2$ of the shock absorber $\mathbf{65}_x$ and/or to the outer and inner parts $\mathbf{532}_1$, $\mathbf{532}_2$ of the interconnecting member $\mathbf{70}_x$ by adhesive bonding. For instance, in some cases, the deformable material 540 may constitute an adhesive that is bonded to the outer and inner parts $\mathbf{512}_1$, $\mathbf{512}_2$ of the shock absorber $\mathbf{65}_x$ and/or to the outer and inner parts $\mathbf{532}_1$, $\mathbf{532}_2$ of the interconnecting member $\mathbf{70}_x$ and that can deform to allow the outer and inner parts $\mathbf{512}_1$, $\mathbf{512}_2$ of the shock absorber $\mathbf{65}_x$ to shear relative to one another and/or to allow the outer and inner parts $\mathbf{532}_1$, $\mathbf{532}_2$ of the interconnecting member $\mathbf{70}_x$ to shear relative to one another. For example, in some embodiments, the deformable material 514 may be a hot-melt adhesive (e.g., a polyurethane adhesive, an ethylene-vinyl acetate (EVA) adhesive, etc.) or any other suitable adhesive. In other cases, the deformable material 540 may be bonded to the outer and inner parts $\mathbf{512}_1$, $\mathbf{512}_2$ of the shock absorber $\mathbf{65}_x$ and/or to the outer and inner parts $\mathbf{532}_1$, $\mathbf{532}_2$ of the interconnecting member $\mathbf{70}_x$ by an adhesive , such as a hot-melt adhesive (e.g., a polyurethane adhesive, an ethylene-vinyl acetate (EVA) adhesive, etc.) or any other suitable adhesive, disposed between the deformable material 540 and the outer and inner parts $\mathbf{512}_1$, $\mathbf{512}_2$ of the shock absorber $\mathbf{65}_x$ and/or between the deformable material 540 and the outer and inner parts $\mathbf{532}_1$, $\mathbf{532}_2$ of the interconnecting member $\mathbf{70}_x$. In some embodiments, the deformable material 540 may be affixed to the outer and inner parts $\mathbf{512}_1$, $\mathbf{512}_2$ of the shock absorber $\mathbf{65}_x$ and/or to the outer and inner parts $\mathbf{532}_1$, $\mathbf{532}_2$ of the interconnecting member $\mathbf{70}_x$ in any other suitable manner (e.g., by chemical bonding or by one or more mechanical fasteners).

Figure 82:
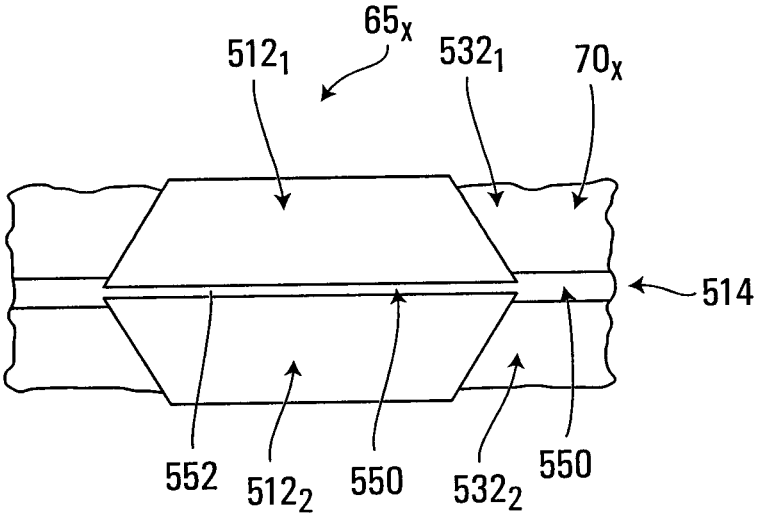
Figure 83:
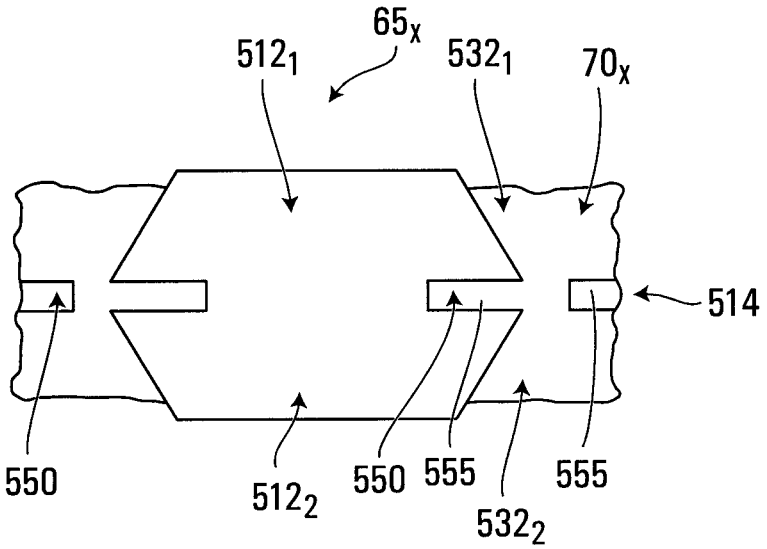

Instead of or in addition to comprising the deformable material 540, in some embodiments, as shown in FIGS. 82 and 83, the shearing layer 514 may comprise a void 550 between the outer and inner parts $\mathbf{512}_1$, $\mathbf{512}_2$ of a shock absorber $\mathbf{65}_x$ and/or between the outer and inner parts $\mathbf{532}_1$, $\mathbf{532}_2$ of an interconnecting member $\mathbf{70}_x$. The void 550, by virtue of its absence of material, facilitates shearing of the outer and inner parts $\mathbf{512}_1$, $\mathbf{512}_2$ of the shock absorber $\mathbf{65}_x$ relative to one another and/or shearing of the outer and inner parts $\mathbf{532}_1$, $\mathbf{532}_2$ of the interconnecting member $\mathbf{70}_x$ relative to one another.

In some embodiments, as shown in FIG. 82, the void 550 of the shearing layer 514 may comprise a gap 552 separating the outer and inner parts $\mathbf{512}_1$, $\mathbf{512}_2$ of the shock absorber $\mathbf{65}_x$ from one another and/or separating the outer and inner parts $\mathbf{532}_1$, $\mathbf{532}_2$ of the interconnecting member $\mathbf{70}_x$ from one another. The outer and inner parts $\mathbf{512}_1$, $\mathbf{512}_2$ of the shock absorber $\mathbf{65}_x$ remain linked to and aligned with one another by being connected to a remainder of the helmet 10 (e.g., to the interconnector 68 interconnecting the shock absorbers $\mathbf{65}_1$-$\mathbf{65}_N$, the outer shell 12, etc.). Similarly, the outer and inner parts $\mathbf{532}_1$, $\mathbf{532}_2$ of the interconnecting member $\mathbf{70}_x$ remain linked to and aligned with one another by being connected to the remainder of the helmet 10 (e.g., to the arrangement of shock absorbers $\mathbf{65}_1$-$\mathbf{65}_N$, the outer shell 12, etc.).

In other embodiments, as shown in FIG. 83, the void 550 of the shearing layer 514 may comprise one or more openings 555 between the outer and inner parts $\mathbf{512}_1$, $\mathbf{512}_2$ of the shock absorber $\mathbf{65}_x$ and/or between the outer and inner parts $\mathbf{532}_1$, $\mathbf{532}_2$ of the interconnecting member $\mathbf{70}_x$.

Figure 84:
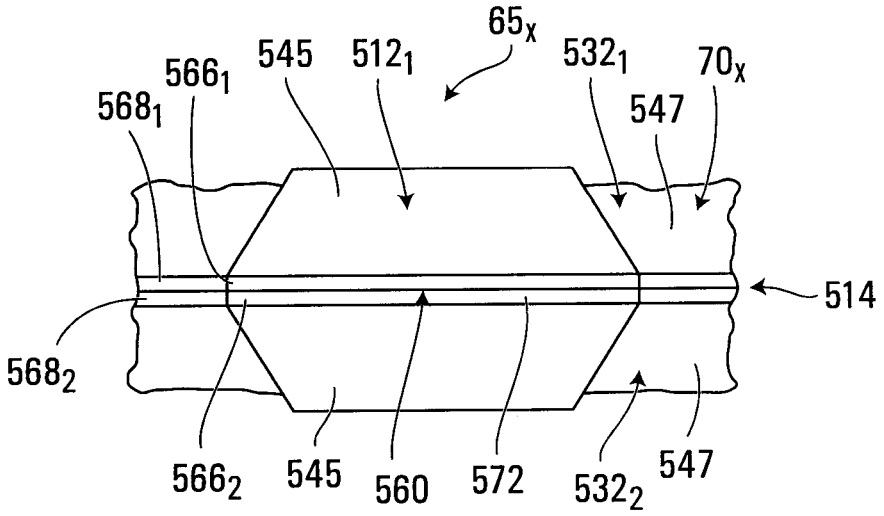

As another alternative, instead of or in addition to comprising the deformable material 540 and/or the void 550, in some embodiments, as shown in FIG. 84, the shearing layer 514 may comprise a low-friction interface 560 between the outer and inner parts $\mathbf{512}_1$, $\mathbf{512}_2$ of a shock absorber $\mathbf{65}_x$ and/or between the outer and inner parts $\mathbf{532}_1$, $\mathbf{532}_2$ of an interconnecting member $\mathbf{70}_x$.

The low-friction interface 560 of the shearing layer 514 is such that a coefficient of friction $\mu_{is}$ between the outer and inner parts $\mathbf{512}_1$, $\mathbf{512}_2$ of the shock absorber $\mathbf{65}_x$ is lower than a coefficient of friction $\mu_{ms}$ between the material 545 of the outer part $\mathbf{512}_1$ of the shock absorber $\mathbf{65}_x$ and the material 545 of the inner part $\mathbf{512}_2$ of the shock absorber $\mathbf{65}_x$, and/or a coefficient of friction $\mu_{ic}$ between the outer and inner parts $\mathbf{532}_1$, $\mathbf{532}_2$ of the interconnecting member $\mathbf{70}_x$ is lower than a coefficient of friction $\mu_{mc}$ between the material 547 of the outer part $\mathbf{532}_1$ of the interconnecting member $\mathbf{70}_x$ and the material 547 of the inner part $\mathbf{532}_2$ of the interconnecting member $\mathbf{70}_x$. For example, in some embodiments, a ratio $\mu_{is}/\mu_{ms}$ of the coefficient of friction $\mu_{is}$ of the low-friction interface 560 over the coefficient of friction $\mu_{ms}$ between the material 545 of the outer part $\mathbf{512}_1$ of the shock absorber $\mathbf{65}_x$ and the material 545 of the inner part $\mathbf{512}_2$ of the shock absorber $\mathbf{65}_x$ may be no more than 0.9, in some cases no more than 0.7, in some cases no more than 0.5, in some cases no more than 0.3, in some cases no more than 0.2, in some cases no more than 0.1, and in some cases even less, and/or a ratio $\mu_{ic}/\mu_{mc}$ of the coefficient of friction $\mu_{ic}$ of the low-friction interface 560 over the coefficient of friction $\mu_{mc}$ between the material 547 of the outer part $\mathbf{532}_1$ of the interconnecting member $\mathbf{70}_x$ and the material 547 of the inner part $\mathbf{532}_2$ of the interconnecting member $\mathbf{70}_x$ may be no more than 0.9, in some cases no more than 0.7, in some cases no more than 0.5, in some cases no more than 0.3, in some cases no more than 0.2, in some cases no more than 0.1, and in some cases even less For instance, in this embodiment, the low-friction interface 560 of the shearing layer 514 may comprise a low-friction element $\mathbf{566}_1$ affixed to the outer part $\mathbf{512}_1$ of the shock absorber $\mathbf{65}_x$ and a low-friction element $\mathbf{566}_2$ affixed to the inner part $512_2$ of the shock absorber $65_x$ such that the low-friction elements $566_1$, $566_2$ are slidable against one another when the outer and inner part $512_1$, $512_2$ of the shock absorber $65_x$ shear relative to one another, and/or a low-friction element $568_1$ affixed to the outer part $532_1$ of the interconnecting member $70_x$ and a low-friction element $568_2$ affixed to the inner part $532_2$ of the interconnecting member $70_x$ such that the low-friction elements $568_1$, $568_2$ are slidable against one another when the outer and inner part $532_1$, $532_2$ of the interconnecting member $70_x$ shear relative to one another.

The low-friction elements $566_1$, $566_2$, $568_1$, $568_2$ of the low-friction interface 560 of the shearing layer 514 can be affixed to the material 545 of the outer and inner parts $512_1$, $512_2$ of the shock absorber $65_x$ and/or to the material 547 of the outer and inner parts $532_1$, $532_2$ of the interconnecting member $70_x$ in any suitable way. For example, in some embodiments, the low-friction elements $566_1$, $566_2$, $568_1$, $568_2$ may be affixed to the material 545 of the outer and inner parts $512_1$, $512_2$ of the shock absorber $65_x$ and/or to the material 547 of the outer and inner parts $532_1$, $532_2$ of the interconnecting member $70_x$ by adhesive bonding. In some embodiments, the low-friction elements low-friction elements $566_1$, $566_2$, $568_1$, $568_2$ may be affixed to the material 545 of the outer and inner parts $512_1$, $512_2$ of the shock absorber $65_x$ and/or to the material 547 of the outer and inner parts $532_1$, $532_2$ of the interconnecting member $70_x$ in any other suitable manner (e.g., by chemical bonding or by one or more mechanical fasteners).

Each of the low-friction elements $566_1$, $566_2$, $568_1$, $568_2$ of the low-friction interface 560 of the shearing layer 514 comprises a low-friction material 572. For example, in some embodiments, a coefficient of friction of the low-friction material 572 according to ASTM G115-10 (Standard Guide for Measuring and Reporting Friction Coefficients) may be no more than 0.5, in some cases no more than 0.4, in some cases no more than 0.3, in some cases no more than 0.2, in some cases no more than 0.15, in some cases no more than 0.1. The coefficient of friction $\mu_r$ of the low-friction material 572 may have any other suitable value in other embodiments.

The low-friction material 572 of each of the low-friction elements $566_1$, $566_2$, $568_1$, $568_2$ of the low-friction interface 560 of the shearing layer 514 may be implemented in any suitable way. For example, in some embodiments, the low-friction material 572 may include a fluorocarbon (e.g., polytetrafluoroethylene (PTFE), such as Teflon), polyethylene, nylon, a dry lubricant (e.g., graphite, molybdenum disulfide, etc.), or any other suitable substance with a low coefficient of friction.

With the low-friction interface 560 of the shearing layer 514, the outer and inner parts $512_1$, $512_2$ of the shock absorber $65_x$ remain linked to and aligned with one another by being connected to the remainder of the helmet 10 (e.g., to the interconnector 68 interconnecting the shock absorbers $65_1$-$65_N$, the outer shell 12, etc.), and/or the outer and inner parts $532_1$, $532_2$ of the interconnecting member $70_x$ remain linked to and aligned with one another by being connected to the remainder of the helmet 10 (e.g., to the arrangement of shock absorbers $65_1$-$65_N$, the outer shell 12, etc.).

As another possibility, in some embodiments, instead of having a low-friction interface such as the low-friction interface 560, the shearing layer 514 may comprise a high-friction interface such that the coefficient of friction $\mu_{is}$ between the outer and inner parts $512_1$, $512_2$ of the shock absorber $65_x$ is greater than the coefficient of friction $\mu_{ms}$ between the material 545 of the outer part $512_1$ of the shock absorber $65_x$ and the material 545 of the inner part $512_2$ of the shock absorber $65_x$, and/or the coefficient of friction $\mu_{ic}$ between the outer and inner parts $532_1$, $532_2$ of the interconnecting member $70_x$ is greater than the coefficient of friction $\mu_{mc}$ between the material 547 of the outer part $532_1$ of the interconnecting member $70_x$ and the material 547 of the inner part $532_2$ of the interconnecting member $70_x$. In some cases, this increased friction may help to dissipate energy as the outer and inner parts $512_1$, $512_2$ of the shock absorber $65_x$ shear relative to one another and/or the outer and inner parts $532_1$, $532_2$ of the interconnecting member $70_x$ shear relative to one another.

A thickness T of the shearing layer 514 may have any suitable value. For example, in some embodiments, the thickness T of the shearing layer 514 may be no more than 10 mm, in some cases no more than 5 mm, in some cases no more than 2 mm, in some cases no more than 1 mm, in some cases no more than 0.5 mm, and in some cases even less (e.g., no more than 0.2 mm). The thickness T of the shearing layer 514 may have any other suitable value in other embodiments.

The shearing layer 514 may be implemented in any other suitable way in other embodiments.

In addition to the shearing layer 514 to facilitate shearing of the outer and inner parts $512_1$, $512_2$ of the shock absorbers $65_1$-$65_N$ and/or the outer and inner parts $522_1$, $522_2$ of the interconnector 68, in this embodiment, the material 545 of the outer part $512_1$ of a shock absorber $65_x$ may be different from (e.g., stiffer or less stiff than; denser or less dense than; etc.) the material 545 of the inner part $512_2$ of the shock absorber $65_x$ and/or the material 547 of the outer part $532_1$ of an interconnecting member $70_x$ may be different from (e.g., stiffer or less stiff than; denser or less dense than; etc.) the material 547 of the inner part $532_2$ of the interconnecting member $70_x$. This may help to manage both high- and low-energy impacts on the helmet 10.

For example, in some embodiments, the material 545 of the outer part $512_1$ of the shock absorber $65_x$ may be less stiff (i.e., more flexible) than the material 545 of the inner part $512_2$ of the shock absorber $65_x$ and/or the material 547 of the outer part $532_1$ of the interconnecting member $70_x$ may less stiff than the material 547 of the inner part $532_2$ of the interconnecting member $70_x$ such that the outer part $512_1$ of the shock absorber $65_x$ and/or the outer part $532_1$ of the interconnecting member $70_x$ deforms more than the inner part $512_2$ of the shock absorber $65_x$ and/or the outer part $532_2$ of the interconnecting member $70_x$. For instance, in some embodiments, a ratio of the elastic modulus of the material 545 of the outer part $512_1$ of the shock absorber $65_x$ over the elastic modulus of the material 545 of the inner part $512_2$ of the shock absorber $65_x$ may be no more than 0.9, in some cases no more than 0.8, in some cases no more than 0.7, in some cases no more than 0.6, in some cases no more than 0.5, and in some cases even less (e.g., no more than 0.3), and/or a ratio of the elastic modulus of the material 547 of the outer part $532_1$ of the interconnecting member $70_x$ over the elastic modulus of the material 547 of the inner part $532_2$ of the interconnecting member $70_x$ may be no more than 0.9, in some cases no more than 0.8, in some cases no more than 0.7, in some cases no more than 0.6, in some cases no more than 0.5, and in some cases even less (e.g., no more than 0.3). In other cases, this may be reversed, with the material 545 of the outer part $512_1$ of the shock absorber $65_x$ being stiffer than the material 545 of the inner part $512_2$ of the shock absorber $65_x$ and/or the material 547 of the outer part $532_1$ of the interconnecting member $70_x$ being stiffer than the material 547 of the inner part $532_2$ of the interconnecting member $70_x$.

As another example, in some embodiments, the material 545 of the outer part $512_1$ of the shock absorber $65_x$ may be less dense than the material 545 of the inner part $512_2$ of the shock absorber $65_x$ and/or the material 547 of the outer part $532_1$ of the interconnecting member $70_x$ may less dense than the material 547 of the inner part $532_2$ of the interconnecting member $70_x$. For instance, in some embodiments, a ratio of a density of the material 545 of the outer part $512_1$ of the shock absorber $65_x$ over a density of the material 545 of the inner part $512_2$ of the shock absorber $65_x$ may be no more than 0.9, in some cases no more than 0.8, in some cases no more than 0.7, in some cases no more than 0.6, in some cases no more than 0.5, and in some cases even less (e.g., no more than 0.3), and/or a ratio of a density of the material 547 of the outer part $532_1$ of the interconnecting member $70_x$ over a density of the material 547 of the inner part $532_2$ of the interconnecting member $70_x$ may be no more than 0.9, in some cases no more than 0.8, in some cases no more than 0.7, in some cases no more than 0.6, in some cases no more than 0.5, and in some cases even less (e.g., no more than 0.3). In other cases, this may be reversed, with the material 545 of the outer part $512_1$ of the shock absorber $65_x$ being denser than the material 545 of the inner part $512_2$ of the shock absorber $65_x$ and/or the material 547 of the outer part $532_1$ of the interconnecting member $70_x$ being denser than the material 547 of the inner part $532_2$ of the interconnecting member $70_x$.

As another example, in some embodiments, the material 545 of the outer part $512_1$ of the shock absorber $65_x$ may be less resilient than the material 545 of the inner part $512_2$ of the shock absorber $65_x$ and/or the material 547 of the outer part $532_1$ of the interconnecting member $70_x$ may less resilient than the material 547 of the inner part $532_2$ of the interconnecting member $70_x$. For instance, in some embodiments, a ratio of the resilience of the material 545 of the outer part $512_1$ of the shock absorber $65_x$ over the resilience of the material 545 of the inner part $512_2$ of the shock absorber $65_x$ may be no more than 0.9, in some cases no more than 0.8, in some cases no more than 0.7, in some cases no more than 0.6, in some cases no more than 0.5, and in some cases even less (e.g., no more than 0.3), and/or a ratio of the resilience of the material 547 of the outer part $532_1$ of the interconnecting member $70_x$ over the resilience of the material 547 of the inner part $532_2$ of the interconnecting member $70_x$ may be no more than 0.9, in some cases no more than 0.8, in some cases no more than 0.7, in some cases no more than 0.6, in some cases no more than 0.5, and in some cases even less (e.g., no more than 0.3), according to DIN 53512 of the German institute for standardization. In other cases, this may be reversed, with the material 545 of the outer part $512_1$ of the shock absorber $65_x$ being more resilient than the material 545 of the inner part $512_2$ of the shock absorber $65_x$ and/or the material 547 of the outer part $532_1$ of the interconnecting member $70_x$ being more resilient than the material 547 of the inner part $532_2$ of the interconnecting member $70_x$.

As another example, in some embodiments, a compression deflection (i.e., 25% compression deflection) of the material 545 of the outer part $512_1$ of the shock absorber $65_x$ may be less than a compression deflection of the material 545 of the inner part $512_2$ of the shock absorber $65_x$ and/or a compression deflection of the material 547 of the outer part $532_1$ of the interconnecting member $70_x$ may less than a compression deflection of the material 547 of the inner part $532_2$ of the interconnecting member $70_x$. For instance, in some embodiments, a ratio of the compression deflection of the material 545 of the outer part $512_1$ of the shock absorber $65_x$ over the compression deflection of the material 545 of the inner part $512_2$ of the shock absorber $65_x$ may be no more than 0.9, in some cases no more than 0.8, in some cases no more than 0.7, in some cases no more than 0.6, in some cases no more than 0.5, and in some cases even less (e.g., no more than 0.3), and/or a ratio of the compression deflection of the material 547 of the outer part $532_1$ of the interconnecting member $70_x$ over the compression deflection of the material 547 of the inner part $532_2$ of the interconnecting member $70_x$ may be no more than 0.9, in some cases no more than 0.8, in some cases no more than 0.7, in some cases no more than 0.6, in some cases no more than 0.5, and in some cases even less (e.g., no more than 0.3), according to ASTM D-1056. In other cases, this may be reversed, with the compression deflection of the material 545 of the outer part $512_1$ of the shock absorber $65_x$ being greater than that of the material 545 of the inner part $512_2$ of the shock absorber $65_x$ and/or the compression deflection of the material 547 of the outer part $532_1$ of the interconnecting member $70_x$ being greater than that of the material 547 of the inner part $532_2$ of the interconnecting member $70_x$.

The outer and inner parts $512_1$, $512_2$ of the shock absorbers $65_1$-$65_N$ and the outer and inner parts $522_1$, $522_2$ of the interconnector 68 may be shaped in any suitable way.

For example, in this embodiment, a shock absorber $65_x$ includes a wall 586 defining an opening 588 such that it is tubular. Also, in this embodiment, a cross-sectional shape of the shock absorber $65_x$ varies in the height direction of the shock absorber $65_x$. For instance, in this example, the outer part $512_1$ of the shock absorber $65_x$ tapers outwardly (i.e., towards the outer shell 12) while the inner part $512_2$ of the shock absorber $65_x$ tapers inwardly (i.e., towards the wearer's head 11). The opening 588 tapers inwardly in the outer part $512_1$ of the shock absorber $65_x$ and tapers outwardly in the inner part $512_2$ of the shock absorber $65_x$. In this case, the cross-sectional shape of each of the outer and inner parts $512_1$, $512_2$ of the shock absorber $65_x$ is generally circular such that each of the outer and inner parts $512_1$, $512_2$ of the shock absorber $65_x$ is generally frustoconical. The outer and inner parts $512_1$, $512_2$ of the shock absorber $65_x$ may have any other suitable shape in other embodiments (e.g., a cross-section that is pentagonal, hexagonal, heptagonal, octagonal, square, rectangular, or otherwise polygonal and/or that is constant and not tapering in the its height direction).

The outer and inner parts $512_1$, $512_2$ of the shock absorbers $65_1$-$65_N$ and the outer and inner parts $522_1$, $522_2$ of the interconnector 68 may be manufactured in any suitable way.

For example, in some embodiments, the outer parts $512_1$ of the shock absorbers $65_1$-$65_N$ and the outer parts $522_1$ of the interconnector 68 may be molded together as a unit constituting an outer substructure $580_1$ of the shock-absorbing structure 32 and the inner parts $512_2$ of the shock absorbers $65_1$-$65_N$ and the inner parts $522_2$ of the interconnector 68 may be molded together as a unit constituting an inner substructure $580_2$ of the shock-absorbing structure 32. Each of the outer and inner substructures $580_1$, $580_2$ of the shock-absorbing structure 32 may be molded using any suitable molding process. For instance, in some embodiments, each of the outer and inner substructures $580_1$, $580_2$ of the shock-absorbing structure 32 may be molded using an injection molding process, a foam-expansion molding process, a compression molding process, etc.

Upon being molded, the outer and inner substructures 580$_1$, 580$_2$ of the shock-absorbing structure 32 may be secured together such as to create the shearing layer 514 between them.

As an example, in some embodiments, the deformable material 540 of the shearing layer 514 may be affixed to the outer and inner substructures 580$_1$, 580$_2$ of the shock-absorbing structure 32 in between them in order to secure them to one another. As another example, in some embodiments, the outer and inner substructures 580$_1$, 580$_2$ of the shock-absorbing structure 32 may be linked to and aligned with one another by being connected to the remainder of the helmet 10 (e.g., the outer shell 12, another component of the inner padding 15, etc.).

Figure 35:
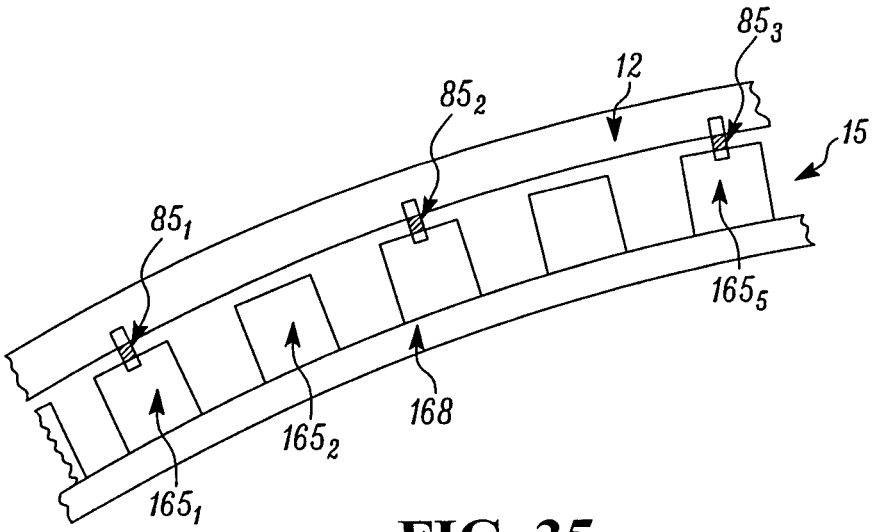
FIGS. 35 to 37 show an example of an arrangement of shock absorbers connected by connectors which are deformable.
Figure 36:
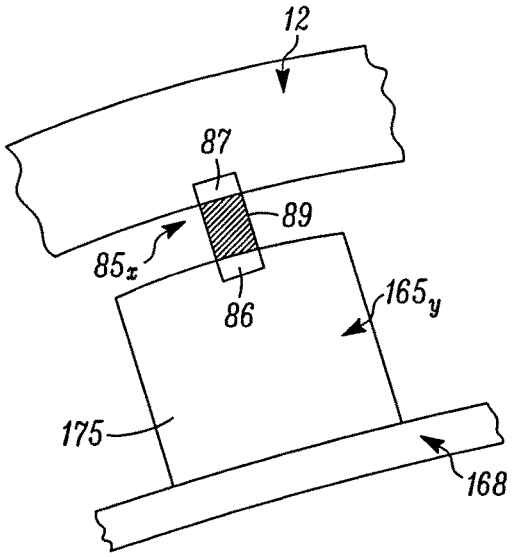

1.2 Arrangement of Shock Absorbers Connected to at Least One Other Helmet Component by Connectors which Are Deformable in Response to a Rotational Impact In some embodiments, as shown in FIGS. 35 and 36, the inner padding 15 may comprise an arrangement (e.g., an array) of shock absorbers 165$_1$-165$_N$ that is connected to one or more other helmet components (e.g., the outer shell 12 and/or another layer of the inner padding 15) by a plurality of connectors 85$_1$-85$_C$ which are deformable in response to a rotational impact on the helmet 10 such that the arrangement of shock absorbers 165$_1$-165$_N$ moves relative to the outer shell 12 in a direction tangential to an angular movement of the outer shell 12 due to the rotational impact. This elastic deformation of the connectors 85$_1$-85$_C$ absorbs energy from the rotational impact and may thus reduce its effect on the wearer's head 11.

The shock absorbers 165$_1$-165$_N$ may be configured like the shock absorbers 65$_1$-65$_N$ discussed above in section 1.1. Also, the inner padding 15 may comprise an interconnector 168 interconnecting the shock absorbers 165$_1$-165$_N$. The interconnector 168 may be configured like the interconnector 68 discussed above in section 1.1.

In this embodiment, the connectors 85$_1$-85$_C$ connect the arrangement of shock absorbers 165$_1$-165$_N$ to the outer shell 12. More particularly, in this embodiment, each connector 85$_x$ comprises a fastener 86 fastening it to the arrangement of shock absorbers 165$_1$-165$_N$ and a fastener 87 fastening it to the outer shell 12. Specifically, in this embodiment, the fastener 86 fastens the connector 85$_x$ to a shock absorber 165$_y$ and the fastener 87 fastens the connector 85$_x$ to the outer shell 12. By way of example, the fastener 86 may be an adhesive fastener, a mechanical fastener (e.g., screw or other threaded fastener, rivet, etc.) or any other suitable fastener.

Figure 37:
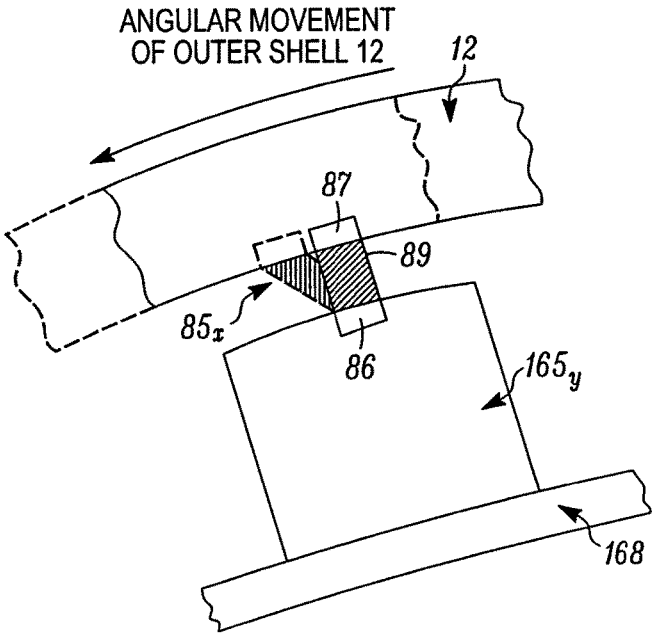

The connector 85$_x$ is deformable when the outer shell 12 angularly moves due to a rotational impact to allow the arrangment of shock absorbers 165$_1$-165$_N$ to move relative to the outer shell 12 in a direction tangential to the outer shell's angular movement. For example, FIG. 37 illustrates in dotted lines the connector 85$_x$ deformed when the outer shell 12 angularly moves due to a rotational impact. For instance, in various embodiments, the connector 85$_x$ may be stretchable, bendable, and/or shearable.

The connector 85$_x$ comprise a deformable material 89. The deformable material 89 may also sometimes be referred to as a "flexible", "elastic", "compliant" or "resilient" material.

The deformable material 89 may have an elastic modulus (i.e., modulus of elasticity) within a certain range to provide suitable elastic deformation. For example, in some embodiments, the elastic modulus of the deformable material 89 of the connector 85$_x$ may be different from (e.g., greater or lower than) an elastic modulus of a material 175 of the arrangement of shock absorbers 165$_1$-165$_N$. For instance, in some embodiments, the elastic modulus of the deformable material 89 of the connector 85$_x$ may be lower than the elastic modulus of the material 175 of the arrangement of shock absorbers 165$_1$-165$_N$. In some examples, a ratio of the elastic modulus of the deformable material 89 of the connector 85$_x$ over the elastic modulus of the material 175 of the arrangement of shock absorbers 165$_1$-165$_N$ may be no more than 0.9, in some cases no more than 0.7, in some cases no more than 0.5, in some cases no more than 0.3, and in some cases even less (e.g., no more than 0.1). For instance, in some embodiments, the elastic modulus of the deformable material 89 of the connector 85$_x$ may be no more than 75 MPa, in some cases no more than 65 MPa, in some cases no more than 55 MPa, and in some cases even less. The elastic modulus of the deformable material 89 of the connector 85$_x$ may have any other suitable value in other embodiments.

For example, in some embodiments, the deformable material 89 may comprise an elastomeric material (e.g., a rubber such as styrene-butadiene rubber or any other suitable rubber; a polyurethane elastomer such as thermoplastic polyurethane (TPU); any other thermoplastic elastomer; etc.). Alternatively, in other embodiments, the deformable material 89 may comprise polymeric cellular material. For instance, the polymeric cellular material may comprise polymeric foam such as expanded polypropylene (EPP) foam, expanded polyethylene (EPE) foam, vinyl nitrile (VN) foam, polyurethane foam (e.g., PORON XRD foam commercialized by Rogers Corporation), or any other suitable polymeric foam material and/or may comprise expanded polymeric microspheres (e.g., Expancel™ microspheres commercialized by Akzo Nobel). In yet other embodiments, the deformable material 89 may comprise a fluid (e.g., a liquid or a gas), which may be contained within a container (e.g., a flexible bag, pouch or other envelope) or implemented as a gel (e.g., a polyurethane gel). As yet another example, in other embodiments, the deformable material 89 may comprise a flexible plastic (e.g., low-density polyethylene).

The connectors 85$_1$-85$_C$ may be configured in various other ways in other embodiments.

Figure 38:
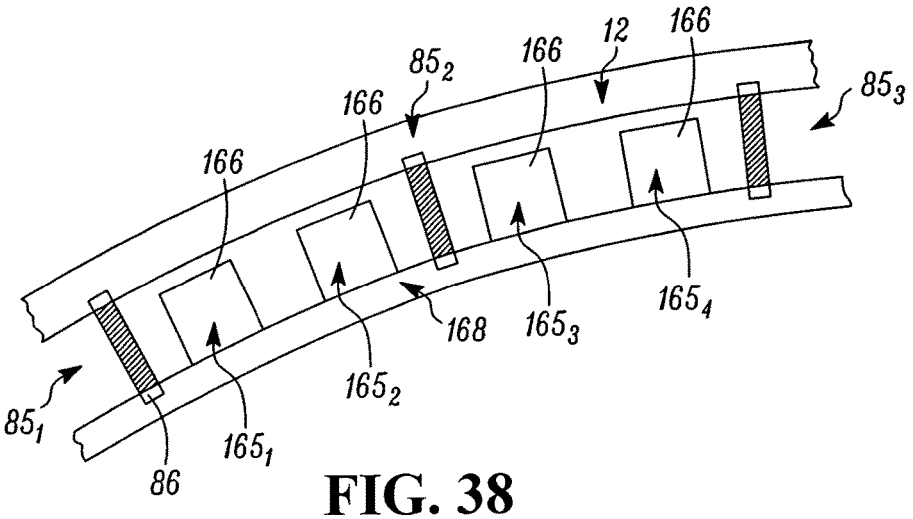
FIGS. 38 and 39 show other examples of an arrangement of shock absorbers connected by connectors which are deformable.

For example, in other embodiments, as shown in FIG. 38, a fastener 86 of a connector 85$_x$ may fasten the connector 85$_x$ to the interconnector 168 as opposed to any of the shock absorbers 165$_1$-165$_N$. In this example, the outer parts 166 of the shock absorbers 165$_1$-165$_N$, in the absence of an impact on the helmet 10, are not connected, interfaced or otherwise engaged with any component of the helmet (e.g., the outer shell 12). In other examples, the outer parts 166 of the shock absorbers 165$_1$-165$_N$ may be connected, interfaced, or otherwise engaged with another component of the helmet (e.g., such as the frictional interface 80 with the outer shell 12 discussed above in section 1.1).

Figure 39:
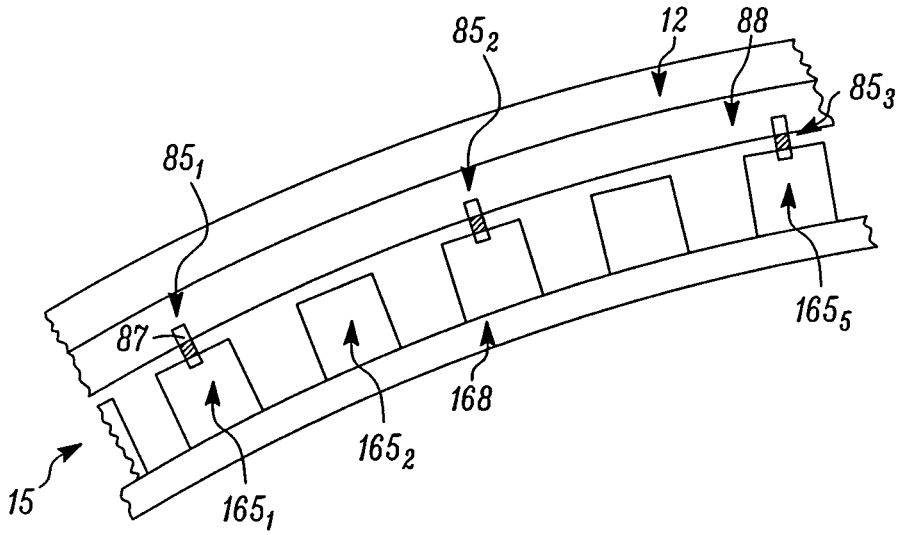

By way of another example, in other embodiments, as shown in FIG. 39, the connectors 85$_1$-85$_C$ may connect the arrangement of shock absorbers 165$_1$-165$_N$ to another layer 88 of the inner padding 15. For instance, in some embodiments, a fastener 87 of a connector 85$_x$ may be fastened to the layer 88 of the inner padding 15 to the shell 12.

As illustrated in FIGS. 35 and 39, in some embodiments, some of the shock absorbers 165$_1$-165$_N$ may not be connected with the connectors 85$_1$-85$_C$. Any suitable selection of which shock absorbers 165$_1$-165$_N$ connect with the connectors 85$_1$-85$_C$ is possible. Alternatively, in other embodiments, all of the shock absorbers $165_1$-$165_N$ may be connected with the connectors $85_1$-$85_C$. Furthermore, in other embodiments, multiple fasteners (i.e., two or more) may be connected to a single shock absorber $165_x$.

In some embodiments, both (i) the shock absorbers $165_1$-$165_N$ and (ii) the connectors $85_1$-$85_C$ may be deformable when the outer shell 12 angularly moves due to a rotational impact. In other embodiments, only the connectors $85_1$-$85_C$ may be deformable when the outer shell 12 angularly moves due to a rotational impact, with the shock absorbers $165_1$-$165_N$ substantially keeping their shape from prior to the rotational impact.

Figure 40:
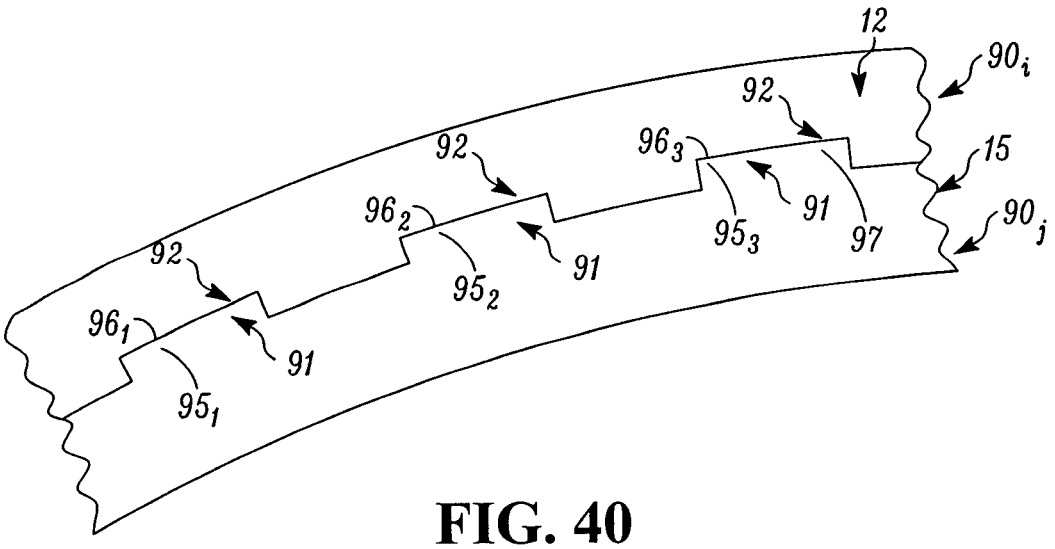
FIGS. 40 and 41 show an example of a plurality of protective layers which are meshing with one another.

1.3 Meshing Protective Layers Movable Relative to One Another and Deformable in Response to a Rotational Impact In some embodiments, as shown in FIG. 40, the rotational impact protection system 28 may comprise a plurality of protective layers $90_1$-$90_P$ which are meshing with one another, such that a first protective layer $90_i$ of the protective layers $90_1$-$90_P$ meshes with a second protective layer $90_j$ of the protective layers $90_1$-$90_P$. The protective layers $90_i$, $90_j$ are "meshing" in that they are in a meshing relationship, i.e., a given one of the protective layers $90_i$, $90_j$ extends into the other one of the protective layers $90_i$, $90_j$. To that end, a meshing part 91 of the given one of the protective layers $90_i$, $90_j$ extends into a meshing hollow space 92 of the other one of the protective layers $90_i$, $90_j$. The meshing hollow space 92 may comprise one or more recesses, holes, and/or other hollow areas. This meshing relationship increases resistance to relative movement of the protective layers $90_i$, $90_j$, which in turn increases how much energy is needed to move them. More energy is required since the meshing part 91 of the given one of the protective layers $90_i$, $90_j$ and/or the meshing hollow space 92 of the other one of the protective layers $90_i$, $90_j$ must deform sufficiently to move the meshing part 91 out of the meshing hollow space 92.

Figure 41:
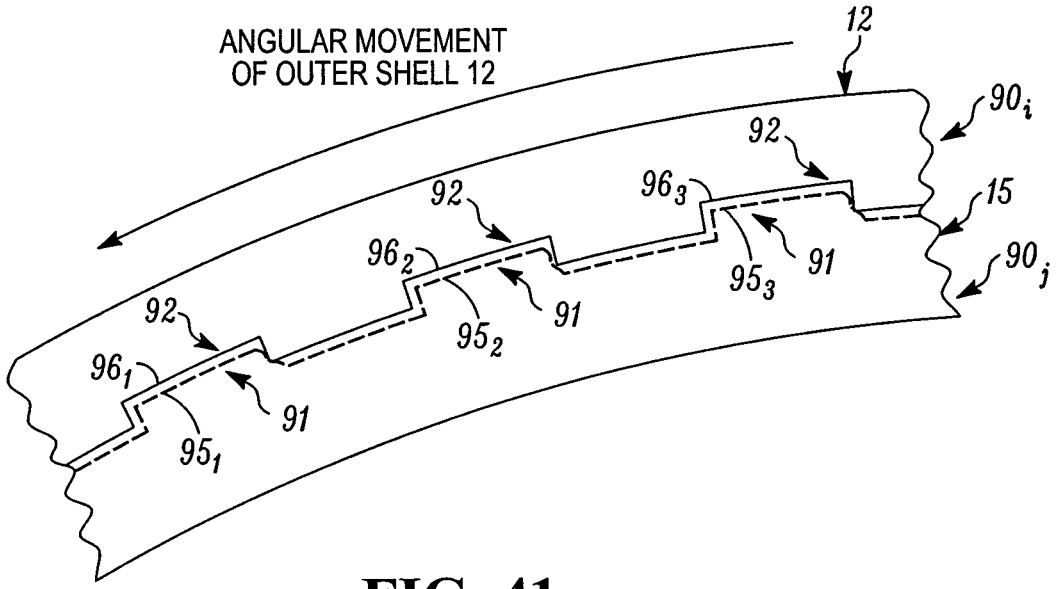

In this embodiment, the protective layer $90_j$ is implemented by the inner padding 15 and comprises the meshing part 91, and the protective layer $90_i$ is implemented by the outer shell 12 and comprises the meshing hollow space 92. In this case, the meshing part 91 of the inner padding 15 comprises a plurality of projections $95_1$-$95_P$ and the meshing hollow space of the outer shell 12 comprises a plurality of recesses $96_1$-$96_P$ receiving corresponding ones of the projections $95_1$-$95_P$. More specifically, in this case, each of the projections $95_1$-$95_P$ are deformable to move out of the recesses $96_1$-$96_P$ when the outer shell 12 angularly moves due to a rotational impact. For instance, in the example illustrated in FIG. 41, the protective layer $90_j$ is deformed and is moved relative to the protective layer $90_i$ in response to a rotational impact causing an angular movement of the outer shell 12.

Each projection $95_x$ may comprise a deformable material 97. The deformable material 97 may sometimes be referred to as a "flexible", "elastic", "compliant" or "resilient" material.

The deformable material 97 may have an elastic modulus (i.e., modulus of elasticity) within a certain range to provide suitable elastic deformation. For example, in some embodiments, the elastic modulus of the deformable material 97 of the projection $95_x$ may be no more than 75 MPa, in some cases no more than 65 MPa, in some cases no more than 55 MPa, and in some cases even less (e.g., less than 50 MPa). The elastic modulus of the deformable material 97 of the projection $95_x$ may have any other suitable value in other embodiments.

For example, in some embodiments, the deformable material 97 may comprise polymeric cellular material. For instance, the polymeric cellular material may comprise polymeric foam such as expanded polypropylene (EPP) foam, expanded polyethylene (EPE) foam, vinyl nitrile (VN) foam, polyurethane foam (e.g., PORON XRD foam commercialized by Rogers Corporation), or any other suitable polymeric foam material and/or may comprise expanded polymeric microspheres (e.g., Expancel™ microspheres commercialized by Akzo Nobel). Alternatively, in other embodiments, the deformable material 97 may comprise an elastomeric material (e.g., a rubber such as styrene-butadiene rubber or any other suitable rubber; a polyurethane elastomer such as thermoplastic polyurethane (TPU); any other thermoplastic elastomer; etc.). In yet other embodiments, the deformable material 97 may comprise a flexible plastic such as low-density polyethylene.

The projections $95_1$-$95_P$ may have any suitable shape. For instance, in some embodiments, the projections $95_1$-$95_P$ may be hemispherical or polygonal, or have a periphery with both flat and curved areas.

In some embodiments, to allow adjustability of the helmet 10, the recesses $96_1$-$96_P$ may be sufficiently large such that they register with respective ones of the projections $95_1$-$95_P$ in a number of different positions. For example, in some embodiments, each recess $96_x$ may be elongated in a direction in which a pad member of the inner padding 15 having a projection $95_x$ registering with the recess $96_x$ moves when the helmet 10 is adjusted using the adjustment mechanism 40. A width of the recess 96, transversal to its length may generally match a diameter of the projection $95_x$.

The protective layers $90_1$-$90_P$ which are meshing with one another may be configured in various other ways in other embodiments.

Figure 42:
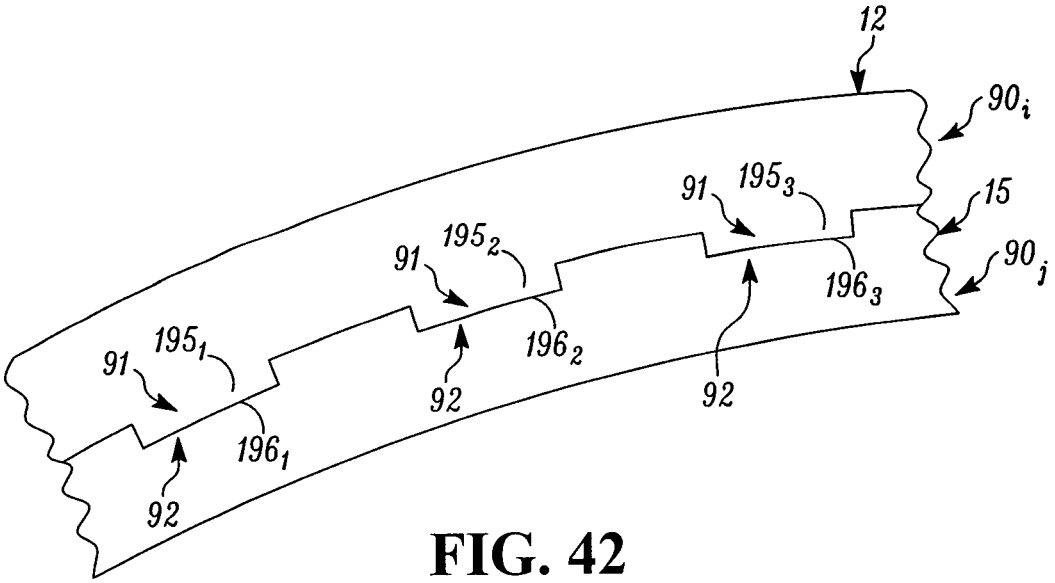
FIGS. 42 to 44 show other examples of a plurality of protective layers which are meshing with one another.

For example, in other embodiments, as shown in FIG. 42, the reverse arrangement in which the protective layer $90_j$ implemented by the inner padding 15 comprises recesses $196_1$-$196_P$ and the protective layer 90, implemented by the outer shell 12 comprises projections $195_1$-$195_P$ may be used. In this case, each of the projections $195_1$-$195_P$ is not deformable and the recesses $196_1$-$196_P$ of the protective layer $90_j$ are deformable to move relative to the protective layer $90_i$ when the outer shell 12 angularly moves due to a rotational impact. Alternatively, in other cases, each of the projections $195_1$-$195_P$ may be deformable to move out of the recesses $196_1$-$196_P$ when the outer shell 12 angularly moves due to a rotational impact. For instance, the projections $195_1$-$195_P$ may be made of a different material or of a more flexible material than the rest of the shell 12.

Figure 43:
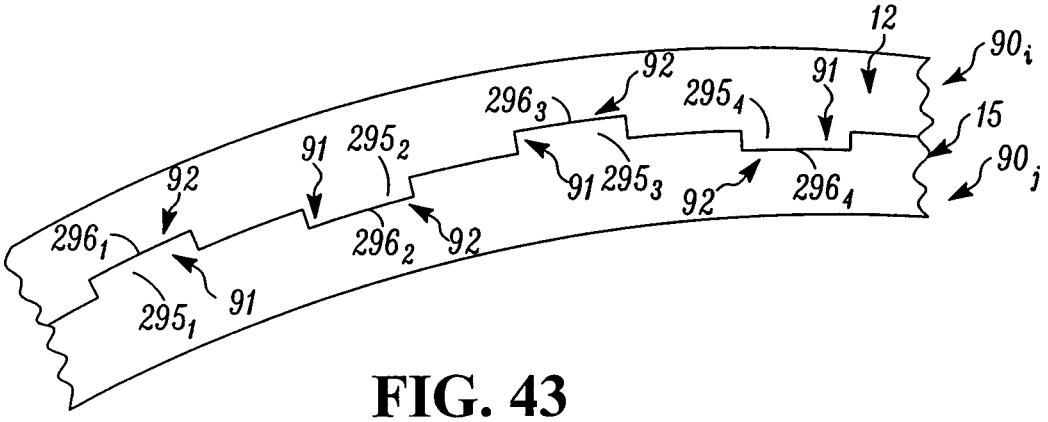

As another example, in other embodiments, as shown in FIG. 43, each of the protective layer $90_i$ implemented by the inner padding 15 and the protective layer $90_j$ implemented by the outer shell 12 may comprise both projections $295_1$-$295_P$ and recesses $296_1$-$296_P$. As in the cases discussed above, each of the projections $295_1$-$295_P$ may be deformable to move out of the recesses $296_1$-$296_P$ when the outer shell 12 angularly moves due to a rotational impact. Alternatively, in some cases, only a selective subset of the projections $295_1$-$295_P$ may be deformable. For instance, in one example, the projections $295_1$, $295_3$, $295_5$, . . . $295_{P-1}$ may be deformable while the other projections $295_2$, $295_4$, $295_6$, . . . $295_P$ may not be deformable.

Figure 44:
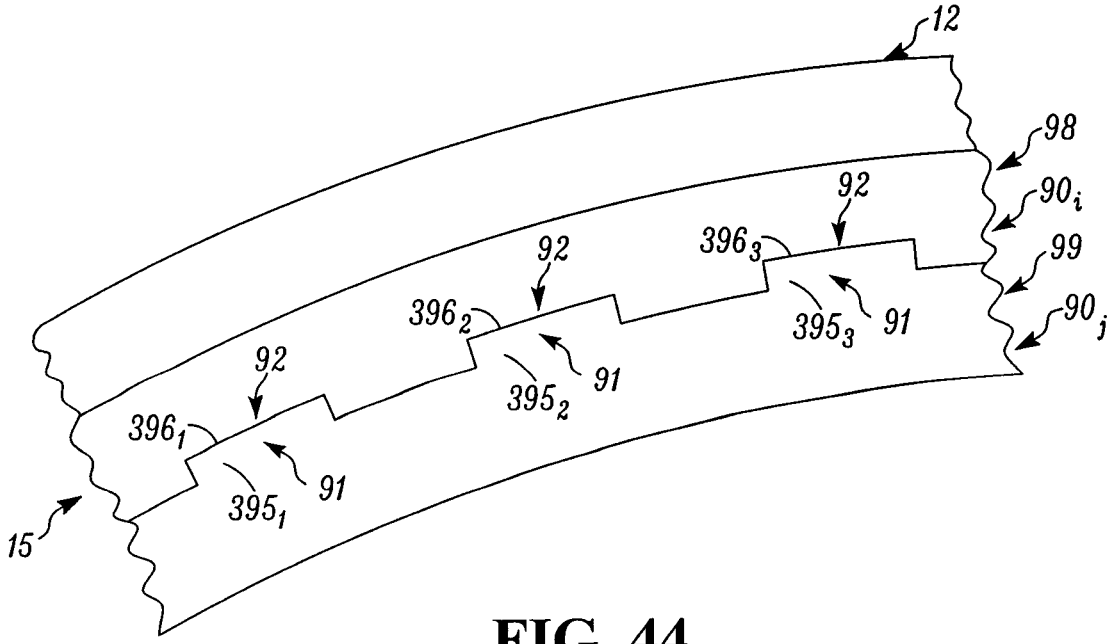

By way of another example, in some embodiments, as shown in FIG. 44, the protective layer $90_i$ may be implemented by a first padding layer 98 of the inner padding 15 and the protective layer $\mathbf{90}_j$ may be implemented by a second padding layer 99 of the inner padding 15. In this case, the padding layers 98, 99 are movable relative to one another. For instance, the padding layers 98, 99 may be individually fastened to the outer shell 12 (e.g., at different locations) by respective fasteners to allow their relative movement. Alternatively, the padding layers 98, 99 may be directly connected to one another by a fastener (e.g., screw or other threaded fastener, rivet, etc., or any other suitable fastener) that allows them to move relatively to one another. In some embodiments, the deformable material 97 of the padding layer 98 may be stiffer or less stiff than the deformable material 97 of the padding layer 99. Both projections $\mathbf{395}_1$-$\mathbf{395}_P$ and recesses $\mathbf{396}_1$-$\mathbf{396}_P$ of the padding layers 98, 99 may be deformable.

Although in embodiments discussed above there are only two protective layers $\mathbf{90}_i$ and $\mathbf{90}_j$ meshing, in other embodiments, there may be three or more protective layers $\mathbf{90}_1$-$\mathbf{90}_P$ that are meshing. For instance, in some embodiments, a protective layer $\mathbf{90}_i$ may be implemented by a first padding layer 98 of the inner padding 15 and a protective layer $\mathbf{90}_j$ may be implemented by a second padding layer 99 of the inner padding 15 as shown above in FIG. 44, and a protective layer $\mathbf{90}_k$ may be implemented by the outer shell 12 as shown in FIG. 40.

Figure 45:
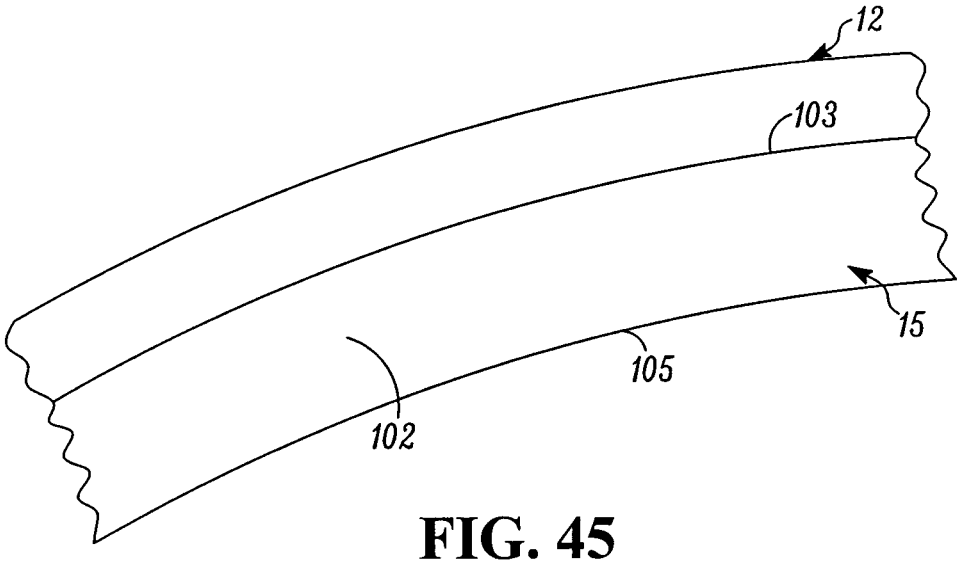
FIGS. 45 and 46 show an example of a shearable material part of the inner padding.
Figure 46:
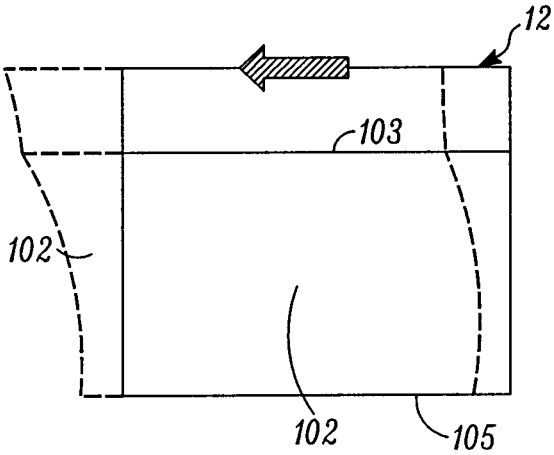

1.4 Shearable Material which Can Elastically Shear in Response to a Rotational Impact In some embodiments, as shown in FIGS. 45 and 46, the rotational impact protection system 28 may comprise a shearable material 102 which can elastically shear in response to a rotational impact on the helmet 10 such that its outer surface 103 is movable relative to its inner surface 105 in a direction tangential to an angular movement of the outer shell 12 due to the rotational impact. This elastic shear of the shearable material 102 absorbs energy from the rotational impact and may thus reduce its effect on the wearer's head 11.

In this embodiment, the shearable material 102 may constitute at least part of the inner padding 15.

More particularly, in some embodiments, the shearable material 102 may have a shear modulus within a certain range to provide suitable shearability. For example, in some embodiments, the shear modulus of the shearable material 102 may be no more than 20 MPa, in some cases no more than 10 MPa, in some cases no more than 5 MPa, and in some cases even less. The shear modulus of the shearable material 102 may have any other suitable value in other embodiments.

Additionally or alternatively, in some embodiments, the shearable material 102 may have a hardness within a certain range to provide suitable shearability. For example, in some embodiments, the hardness of the shearable material 102 may be no more than 90 durometers Shore OO, in some cases no more than 70 durometers Shore OO, in some cases no more than 50 durometers Shore OO, in some cases no more than 30 durometers Shore OO, and in in some cases even less (e.g., no more than 20 durometers Shore OO). The hardness of the shearable material 102 may have any other suitable value in other embodiments.

Yet additionally or alternatively, in some embodiments, the shearable material 102 may have a resilience within a certain range to provide suitable shearability. For example, in some embodiments, the resilience of the shearable material 102 may be at least 5%, in some cases at least 10%, in some cases at least 20%, and in some cases at least 30% according to DIN 53512 of the German institute for standardization and/or may be no more than 30%, in some cases no more than 20%, in some cases no more than 10%, and in some cases no more than 5% according to DIN 53512. The resilience of the shearable material 102 may have any other suitable value in other embodiments.

For example, in some embodiments, the hardness of the shearable material 102 may be between 20 and 90 durometers Shore OO and the resilience of the shearable material 102 may be no more than 30% according to DIN 53512.

A thickness T of the shearable material 102 may be with a certain range for suitable shearability. For example, in some embodiments, the thickness T of the shearable material 102 may be no more than 20 mm, in some cases no more than 10 mm, in some cases no more than 5 mm, and in some cases even less (e.g., no more than 1 mm). The thickness T of the shearable material 102 may have any other suitable value in other embodiments.

The shearable material 102 may be of any suitable type in various embodiments.

For example, in some embodiments, the shearable material 102 may comprise an elastomeric material (e.g., a rubber or a polyurethane elastomer).

As another example, in some embodiments, the shearable material 102 may comprise polymeric cellular material. For instance, the polymeric cellular material may comprise polymeric foam such as vinyl nitrile (VN) foam, expanded polypropylene (EPP) foam, expanded polyethylene (EPE) foam, polyurethane foam (e.g., PORON XRD foam commercialized by Rogers Corporation), or any other suitable polymeric foam material and/or may comprise expanded polymeric microspheres (e.g., Expancel™ microspheres commercialized by Akzo Nobel).

By way of another example, in some embodiments, the shearable material 102 may comprise a fluid (e.g., a liquid or a gas). In some cases, the fluid may be contained within a container (e.g., a flexible bag, pouch or other envelope). In other cases, the shearable material 102 may comprise a gel. For instance, in some embodiments, the gel may be a polyurethane gel.

Figure 47:
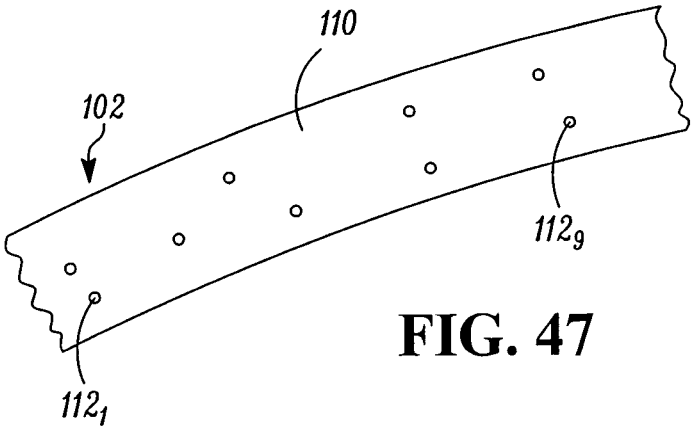
FIGS. 47 to 49 show another example of a shearable material part of the inner padding.
Figure 48:
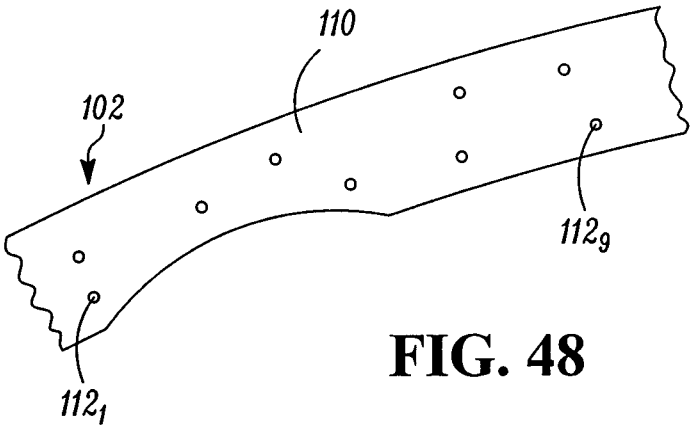
Figure 49:
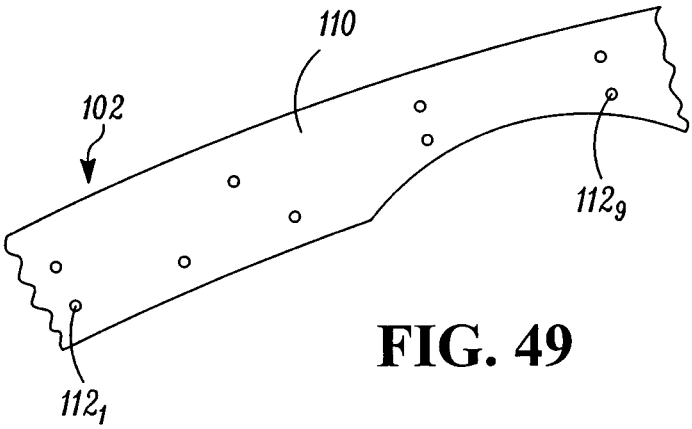

In yet another example, in some embodiments, as shown in FIGS. 47 to 49, the shearable material 102 may comprise a viscous medium 110 containing particles $\mathbf{112}_1$-$\mathbf{112}_V$. This may allow the shearable material 102 to be viscoelastic. For instance, in this embodiment, the shearable material 102 may be malleable such that it is repeatedly deformable and substantially retains any of a plurality of shapes it can acquire. For example, FIG. 47 shows an original shape of the shearable material 102, while FIGS. 48 and 49 show different shapes of the shearable material 102 that it retains upon being deformation. For instance, the shape that the shearable material 102 retains may depend on the shape of the wearer's head 11 in the helmet 10, as the shearable material 102 may form to fit the wearer's head 11. For example, in some embodiments, the viscous medium 110 may be oil and the particles $\mathbf{112}_1$-$\mathbf{112}_V$ may be expanded polymeric microspheres (e.g., Expancel™ microspheres commercialized by Akzo Nobel).

The shearable material 102 may be configured in various other ways in other embodiments.

Figure 50:
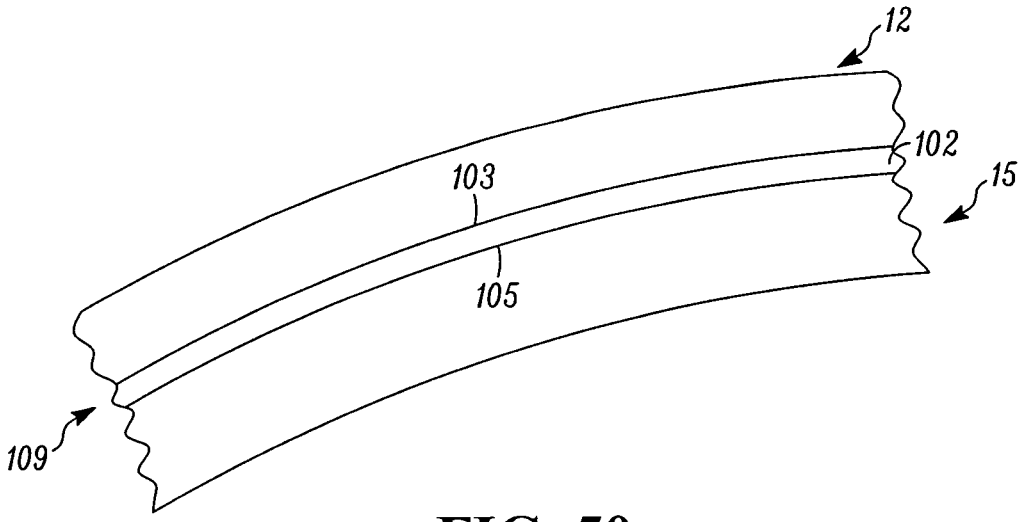
FIGS. 50 and 51 show an example of a shearable material forming an interface between the inner padding and the outer shell.
Figure 51:
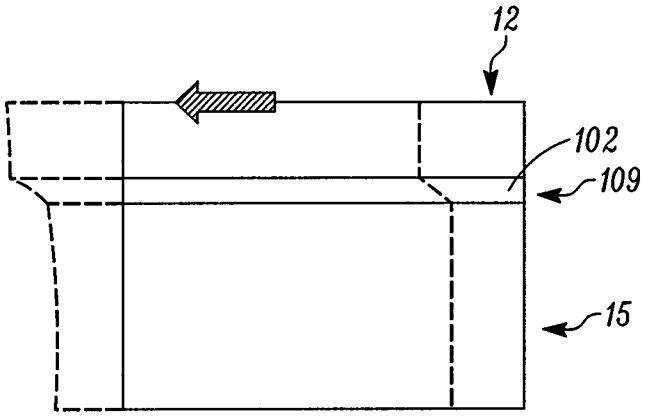

For example, as illustrated in FIGS. 50 and 51, the shearable material 102 may form an interface layer 109 disposed between the outer shell 12 and the inner padding 15. For instance, FIG. 51 illustrates in dotted lines a shearing of the shearable material 102 in response to an angular movement of the outer shell. In this embodiment, the interface layer 109 is fastened to outer shell 12 and the inner padding 15 by fasteners, which may be an adhesive fastener, a mechanical fastener (e.g., screw or other threaded fastener, rivet, etc.) or any other suitable fastener.

1.5 Floating Liner

Figure 52:
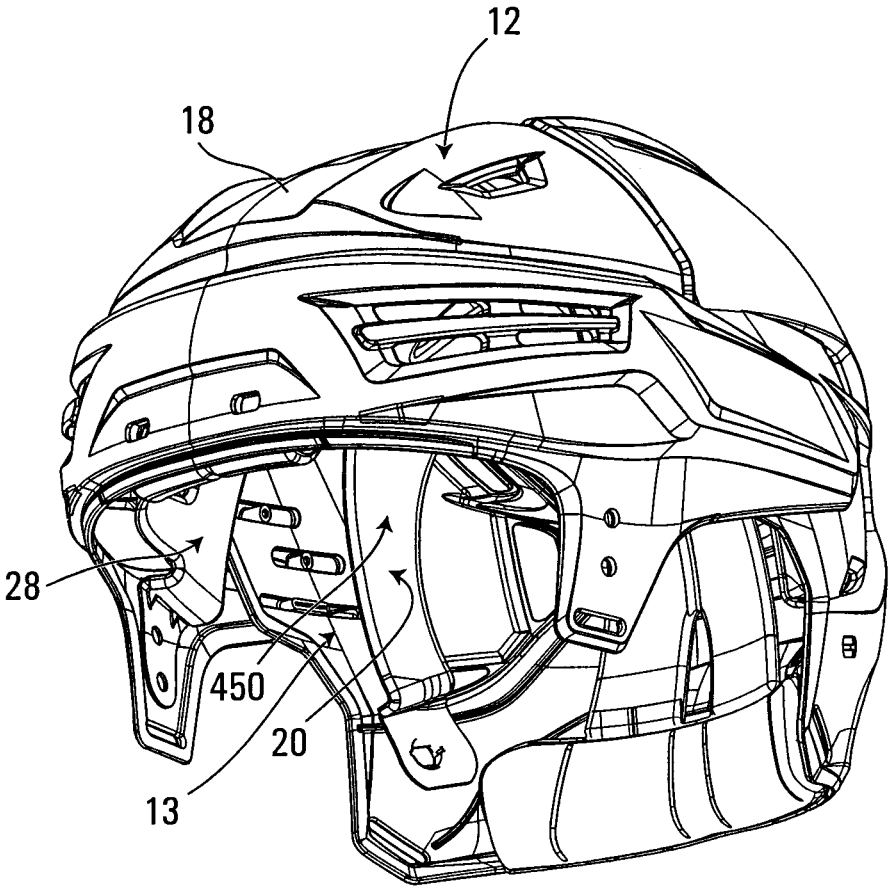
FIGS. 52 to 54 show an example of a floating liner.
Figure 53:
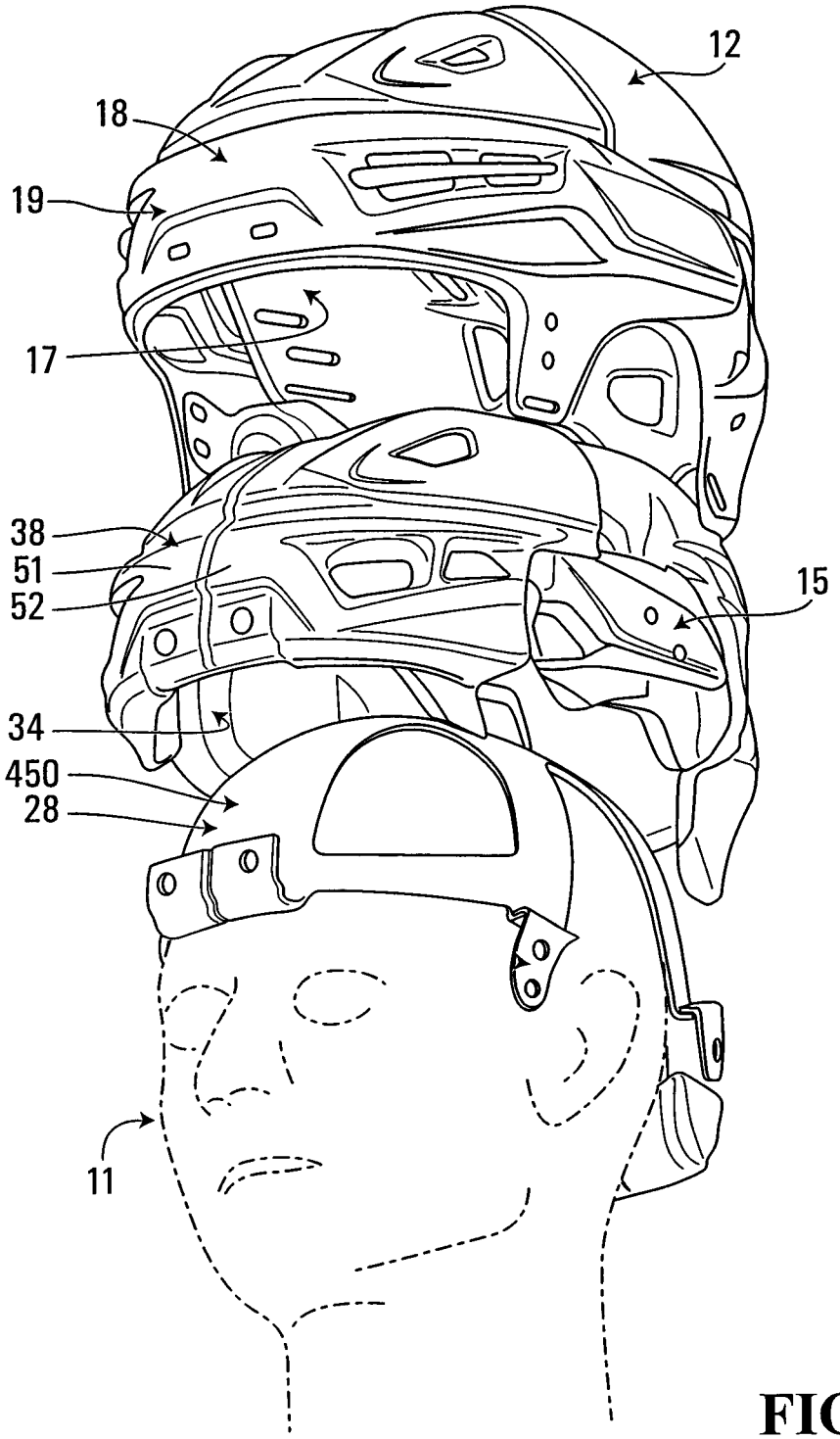
Figure 54:
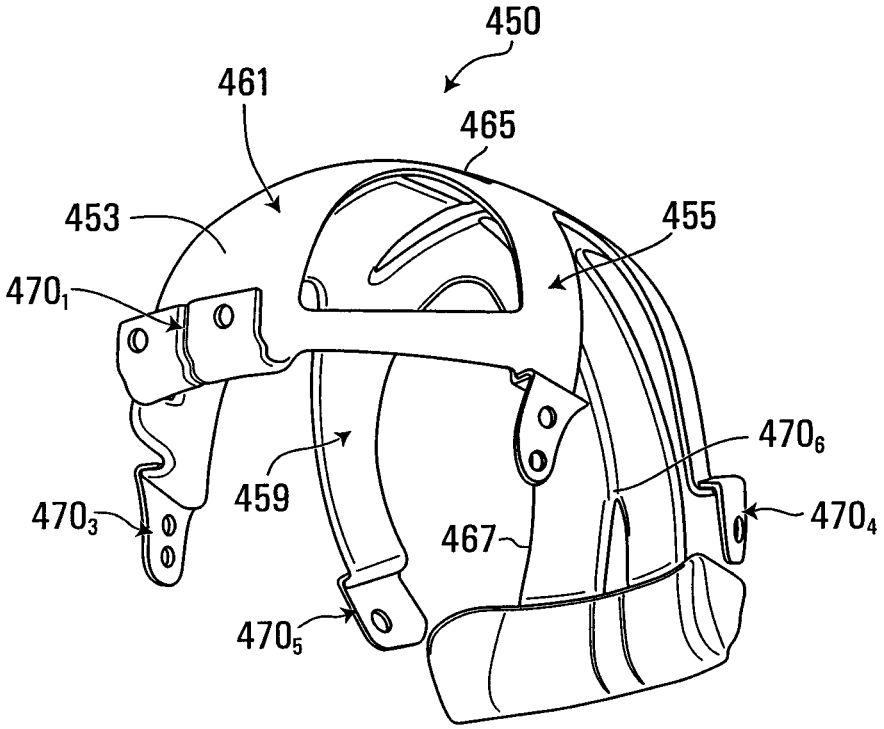

In some embodiments, as shown in FIGS. 52 to 54, the rotational impact protection system 28 of the helmet 10 may comprise a floating liner 450 disposed between the outer shell 12 and the wearer's head 11 and movable relative to the inner padding 15 and the outer shell 12 in response to a rotational impact. In this example, the floating liner 450 is disposed between the inner padding 15 and the wearer's head 11. In other examples, the floating liner 450 may be disposed elsewhere between the outer shell 12 and the wearer's head 11, such as, for instance, between the outer shell 12 and the inner padding 15.

For example, in some embodiments, the floating liner 450 may be configured as described in U.S. patent application Ser. No. 13/560,546, which was published as U.S. Patent Application Publication 2013/0025032 on Jan. 31, 2013 and which is incorporated by reference herein. As discussed therein, in some embodiments, energy from a rotational impact is absorbed by a frictional engagement of the floating liner 450 with the inner padding 15 in which energy is dissipated through friction and by an elastic deformation of the floating liner 450 in which energy is absorbed through stretching of the floating liner 450. In addition to its rotational impact protection, in some embodiments, the floating liner 450 also provides linear impact protection. More particularly, the floating liner 450 is elastically compressible in response to a linear impact force to absorb energy by elastic compression.

In this embodiment, the floating liner 450 comprises an inner surface 459 for contacting the wearer's head 11 and an outer surface 461 facing the inner padding 15. In this case, the inner surface 459 of the floating liner 450 constitutes the internal surface 20 of the helmet 10 which contacts the wearer's head 11 when the helmet 10 is worn.

Also, in this embodiment, the floating liner 450 comprises a front portion 453 for facing the front region FR of the wearer's head 11, left and right side portion 455, 457 for facing the left and right side regions LS, RS of the wearer's head 11, a top portion 465 for facing the top region TR of the wearer's head 11, and a back portion 467 for facing the back region BR of the wearer's head 11. These portions of the floating liner 450 are arranged such that the floating liner 450 has a dome shape for receiving the wearer's head 11. In this example, the front portion 453, side portions 455, 457, and back portion 467 comprise respective segments $\mathbf{470}_1$-$\mathbf{470}_6$ extending downwardly from the top portion 465 and spaced from one another. The floating liner 450 may have various other shapes in other embodiments.

The floating liner 450 may be made of any suitable material to achieve its impact protection function. In this embodiment, in order to absorb energy by elastic deformation, the floating liner 450 comprises elastic material that is elastically stretchable to absorb energy by stretching when the helmet 10 is rotationally impacted. Also, in this case, the elastic material of the floating liner 450 is elastically compressible to absorb energy by compressing when the helmet 10 is impacted. The elastic material of the floating liner 450 may thus be an elastically stretchable compressible impact-absorbing material. For example, in some embodiments, the elastic material of the floating liner 450 may comprise elastomeric material (e.g., elastomeric polyurethane foam such as PORON XRD foam commercialized by Rogers Corporation or any other suitable elastomeric foam).

The floating liner 450 may be configured in various other ways in other embodiments. Examples of variants of the floating liner 450 are discussed in U.S. Patent Application Publication 2013/0025032.

1.6 Compression of Padding Layers Decoupled from Shearing of the Padding Layers In some embodiments, as shown in FIGS. 73 to 76, the rotational impact protection system 28 of the helmet 10 may be implemented by the inner padding 15 comprising a plurality of padding layers $\mathbf{330}_1$-$\mathbf{330}_P$ that are stacked and interconnected such that compression of adjacent ones of the padding layers $\mathbf{330}_1$-$\mathbf{330}_P$ is decoupled (i.e., independent) from shearing of these adjacent ones of the padding layers $\mathbf{330}_1$-$\mathbf{330}_P$ relative to one another. This may allow the inner padding 15 to better absorb linear impact forces by compression of the padding layers $\mathbf{330}_1$-$\mathbf{330}_P$ and rotational impact forces by shearing of adjacent ones of the padding layers $\mathbf{330}_1$-$\mathbf{330}_P$ relative to one another. For example, in response to a rotational impact on the helmet 10, an outer one of the padding layers $\mathbf{330}_1$-$\mathbf{330}_P$ may be movable relative to an inner one of the padding layers $\mathbf{330}_1$-$\mathbf{330}_P$ in a direction tangential to an angular movement of the outer shell 12 due to the rotational impact, potentially with little or no compression of one or both of these outer and inner ones of the padding layers $\mathbf{330}_1$-$\mathbf{330}_P$.

In this embodiment, the inner padding 15 comprises a plurality of pad members $\mathbf{344}_1$-$\mathbf{344}_P$ separate from one another, in which each pad member $\mathbf{344}_i$ comprises a plurality of padding layers $\mathbf{348}_1$-$\mathbf{348}_3$ that are stacked and a connector 350 interconnecting adjacent ones of the padding layers $\mathbf{348}_1$-$\mathbf{348}_3$ such that compression of the padding layers $\mathbf{348}_1$-$\mathbf{348}_3$ is decoupled (i.e., independent) from shearing of the adjacent ones of the padding layers $\mathbf{348}_1$-$\mathbf{348}_3$ relative to one another. Thus, in this embodiment, the padding layers $\mathbf{348}_1$-$\mathbf{348}_3$ of each of the pad members $\mathbf{344}_1$-$\mathbf{344}_P$ constitute respective ones of the padding layers $\mathbf{330}_1$-$\mathbf{330}_P$ of the inner padding 15. Also, in this embodiment, the pad member $\mathbf{344}_i$ comprises a low-friction interface 370 between adjacent ones of the padding layers $\mathbf{348}_1$-$\mathbf{348}_3$ to facilitate shearing of these adjacent padding layers relative to one another.

In response to a rotational impact on the helmet 10, an outer one of the padding layers $\mathbf{348}_1$-$\mathbf{348}_3$ of a pad member $\mathbf{344}_i$ may be movable relative to an inner one of the padding layers $\mathbf{348}_1$-$\mathbf{348}_3$ of the pad member $\mathbf{344}_i$ in a direction tangential to an angular movement of the outer shell 12 due to the rotational impact, potentially with little or no compression of one or both of these outer and inner ones of the padding layers $\mathbf{348}_1$-$\mathbf{348}_3$. In this example of implementation, because of separateness of the pad members $\mathbf{344}_1$-$\mathbf{344}_P$, the outer and inner ones of the padding layers $\mathbf{348}_1$-$\mathbf{348}_3$ of the pad member $\mathbf{344}_i$ may move omnidirectionally relative to one another (i.e., may move relative to one another in any direction in a plane between them). This may be particularly useful in embodiments such as those considered here where the helmet 10 does not have a perfectly spherical configuration.

In this example, the padding layer $\mathbf{348}_1$ of each of the pad members $\mathbf{344}_1$-$\mathbf{344}_P$ is secured to the outer shell 12 (e.g., by an adhesive, one or more mechanical fasteners, etc.) in order to secure the pad members $\mathbf{344}_1$-$\mathbf{344}_P$ and provide anchoring points for shearing purposes. In other examples, the pad members $344_1$-$344_P$ may be secured in any other suitable way within the helmet 10.

Each of the padding layers $348_1$-$348_3$ of a pad member $344_i$ comprises a shock-absorbing material 355, For example, in some embodiments, the shock-absorbing material 355 may comprise polymeric cellular material. For instance, the polymeric cellular material may comprise polymeric foam such as expanded polypropylene (EPP) foam, expanded polyethylene (EPE) foam, vinyl nitrile (VN) foam, polyurethane foam (e.g., PORON XRD foam commercialized by Rogers Corporation), or any other suitable polymeric foam material and/or may comprise expanded polymeric microspheres (e.g., Expancel™ microspheres commercialized by Akzo Nobel). In other embodiments, the shock-absorbing material 355 may comprise an elastomeric material (e.g., a rubber such as styrene-butadiene rubber or any other suitable rubber; a polyurethane elastomer such as thermoplastic polyurethane (TPU); any other thermoplastic elastomer; etc.). In yet other embodiments, the shock-absorbing material 355 may comprise a fluid (e.g., a liquid or a gas), which may be contained within a container (e.g., a flexible bag, pouch or other envelope) or implemented as a gel (e.g., a polyurethane gel). Any other material with suitable impact energy absorption may be used in other embodiments.

The shock-absorbing material 355 of each of the padding layers $348_1$-$348_3$ of the pad member $344_i$ is compressible in response to an impact. In some examples, a compressibility of the shock-absorbing material 355 may be greater than a shearability of the shock-absorbing material 355. That is, the shock-absorbing material 355 may deform by compression more easily than by shearing.

In some cases, the shock-absorbing material 355 of a padding layer $348_x$ may be the same as the shock-absorbing material 355 of another padding layer $348_y$.

In other cases, the shock-absorbing material 355 of a padding layer $348_x$ may be different than the shock-absorbing material 355 of another padding layer $348_y$. For example, in some embodiments, the shock-absorbing material 355 of the padding layer $348_x$ may be stiffer than the shock-absorbing material 355 of the padding layer $348_y$ that is more inwards (i.e., closer to the wearer's head 11) than the padding layer $348_x$. For instance, in some examples, the shock-absorbing material 355 of the padding layer $348_1$ may be stiffer than the shock-absorbing material 355 of the padding layer $348_2$ that is more inwards (i.e., closer to the wearer's head 11) than the padding layer $348_1$, and/or the shock-absorbing material 355 of the padding layer $348_2$ may be stiffer than the shock-absorbing material 355 of the padding layer $348_3$ that is more inwards (i.e., closer to the wearer's head 11) than the padding layer $348_2$.

For example, in some embodiments, the shock-absorbing material 355 of the padding layer $348_1$ and the shock-absorbing material 355 of the padding layer $348_2$ may provide a bulk of a shock absorption capability of the pad member $344_i$, while the shock-absorbing material 355 of the padding layer $348_3$ may be primarily for comfort of the wearer (e.g., the padding layer $348_3$ may be a comfort padding layer contacting the wearer's head 11 when the helmet 10 is being worn).

Each of the padding layers $348_1$-$348_3$ of the pad member 344, can have any suitable shape. In this embodiment, each of the padding layers $348_1$-$348_3$ has a generally circular cross-section such that it is generally cylindrical. The padding layers $348_1$-$348_3$ may have any other suitable shape in other examples. Also, in some examples, different ones of the padding layers $348_1$-$348_3$ may have different shapes.

The pad member $344_i$ may include any number of padding layers that are stacked and interconnected such as the padding layers $348_1$-$348_3$ in other embodiments (i.e., two or more than three padding layers such as the padding layers $348_1$-$348_3$).

The connector 350 of the pad member $344_i$ interconnects adjacent ones of the padding layers $348_1$-$348_3$ of the pad member $344_i$. In this embodiment, the connector 350 connects the padding layers $348_1$, $348_2$ to one another. The padding layers $348_2$, $348_3$ may be secured to one another by an adhesive and/or a mechanical fastener and/or in any other way (e.g., ultrasonic welding, overmolding, etc.).

The connector 350 is deformable to allow the padding layers $348_1$, $348_2$ of the pad member $344_i$ to shear relative to one another. More particularly, in this embodiment, the connector 350 is stretchable and/or bendable to allow the padding layers $348_1$, $348_2$ of the pad member $344_i$ to shear relative to one another. Thus, in response to a rotational impact on the helmet 10, the connector 350 is deformable to allow the padding layers $348_1$, $348_2$ to move relative to one another in a direction tangential to an angular movement of the outer shell 12 due to the rotational impact.

In this embodiment, the connector 350 of the pad member $344_i$ comprises a plurality of connecting members $354_1$-$354_4$ that are separate from one another. More particularly, in this embodiment, each of the connecting members $354_1$-$354_4$ is elongated and extends from the padding layer $348_1$ to the padding layer $348_2$ to interconnect these padding layers. In that sense, the connecting members $354_1$-$354_4$ may be referred to as connecting "columns". In this example, each of the connecting members $354_1$-$354_4$ has a generally circular cross-section such that it is generally cylindrical. The connecting members $354_1$-$354_4$ may have any other suitable shape in other examples. Also, in some examples, different ones of the connecting members $354_1$-$354_4$ may have different shapes.

Each connecting member $354_x$ of the pad member $344_i$ comprises a deformable material 360. The deformable material 360 may sometimes be referred to as a "flexible", "elastic", "compliant" or "resilient" material.

The deformable material 360 of a connecting member $354_x$ may have an elastic modulus (i.e., modulus of elasticity) within a certain range to provide suitable elastic deformation. For example, in some embodiments, the elastic modulus of the deformable material 360 of the connecting member $354_x$ may be different from (e.g., greater or lower than) an elastic modulus of the shock-absorbing material 355 of a padding layer $348_x$ of the pad member $344_i$. For instance, in some embodiments, the elastic modulus of the deformable material 360 of the connecting member $354_x$ may be lower than the elastic modulus of the shock-absorbing material 355 of the padding layer $348_x$. In some examples, a ratio of the elastic modulus of the deformable material 360 of the connecting member $354_x$ over the elastic modulus of the shock-absorbing material 355 of the padding layer $348_x$ may be no more than 0.9, in some cases no more than 0.7, in some cases no more than 0.5, in some cases no more than 0.3, and in some cases even less (e.g., no more than 0.1). For instance, in some embodiments, the elastic modulus of the deformable material 360 of the connecting member $354_x$ may be no more than 50 MPa, in some cases no more than 35 MPa, in some cases less than 20 MPa, and in some cases even less (e.g., no more than 10 MPa). The elastic modulus of the deformable material 360 of the connector $\mathbf{354}_x$ may have any other suitable value in other embodiments.

For example, in some embodiments, the deformable material 360 of a connecting member $\mathbf{354}_x$ of the pad member $\mathbf{344}_i$ may comprise an elastomeric material (e.g., a rubber such as styrene-butadiene rubber or any other suitable rubber; a polyurethane elastomer such as thermoplastic polyurethane (TPU); any other thermoplastic elastomer; etc.). Alternatively, in other embodiments, the deformable material 360 may comprise polymeric cellular material. For instance, the polymeric cellular material may comprise polymeric foam such as expanded polypropylene (EPP) foam, expanded polyethylene (EPE) foam, vinyl nitrile (VN) foam, polyurethane foam (e.g., PORON XRD foam commercialized by Rogers Corporation), or any other suitable polymeric foam material and/or may comprise expanded polymeric microspheres (e.g., Expancel™ microspheres commercialized by Akzo Nobel). As yet another example, in other embodiments, the deformable material 360 may comprise a flexible plastic (e.g., low-density polyethylene).

The connector 350 of the pad member $\mathbf{344}_i$ can be secured to the padding layers $\mathbf{348}_1$, $\mathbf{348}_2$ of the pad member $\mathbf{344}_i$ in any suitable way. In this embodiment, each connecting member $\mathbf{354}_x$ comprises enlarged end portions $\mathbf{366}_1$, $\mathbf{366}_2$ that engage respective ones of the padding layers $\mathbf{348}_1$, $\mathbf{348}_2$ to secure them together. More particularly, in this embodiment, each of the padding layers $\mathbf{348}_1$, $\mathbf{348}_2$ comprises a plurality of channels $\mathbf{368}_1$-$\mathbf{368}_4$ that receive respective ones of the connecting members $\mathbf{354}_1$-$\mathbf{354}_4$ such that the padding layers $\mathbf{348}_1$, $\mathbf{348}_2$ are disposed and retained between the enlarged end portions $\mathbf{366}_1$, $\mathbf{366}_2$ of each of the connecting members $\mathbf{354}_1$-$\mathbf{354}_4$. The channels $\mathbf{368}_1$-$\mathbf{368}_4$ may be formed by drilling, punching, molding, or in any other suitable way. In some examples, the connecting members $\mathbf{354}_1$-$\mathbf{354}_4$ with their enlarged end portions $\mathbf{366}_1$, $\mathbf{366}_2$ may be inserted through the channels $\mathbf{368}_1$-$\mathbf{368}_4$ via a one-way plug. In other examples, the enlarged end portions $\mathbf{366}_1$, $\mathbf{366}_2$ of the connecting members $\mathbf{354}_1$-$\mathbf{354}_4$ may be formed after insertion of the connecting members $\mathbf{354}_1$-$\mathbf{354}_4$ through the channels $\mathbf{368}_1$-$\mathbf{368}_4$, such as by thermoforming (e.g., heat-forming a thermoplastic-elastomer filament) and/or by any other suitable process. The connector 350 of the pad member $\mathbf{344}_i$ may be secured to the padding layers $\mathbf{348}_1$, $\mathbf{348}_2$ in any other suitable manner in other embodiments (e.g., by adhesive bonding, using one or more mechanical fasteners, etc.).

In this embodiment, the connector 350 of the pad member $\mathbf{344}_i$ allows the pad member $\mathbf{344}_i$ to have a compact size. This may help to avoid increasing an offset of the helmet 10 from the wearer's head 11 (i.e., a distance between the wearer's head 11 and the external surface 18 of the helmet 10). More particularly, in this embodiment, the connector 350 is concealed by the padding layers $\mathbf{348}_1$-$\mathbf{348}_3$ of the pad member $\mathbf{344}_i$ and does not affect a thickness of the pad member $\mathbf{344}_i$. That is, the thickness of the pad member $\mathbf{344}_i$ would remain identical if the connector 350 was removed from the pad member $\mathbf{344}_i$ but the pad member $\mathbf{344}_i$ was otherwise identical. In this case, the connecting members $\mathbf{354}_1$-$\mathbf{354}_4$ of the connector 350 are located in the channels $\mathbf{368}_1$-$\mathbf{368}_4$ of the padding layers $\mathbf{348}_1$, $\mathbf{348}_2$, thus concealed by the padding layers $\mathbf{348}_1$, $\mathbf{348}_2$ and not adding to the thickness of the pad member $\mathbf{344}_i$.

The connector 350 of the pad member $\mathbf{344}_i$ may be configured in any other suitable way in other embodiments. For instance, in other embodiments, the connector 350 of the pad member $\mathbf{344}_i$ may be constituted by a single connecting member or may comprise any suitable number of connecting members such as the connecting members $\mathbf{354}_1$-$\mathbf{354}_4$ (e.g., two, three, or more than four connecting members).

In this embodiment, the low-friction interface 370 of the pad member $\mathbf{344}_i$ is disposed between the padding layers $\mathbf{348}_1$, $\mathbf{348}_2$ in order to facilitate shearing of the padding layers $\mathbf{348}_1$, $\mathbf{348}_2$ relative to one another. The low-friction interface 370 is such that a coefficient of friction $\mu_i$ between the padding layers $\mathbf{348}_1$, $\mathbf{348}_2$ is lower than a coefficient of friction $\mu_m$ between the shock-absorbing material 355 of the padding layer $\mathbf{348}_1$ and the shock-absorbing material 355 of the padding layer $\mathbf{348}_2$. For example, in some embodiments, a ratio $\mu_i/\mu_m$ of the coefficient of friction $\mu_i$ of the low-friction interface 370 over the coefficient of friction $\mu_m$ between the shock-absorbing material 355 of the padding layer $\mathbf{348}_1$ and the shock-absorbing material 355 of the padding layer $\mathbf{348}_2$ may be no more than 0.9, in some cases no more than 0.7, in some cases no more than 0.5, in some cases no more than 0.3, in some cases no more than 0.2, in some cases no more than 0.1, and in some cases even less.

More particularly, in this embodiment, the low-friction interface 370 of the pad member $\mathbf{344}_i$ comprises a low-friction element $\mathbf{372}_1$ affixed to the shock-absorbing material 355 of the padding layer $\mathbf{348}_1$ and a low-friction element $\mathbf{372}_2$ affixed to the shock-absorbing material 355 of the padding layer $\mathbf{348}_2$ such that the low-friction elements $\mathbf{372}_1$, $\mathbf{372}_2$ are slidable against one another when the padding layers $\mathbf{348}_1$, $\mathbf{348}_2$ shear relative to one another.

The low-friction elements $\mathbf{372}_1$, $\mathbf{372}_2$ of the low-friction interface 370 of the pad member $\mathbf{344}_i$ can be affixed to the shock-absorbing material 355 of the padding layers $\mathbf{348}_1$, $\mathbf{348}_2$ in any suitable way. For example, in some embodiments, the low-friction elements $\mathbf{372}_1$, $\mathbf{372}_2$ may be affixed to the shock-absorbing material 355 of the padding layers $\mathbf{348}_1$, $\mathbf{348}_2$ by adhesive bonding. In some embodiments, the low-friction elements $\mathbf{372}_1$, $\mathbf{372}_2$ may be affixed to the shock-absorbing material 355 of the padding layers $\mathbf{348}_1$, $\mathbf{348}_2$ in any other suitable manner (e.g., by chemical bonding or by one or more mechanical fasteners).

Each of the low-friction elements $\mathbf{372}_1$, $\mathbf{372}_2$ of the low-friction interface 370 of the pad member $\mathbf{344}_i$ comprises a low-friction material 375. For example, in some embodiments, a coefficient of friction $\mu_e$ of the low-friction material 375 according to ASTM G115-10 (Standard Guide for Measuring and Reporting Friction Coefficients) may be no more than 0.5, in some cases no more than 0.4, in some cases no more than 0.3, in some cases no more than 0.2, in some cases no more than 0.15, in some cases no more than 0.1. The coefficient of friction $\mu_e$ of the low-friction material 375 may have any other suitable value in other embodiments.

The low-friction material 375 of each of the low-friction elements $\mathbf{372}_1$, $\mathbf{372}_2$ of the low-friction interface 370 of the pad member $\mathbf{344}_i$ may be implemented in any suitable way. For example, in some embodiments, the low-friction material 375 may include a fluorocarbon (e.g., polytetrafluoroethylene (PTFE), such as Teflon), polyethylene, nylon, a dry lubricant (e.g., graphite, molybdenum disulfide, etc.), or any other suitable substance with a low coefficient of friction.

Therefore, in this embodiment, when the helmet 10 is subject to an impact, one or more of the padding layers $\mathbf{348}_1$-$\mathbf{348}_3$ of a pad member $\mathbf{344}_i$ may compress under a linear impact force and/or the padding layers $\mathbf{348}_1$, $\mathbf{348}_2$ may shear relative to one another under a rotational impact force. For instance, upon a rotational impact on the helmet 10, the padding layer $\mathbf{348}_1$ can move relative to the padding layer $\mathbf{348}_2$ in a direction tangential to an angular movement of the outer shell 12 due to the rotational impact. As the padding layers $348_1$, $348_2$ move relative to one another, the connector 350 of the pad member $344_i$ elastically deforms (e.g., stretches and/or bends) to accommodate this movement, while the low-friction interface 370 between the padding layers $348_1$, $348_2$ facilitates this movement. In this example, because of the separateness of the pad members $344_1$-$344_P$, the padding layers $348_1$, $348_2$ of the pad member $344_i$ can move omnidirectionally relative to one another, thereby working efficiently for various orientations of rotational impacts.

The padding layers $330_1$-$330_P$ of the inner padding 15 that are stacked and interconnected such that compression of adjacent ones of the padding layers $330_1$-$330_P$ is decoupled from shearing of these adjacent ones of the padding layers $330_1$-$330_P$ relative to one another may be implemented in various other ways in other embodiments.

As an example, in some embodiments, different ones of the pad members $344_1$-$344_P$ may be different from one another (e.g., have different shapes and/or comprise different materials). For instance, in some embodiments, the padding layers $348_1$-$348_3$, the connector 350 and/or the low-friction interface 370 of a pad member $344_x$ may have different shapes and/or comprise different materials than the padding layers $348_1$-$348_3$, the connector 350 and/or the low-friction interface 370 of another pad member $344_y$.

Figure 77:
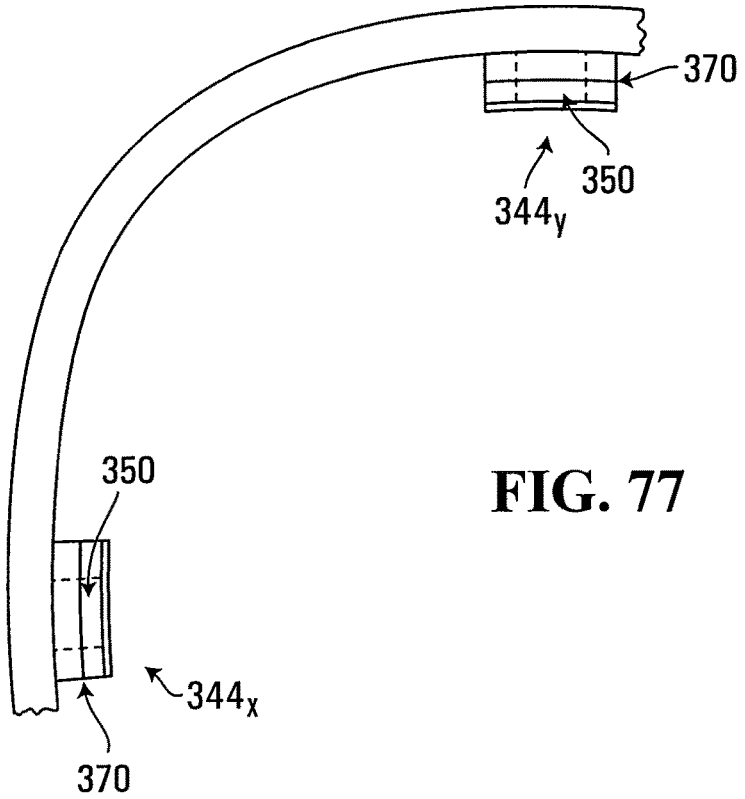

For instance, in some embodiments, as shown in FIG. 77, different ones of the pad members $344_1$-$344_P$ at different locations around the helmet 10 may have different levels of compressibility and/or different levels of shearability. For example, in some embodiments, a shearability of a pad member $344_x$ located in a lateral side of the helmet 10 may be greater than a shearability of a pad member $344_y$ located in a top (crown) area of the helmet 10, since rotational impacts are more likely to occur at the lateral side of the helmet 10.

In this embodiment, a stiffness of the connector 350 of the pad member $344_x$ located in the lateral side of the helmet 10 may be lower than a stiffness of the connector 350 located in the top area of the helmet 10 to allow the padding layers $348_1$-$348_3$ of the pad member $344_x$ to shear relative to one another more easily than the padding layers $348_1$-$348_3$ of the pad member $344_y$. To that end, in some embodiments, the connecting members $354_1$-$354_4$ of the connector 350 of the pad member $344_x$ in the lateral side of the helmet 10 may be smaller, may be fewer in number, and/or their deformable material 360 may have a greater elasticity (i.e., a lower modulus of elasticity) and/or a lower hardness than the connecting members $354_1$-$354_4$ of the connector 350 of the pad member $344_y$ in the top area of the helmet 10.

Additionally or alternatively, in this embodiment, the coefficient of friction $\mu_i$ of the low-friction interface 370 between the padding layers $348_1$, $348_2$ of the pad member $344_x$ in the lateral side of the helmet 10 may be lower than the coefficient of friction $\mu_i$ of the low-friction interface 370 between the padding layers $348_1$, $348_2$ of the pad member $344_y$ in the top area of the helmet 10. As another possibility, there may be no low-friction interface such as the low-friction interface 370 between the padding layers $348_1$, $348_2$ of the pad member $344_y$ in the top area of the helmet 10, i.e., an interface between the padding layers $348_1$, $348_2$ of the pad member $344_x$ may be a direct contact of these padding layers, such that the coefficient of friction $\mu_i$ of the low-friction interface 370 between the padding layers $348_1$, $348_2$ of the pad member $344_x$ in the lateral side of the helmet 10 is lower than a coefficient of friction of the interface between the padding layers $348_1$, $348_2$ of the pad member $344_y$ in the top area of the helmet 10.

As another example, in other embodiments, the padding layers $330_1$-$330_P$ of the inner padding 15 may be implemented by a single pad member instead of the pad members $344_1$-$344_P$ that are separate from one another as considered above.

2. External Elements for Rotational Impact Protection

In some embodiments, the rotational impact protection system 28 of the helmet 10 may comprise one or more external elements at an external side of the outer shell 12 that help to protect against a rotational impact.

2.1 Impact Deflector

Figure 55:
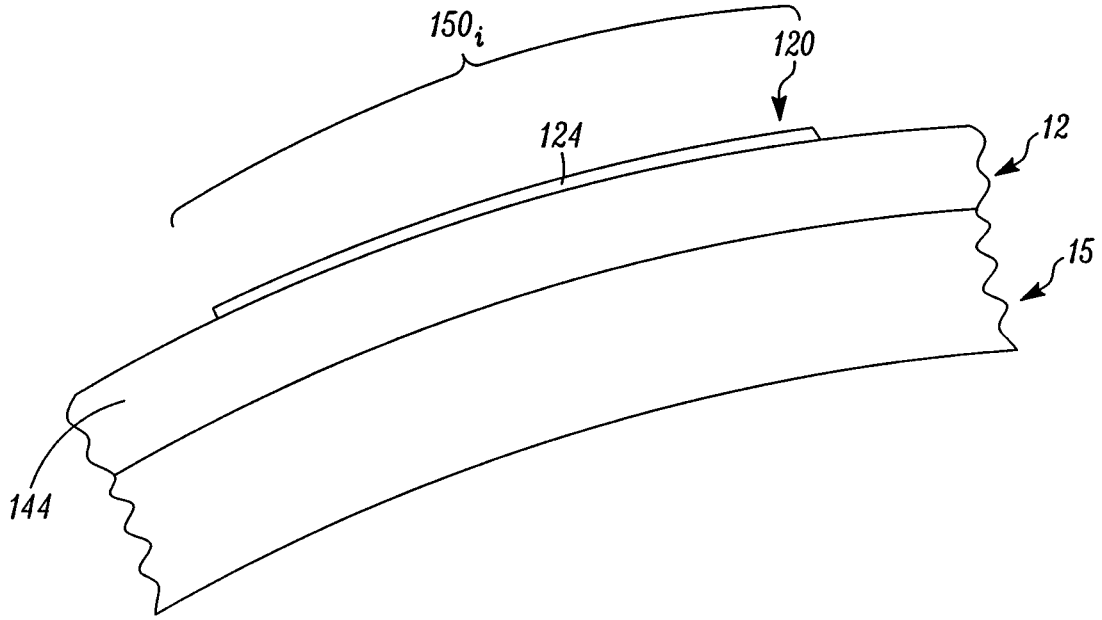
FIG. 55 shows an example of an impact deflector at an external side of the outer shell.

In some embodiments, as shown in FIG. 55, the external side of the outer shell 12 may comprise an impact deflector 120 to deflect a rotational impact so that an angular movement of the outer shell 12 due to the rotational impact is less than if the impact deflector 120 was omitted but the helmet 10 was otherwise identical.

In this embodiment, the impact deflector 120 comprises a low-friction material 124 that constitutes at least part of the outer surface 19 of the outer shell 12. This can make the outer shell 12 "slippery". For example, the low-friction material 124 may be an outer layer (e.g., a coating or film) applied on an underlying layer of the outer shell 12.

More particularly, in this embodiment, the low-friction material 124 has a coefficient of friction $\mu_d$ with an impacting object (e.g., a puck, a stick, a piece of protective equipment of another player, a board, etc.) that impacts the helmet 10 which is less than a coefficient of friction $\mu_s$ of a main material 144 of the outer shell 12 with the impacting object (i.e., the main material 144 of the outer shell 12 is the material making up a greatest proportion of the outer shell 12). For example, in some embodiments, a ratio $\mu_d/\mu_s$ of the coefficient of friction $\mu_d$ of the low-friction material 124 with the impacting object over the coefficient of friction $\mu_s$ of the main material 144 of the outer shell 12 with the impacting object may be no more than 0.9, in some cases no more than 0.8, in some cases no more than 0.7, in some cases no more than 0.6, in some cases no more than 0.5, in some cases no more than 0.4, in some cases no more than 0.3, in some cases no more than 0.2, and in some cases even less. For instance, in some embodiments, a coefficient of friction $\mu_{d*}$ of the low-friction material 124 according to ASTM G115-10 (Standard Guide for Measuring and Reporting Friction Coefficients) may be no more than 0.5, in some cases no more than 0.4, in some cases no more than 0.3, in some cases no more than 0.2, in some cases no more than 0.15, in some cases no more than 0.1.

For example, in this embodiment, the low-friction material 124 may include a fluorocarbon (e.g., polytetrafluoroethylene (PTFE), such as Teflon), a dry lubricant (e.g., graphite, molybdenum disulfide, etc.), or any other suitable material with a low coefficient of friction.

Figure 56:
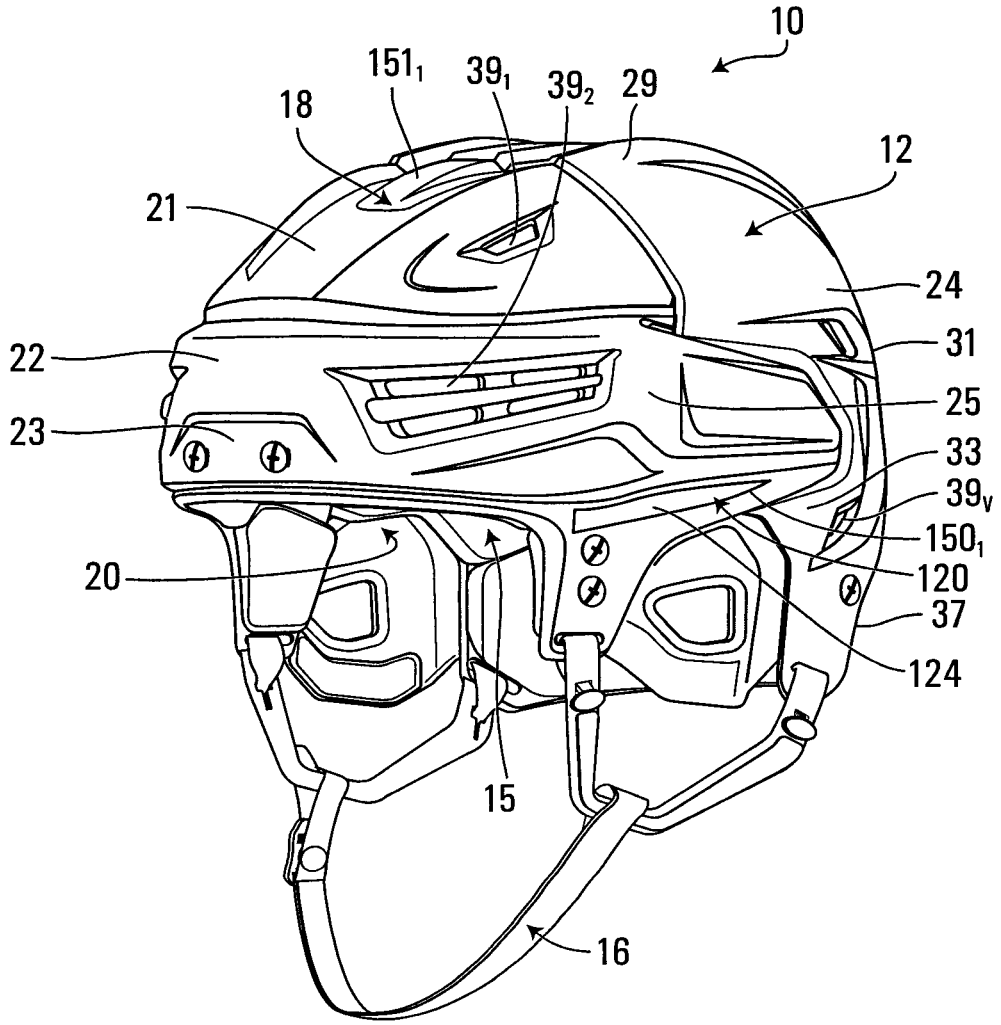
FIGS. 56 and 57 show an example of selected areas in which the impact deflector may be located.
Figure 57:
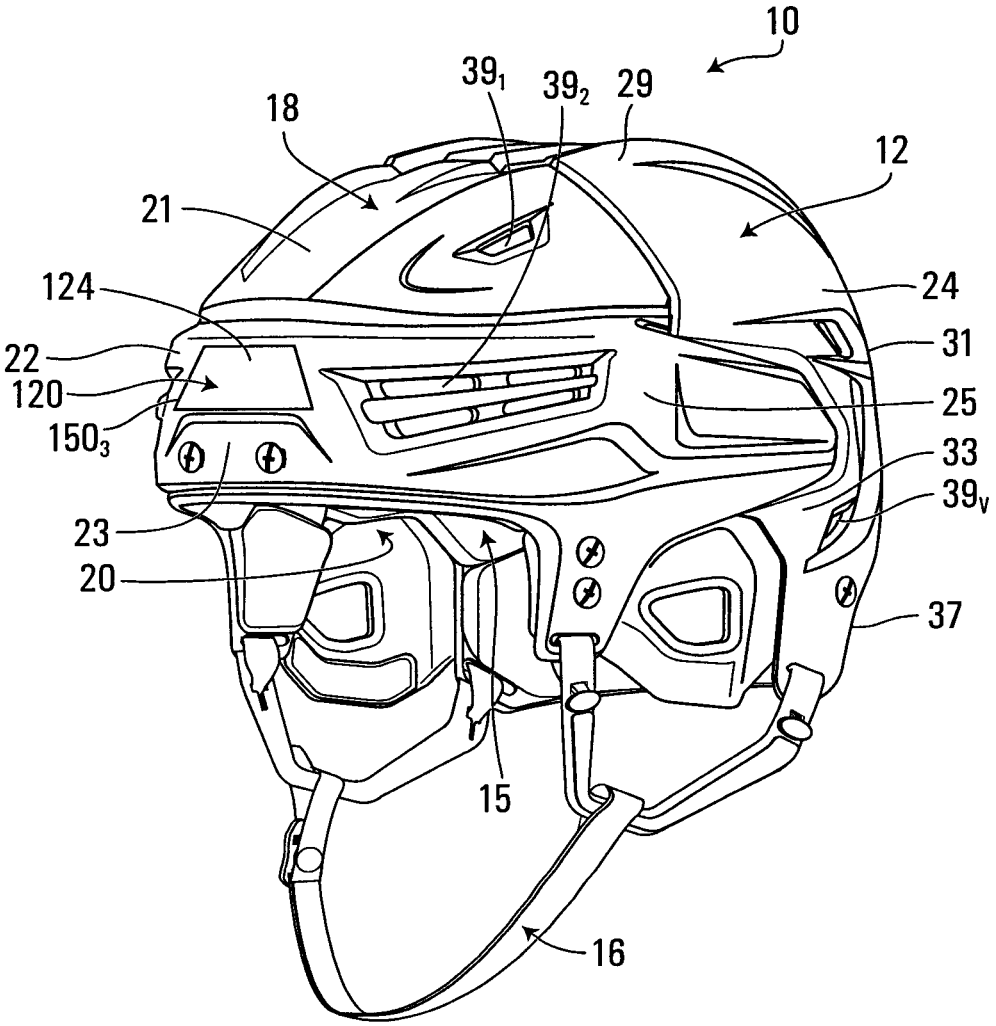

In some embodiments, with additional reference to FIG. 56, the low-friction material 124 may be present only in selected areas $150_1$-$150_M$ of the outer shell 12 which are more likely to be impacted. In one example, the selected areas $150_1$-$150_M$ may include temple areas adjacent to temples of the wearer's head 11. In particular, there may be a selected area $150_1$ which is a left temple area adjacent to the left temple of the wearer's head 11 and a selected area $150_2$ which is a right temple area adjacent to the right temple of the wearer's head 11, both comprising the low-friction material 124 (although FIG. 56 only illustrates the left temple area $\mathbf{150}_1$, the right temple area $\mathbf{150}_2$ is similar). The selected areas $\mathbf{150}_1$-$\mathbf{150}_M$ of the outer shell 12 may be arranged in other ways in other embodiments. For instance, as shown in FIG. 57, a selected area $\mathbf{150}_3$ including the low-friction material 124 may be a forehead area of the helmet 10 adjacent to the forehead of the wearer's head 11.

Conversely, in some embodiments, the low-friction material 124 may not be present in selected areas $\mathbf{151}_1$-$\mathbf{151}_L$ of the outer shell 12 which are less likely to be impacted, i.e., the selected areas $\mathbf{151}_1$-$\mathbf{151}_L$ of the outer shell 12 are free of the low-friction material 124. For example, in some embodiments, a selected area $\mathbf{151}_1$ may be a crown area facing the top of the wearer's head 11.

The impact deflector 120 may be configured in various other ways in other embodiments.

For example, in other embodiments, the low-friction material 124 may constitute at least a majority, in some cases an entirety, of the outer surface 19 of the outer shell 12.

Figure 58:
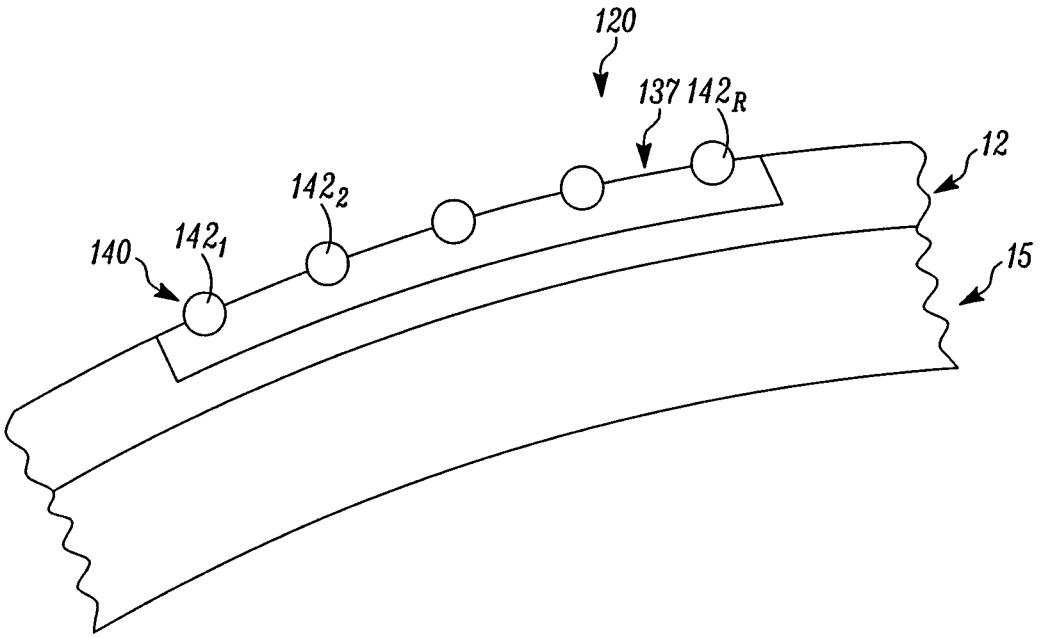
FIGS. 58 and 59 show other examples of an impact deflector at an external side of the outer shell.

By way of another example, in other embodiments, as shown in FIG. 58, the impact deflector 120 may comprise a movable interface 137 that can move relative to the outer surface 19 of the outer shell 12 when the movable interface 137 is impacted by an impacting object.

For instance, in this embodiment, the movable interface 137 comprises a rolling arrangement 140. More particularly, in this embodiment, the rolling arrangement 140 comprises a plurality of rollers $\mathbf{142}_1$-$\mathbf{142}_R$ that can roll relative to the outer surface 19 of the outer shell 12 when the rolling arrangement 140 is impacted by an impacting object. In this case, the rollers $\mathbf{142}_1$-$\mathbf{142}_R$ may be elongated rollers (e.g., cylindrical rollers). In other cases, the rollers $\mathbf{142}_1$-$\mathbf{142}_R$ may be spherical rollers (e.g., balls).

Figure 59:
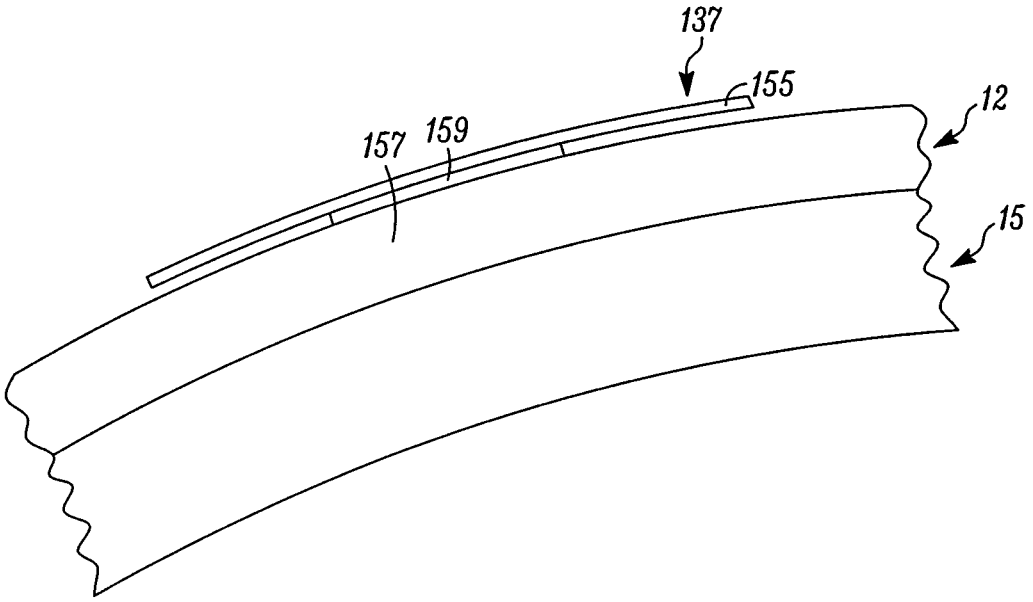

Alternatively, in other embodiments, as shown in FIG. 59, the movable interface 137 may comprise a plate 155 mounted to an underlying part 157 of the outer shell 12 by a connector 159 such that the plate 155 can move relative to the underlying part 157 of the outer shell 12 when the plate 155 is subject to a rotational impact. The plate 155 is mounted to the underlying part 157 of the outer shell 12 by a connector 159 such that the plate 155 can move relative to the underlying part 157 of the outer shell 12 when the plate 155 is subject to a rotational impact. In this case, the connector 159 may comprise an elastic member that can elastically stretch or otherwise deform to allow movement of the plate 155. In other cases, the connector 159 may be a mechanical link (e.g., a pivot).

2.2 Sacrificial Layer

Figure 60:
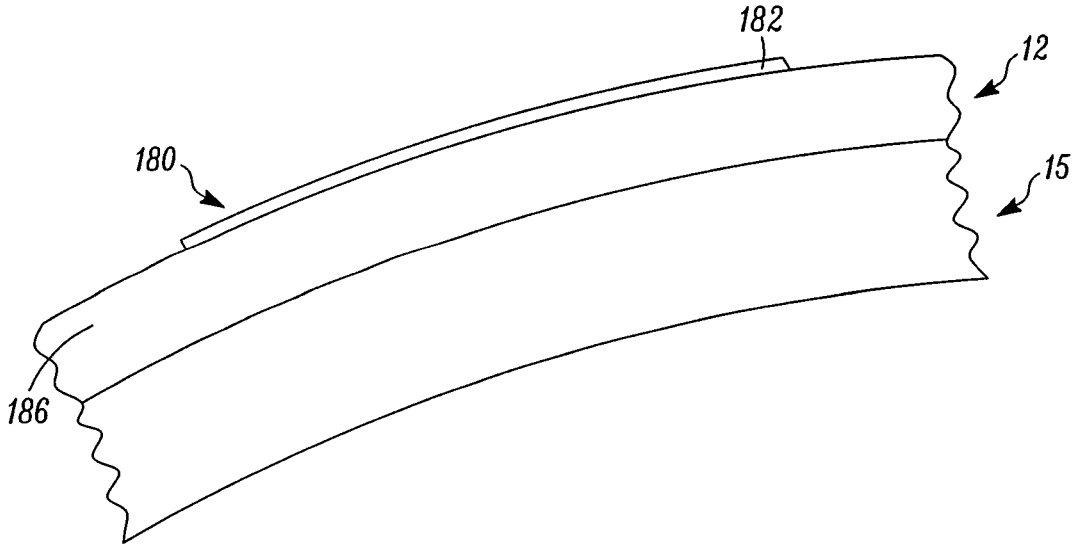
FIG. 60 shows an example of a sacrificial layer at an external side of the outer shell.

In some embodiments, as shown in FIG. 60, the external side of the outer shell 12 may comprise a sacrificial layer 180 configured to erode (e.g., scrape off) or be otherwise sacrificed at a point of rotational impact.

For instance, in this embodiment, the sacrificial layer 180 comprises a soft material 182. More particularly, in this embodiment, the soft material 182 is softer than a main material 186 of the outer shell 12 (i.e., the main material 186 of the outer shell 12 is that material making up a greatest proportion of the outer shell 12). For example, in some embodiments, a ratio $H_e/H_s$ of a hardness $H_e$ of the soft material 182 in durometers over a hardness $H_s$ of the main material 186 of the outer shell 12 in durometers may be no more than 0.9, in some cases no more than 0.8, in some cases no more than 0.7, in some cases no more than 0.6, in some cases no more than 0.5, in some cases no more than 0.4, in some cases no more than 0.3, and in some cases even less. For instance, in some embodiments, the hardness $H_e$ of the soft material 182 may be no more than a certain value in durometers. The soft material 182 may include a wax, silicone, or any other suitable material that can erode relatively easily upon being impacted.

In this embodiment, the soft material 182 is present only in selected areas $\mathbf{250}_1$-$\mathbf{250}_M$ of the outer shell 12 which are more likely to be impacted. For instance, the selected areas $\mathbf{250}_1$-$\mathbf{150}_M$ may include temple areas adjacent to temples of the wearer's head 11, as discussed previously in connection with the selected areas $\mathbf{150}_1$-$\mathbf{150}_M$ shown in FIG. 56.

The sacrificial layer 180 may be configured in various other ways in other embodiments.

For example, in other embodiments, the soft material 182 may constitute at least a majority, in some cases an entirety, of the outer surface 19 of the outer shell 12.

By way of another example, in some embodiments, the sacrificial layer 180 may be replaceable. For instance, in some cases, the sacrificial layer 180 may be peelable so that it can be peeled off when damaged and replaced by a new sacrificial layer 180*. The sacrificial layer 180 may include an adhesive layer that allows it to be adhesively bonded to the outer shell 12 and removed when it is to be replaced

3. Faceguard Providing Rotational Impact Protection

Figure 61:
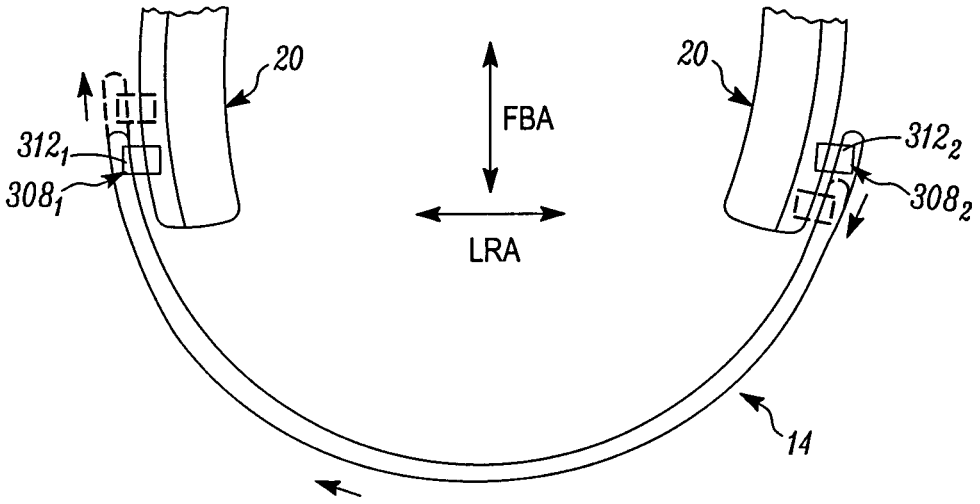
FIG. 61 shows an example of the faceguard being configured to provide rotational impact protection.

In some embodiments, as shown in FIG. 61, the faceguard 14 may be configured to absorb energy from a rotational impact.

In this embodiment, the faceguard 14 is mounted to be angularly movable (i.e., undergo an angular movement) relative to the internal surface 20 of the helmet 10 (e.g., the inner surface 34 of the inner padding 15) that contacts the wearer's head 11 in response to a rotational impact on the faceguard 14. For example, in some embodiments, the faceguard 14 may be angularly movable relative to the outer shell 12 by at least 2°, in some cases at least 5°, in some cases at least 10°, and in some cases even more. For instance, in some embodiments, the faceguard 14 may be movable (i.e., a point of the faceguard 14 may be movable) relative to the outer shell 12 by a distance (e.g., an arc length) of at least 2 mm, in some cases at least 5 mm, in some cases at least 10 mm, in some cases at least 20 mm, and in some cases even more.

In this embodiment, the faceguard 14 is mounted to the outer shell 12 by connectors $\mathbf{308}_1$, $\mathbf{308}_2$ on respective lateral sides of the faceguard 14 that allow the faceguard 14 to angularly move relative to the outer shell 12. For example, the connectors $\mathbf{308}_1$, $\mathbf{308}_2$ may comprise shock absorbers $\mathbf{312}_1$, $\mathbf{312}_2$ to absorb energy from impacts, including rotational impacts, on the faceguard 14. More particularly, in this example, each of the shock absorbers $\mathbf{312}_1$, $\mathbf{312}_2$ comprises a spring 322 which is a resilient object that is deformable (i.e., changeable in configuration) such that it changes in configuration under load and recovers its initial configuration when the load is removed. The spring 322 may be an elastomeric spring (e.g., a rubber spring), a coil spring (e.g., a metallic or polymeric coil spring), a leaf spring, a fluid spring (i.e., a spring including a liquid or gas contained in a container such as a cylinder or a bellows and variably compressed) such as a gas spring, or any other resilient object that changes in configuration under load and recovers its initial configuration when the load is removed.

The connectors $\mathbf{308}_1$, $\mathbf{308}_2$ may be such that a transversal displacement capability of the faceguard 14 relative to the internal surface 20 of the helmet 10 is greater than a longitudinal displacement capability of the faceguard 14 relative to the internal surface 20 of the helmet 10. The faceguard's transversal displacement capability is a capability of the faceguard 14 to move relative to the internal surface 20 of the helmet 10 in a direction parallel to the helmet's transversal (i.e., left-right) axis LRA, whereas the faceguard's longitudinal displacement capability is a capability of the faceguard 14 to move relative to the internal surface 20 of the helmet 10 in a direction parallel to the helmet's longitudinal (i.e., front-back) axis FBA.

The faceguard 14 may be prevented from contacting the wearer's face when the outer shell 12 angularly moves in response to a rotational impact.

The faceguard 14 may be configured in various other ways to provide rotational impact protection in other embodiments.

4. Multi-Level Rotational Impact Protection

Figure 62:
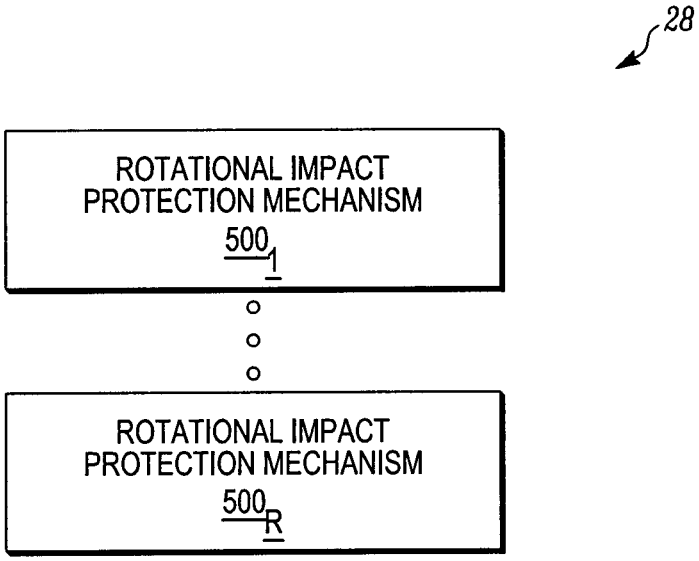
FIG. 62 shows an example of a rotational impact protection system of the helmet comprising a plurality of distinct rotational impact protection mechanisms.

In some embodiments, as shown in FIG. 62, the rotational impact protection system 28 of the helmet 10 may comprise a plurality of distinct rotational impact protection mechanisms $\mathbf{500}_1$-$\mathbf{500}_R$ to provide "multi-level" rotational impact protection. In response to a rotational impact, each of the rotational impact protection mechanisms $\mathbf{500}_1$-$\mathbf{500}_R$ absorbs some energy from the rotational impact such that, cumulatively, this reduces rotational energy transmitted to the wearer's head 11 and, therefore, an angular acceleration of the wearer's head 11 by a greater amount than that which would be achieved by any of the rotational impact protection mechanisms $\mathbf{500}_1$-$\mathbf{500}_R$ acting alone.

For instance, in some embodiments, each of the rotational impact protection mechanisms $\mathbf{500}_1$-$\mathbf{500}_R$ may include any feature considered herein in sections 1 to 3. For example, in some cases, a first one of the rotational impact protection mechanisms $\mathbf{500}_1$-$\mathbf{500}_R$ may include an internal rotational impact protection mechanism having any feature considered herein in section 1 and a second one of the rotational impact protection mechanisms $\mathbf{500}_1$-$\mathbf{500}_R$ may include an external rotational impact protection mechanism having any feature considered herein in section 2. As another example, in some cases, a first one of the rotational impact protection mechanisms $\mathbf{500}_1$-$\mathbf{500}_R$ may include an internal or external rotational impact protection mechanism having any feature considered herein in section 1 or 2 and a second one of the rotational impact protection mechanisms $\mathbf{500}_1$-$\mathbf{500}_R$ may relate to the faceguard 14 and have any feature considered herein in section 3.

In some embodiments, a first rotational impact protection mechanism $\mathbf{500}_i$ may be in series or cascading with a second rotational impact protection mechanism $\mathbf{500}_j$ such that, in response to a rotational impact, an action of the first rotational impact protection mechanism $\mathbf{500}_i$ induces an action of the rotational impact protection mechanism $\mathbf{500}_j$. For example, in some embodiments, a movement of a component of the first rotational impact protection mechanism $\mathbf{500}_i$ induces a movement of a component of the second rotational impact protection mechanism $\mathbf{500}_j$.

Figure 63:
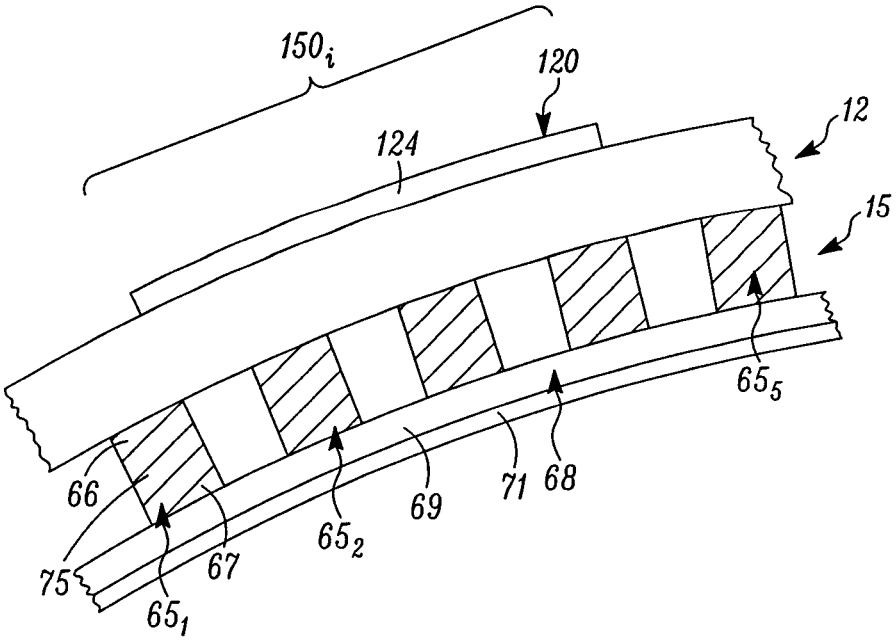
FIGS. 63 and 64 show other examples of the rotational impact protection system comprising a plurality of distinct rotational impact protection mechanisms.

For example, in some embodiments, as illustrated in FIG. 63, the arrangement of shock absorbers $\mathbf{65}_1$-$\mathbf{65}_N$ which are deformable in response to a rotational impact on the helmet 10 and discussed above are combined with the impact deflector 120 also discussed above. The rotational impact protection system 28 in this case thus includes two rotational impact protection mechanisms $\mathbf{500}_1$ and $\mathbf{500}_2$, where the arrangement of shock absorbers $\mathbf{65}_1$-$\mathbf{65}_N$ is the first rotational impact protection mechanism $\mathbf{500}_1$ and the impact deflector 120 is the second rotational impact protection mechanism $\mathbf{500}_2$. In this case, when a rotational impact force impacts the impact deflector 120, the impact deflector 120 will deflect some of the impact force. Then, part of the impact force not deflected will be absorbed by the shock absorbers $\mathbf{61}_1$-$\mathbf{61}_N$ that deform.

Although not illustrated in FIG. 63, the faceguard 14 implementing a rotational impact protection mechanism, as discussed above in section 3, could also be applied as a third rotational impact protection mechanisms $\mathbf{500}_3$ to the shock absorbers $\mathbf{65}_1$-$\mathbf{65}_N$ (i.e., the first rotational impact protection mechanism $\mathbf{500}_1$) and the impact deflector 120 (i.e., the second rotational impact protection mechanism $\mathbf{500}_2$), of the example discussed above.

Figure 64:
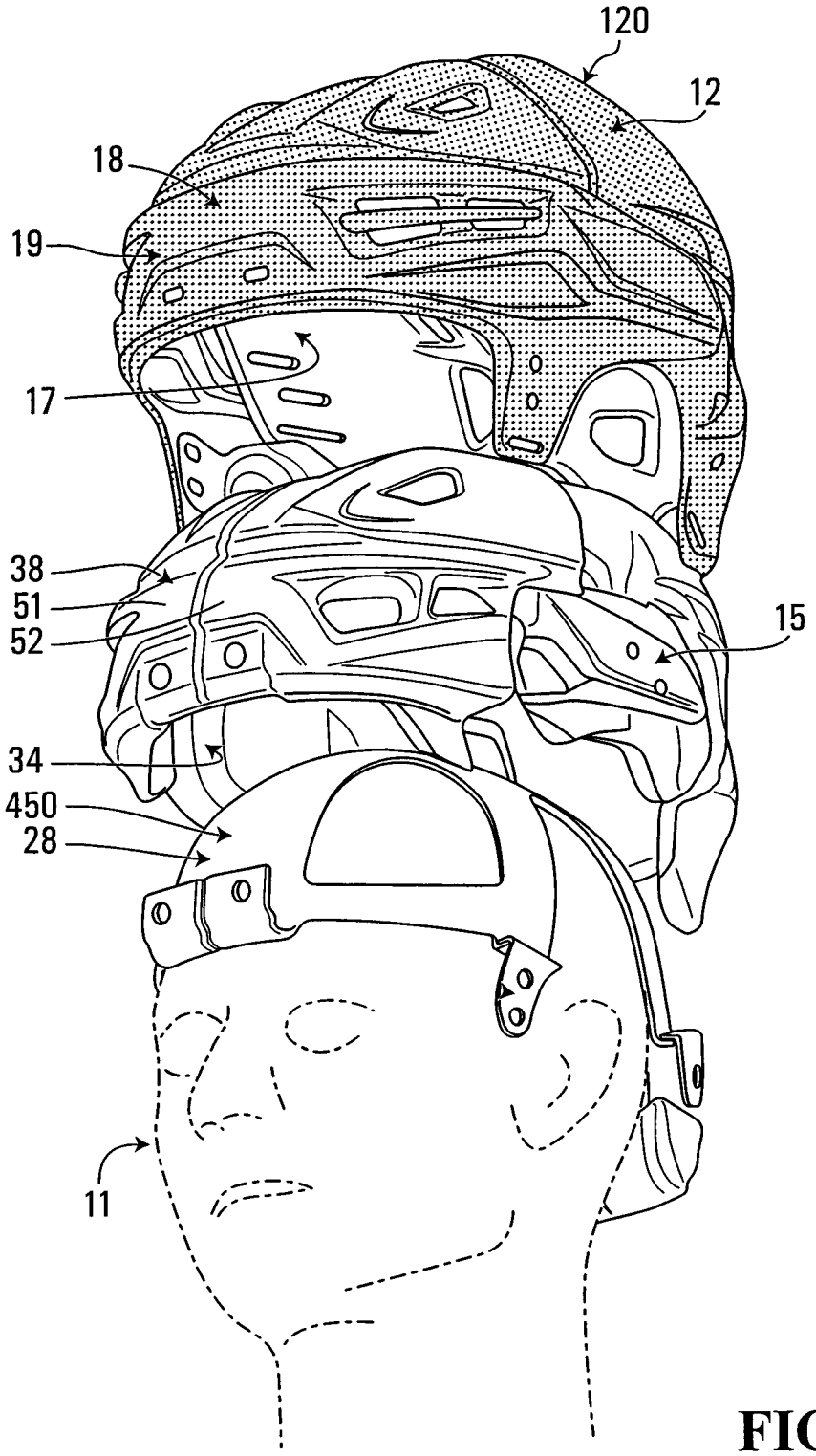

As another example, in some embodiments, as illustrated in FIG. 64, the floating liner 450 which is movable relative to the inner padding 15 and outer shell 12 and discussed above is combined with the impact deflector 120 also discussed above. In this case, the rotational impact protection system 28 thus includes two rotational impact protection mechanisms $\mathbf{500}_1$ and $\mathbf{500}_2$, where the floating liner 450 is the first rotational impact protection mechanism $\mathbf{500}_1$ and the impact deflector 120 is the second rotational impact protection mechanism $\mathbf{500}_2$.

Again, although not illustrated in FIG. 64, the faceguard 14 implementing a rotational impact protection mechanism, as discussed above in section 3, could also be applied as a third rotational impact protection mechanisms $\mathbf{500}_3$ to the floating liner 450 (i.e., the first rotational impact protection mechanism $\mathbf{500}_1$) and the impact deflector 120 (i.e., the second rotational impact protection mechanism $\mathbf{500}_2$), of the example discussed above.

The rotational impact protection mechanisms $\mathbf{500}_1$-$\mathbf{500}_R$ may be configured in various other ways in other embodiments.

Any feature of any embodiment discussed herein may be combined with any feature of any other embodiment discussed herein in some examples of implementation.

Although in embodiments considered above the helmet 10 is a hockey helmet for protecting the head of a hockey player, in other embodiments, a helmet constructed using principles described herein in respect of the helmet 10 may be another type of sport helmet. For instance, a helmet constructed using principles described herein in respect of the helmet 10 may be for protecting the head of a player of another type of contact sport (sometimes referred to as "full-contact sport" or "collision sport") in which there are significant impact forces on the player due to player-to-player and/or player-to-object contact. For example, in one embodiment, a helmet constructed using principles described herein in respect of the helmet 10 may be a lacrosse helmet for protecting the head of a lacrosse player. As another example, in one embodiment, a helmet constructed using principles described herein in respect of the helmet 10 may be a football helmet for protecting the head of a football player. As another example, in one embodiment, a helmet constructed using principles described herein in respect of the helmet 10 may be a baseball helmet for protecting the head of a baseball player (e.g., a batter or catcher). Furthermore, a helmet constructed using principles described herein in respect of the helmet 10 may be for protecting the head of a wearer involved in a sport other than a contact sport (e.g., bicycling, skiing, snowboarding, horseback riding or another equestrian activity, etc.).

Also, while in the embodiments considered above the helmet 10 is a sport helmet, a helmet constructed using principles described herein in respect of the helmet 10 may be used in an activity other than sport in which protection against head injury is desired. For example, in one embodiment, a helmet constructed using principles described herein in respect of the helmet 10 may be a motorcycle helmet for protecting the head of a wearer riding a motorcycle. As another example, in one embodiment, a helmet constructed using principles described herein in respect of the helmet 10 may be a industrial or military helmet for protecting the head of a wearer in an industrial or military application.

Although various embodiments and examples have been presented, this was for the purpose of describing, but not limiting, the invention. Various modifications and enhancements will become apparent to those of ordinary skill in the art and are within the scope of the invention, which is defined by the appended claims.

The invention claimed is:

1. A helmet for protecting a head of a wearer, the helmet comprising:

an outer shell; and padding configured to be disposed between the outer shell and the wearer's head, the padding comprising:

an outer part connected to the outer shell; and ii) an inner part configured to face the wearer's head, the inner part of the padding comprising a plurality of rotational impact protection pads that are spaced from one another and arranged so that the plurality of rotational impact protection pads are oriented towards different areas of the head of the wearer when the helmet is worn, each rotational impact protection pad being separately connected to the outer part of the padding by at least one connector such that each rotational impact protection pad is movable relative to the outer part of the padding by sliding against the outer part of the padding in response to a rotational impact on the helmet, wherein:

each rotational impact protection pad comprise a first shock absorbing material;

the outer part of the padding comprises a second shock absorbing material different from the first shock absorbing material; and the first shock absorbing material comprises a fluid contained within a container.

2. The helmet of claim 1, wherein the plurality of rotational impact protection pads includes four rotational impact protection pads, wherein, when the helmet is worn, the rotational impact protection pads are arranged to be distributed around the wearer's head such that one of the rotational impact protection pads is located to engage a front region of the wearer's head, one of the rotational impact protection pads is located to engage a left side region of the wearer's head, one of the rotational impact protection pads is located to engage a right side region of the wearer's head, and one of the rotational impact protection pads is located to engage a back region of the wearer's head.

3. The helmet of claim 2, wherein the plurality of rotational impact protection pads further includes a rotational impact protection pad located to engage a top region of the wearer's head when the helmet is worn.

4. The helmet of claim 1, wherein, for each rotational impact protection pad, the at least one connector connecting the rotational impact protection pad to the outer part of the padding is at least one of stretchable and bendable to allow the rotational impact protection pad to slide against the outer part of the padding in response to the rotational impact on the helmet.

5. The helmet of claim 1, wherein the container comprises a flexible bag, pouch or other envelope.

6. The helmet of claim 1, wherein the fluid comprises a liquid.

7. The helmet of claim 1, wherein the fluid comprises a gas.

8. The helmet of claim 1, wherein given ones of the rotational impact protection pads have different shapes from one another.

9. The helmet of claim 1, wherein given ones of the rotational impact protection pads have different sizes from one another.

10. The helmet of claim 1, wherein the outer part of the inner padding comprises a plurality of outer pads separate from one another.

11. The helmet of claim 10, wherein the outer shell comprises a first shell member and a second shell member movable relative to one another to adjust a size of the helmet.

12. The helmet of claim 11, wherein respective ones of the outer pads are secured to different ones of the first shell member and the second shell member to move relative to one another when the first shell member and the second shell member are moved relative to one another to adjust the size of the helmet.

13. The helmet of claim 1, wherein each rotational impact protection pad is movable omnidirectionally relative to the outer part of the padding in response to the rotational impact on the helmet.

14. The helmet of claim 1, wherein the helmet is a hockey helmet.

15. A helmet for protecting a head of a wearer, the helmet comprising:

an outer shell; and padding configured to be disposed between the outer shell and the wearer's head, the padding comprising:

i) an outer part connected to the outer shell; and ii) an inner part configured to face the wearer's head, the inner part of the padding comprising a plurality of rotational impact protection pads that are spaced from one another and arranged so that the plurality of rotational impact protection pads are oriented towards different areas of the head of the wearer when the helmet is worn, each rotational impact protection pad being separately connected to the outer part of the padding by at least one connector such that each rotational impact protection pad is movable relative to the outer part of the padding by sliding against the outer part of the padding in response to a rotational impact on the helmet, wherein at least one of the rotational impact protection pads has a multi-layer construction comprising a main shock absorption layer and a comfort layer, the comfort layer configured to be closer to the wearer's head than the main shock absorption layer of the at least one rotational impact protection pad when the helmet is worn.

16. The helmet of claim 15, wherein the outer part of padding comprises a plurality of outer pads separate from one another.

17. The helmet of claim 16, wherein the outer shell comprises a first shell member and a second shell member movable relative to one another to adjust a size of the helmet.

18. The helmet of claim 17, wherein respective ones of the outer pads are secured to different ones of the first shell member and the second shell member to move relative to one another when the first shell member and the second shell member are moved relative to one another to adjust the size of the helmet.

19. The helmet of claim 15, wherein each rotational impact protection pad is movable omnidirectionally relative to the outer part of the padding in response to the rotational impact on the helmet.

20. The helmet of claim 15, wherein the helmet is a hockey helmet.

* * * * *